US009975347B2

(12) United States Patent
Tozuka et al.

(10) Patent No.: US 9,975,347 B2
(45) Date of Patent: May 22, 2018

(54) LIQUID EJECTION APPARATUS AND LIQUID EJECTION METHOD

(71) Applicant: CANON KABUSHIKI KAISHA, Tokyo (JP)

(72) Inventors: Ayako Tozuka, Yokohama (JP); Shuzo Iwanaga, Kawasaki (JP); Shintaro Kasai, Yokohama (JP); Yoshiyuki Nakagawa, Kawasaki (JP); Akiko Saito, Tokyo (JP); Tomohiro Sato, Tokyo (JP); Takatsugu Moriya, Tokyo (JP); Koichi Ishida, Tokyo (JP); Tatsuya Yamada, Kawasaki (JP); Tomoki Ishiwata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/391,114

(22) Filed: Dec. 27, 2016

(65) Prior Publication Data

US 2017/0197430 A1 Jul. 13, 2017

(30) Foreign Application Priority Data

Jan. 8, 2016 (JP) ..... 2016-002777
Dec. 12, 2016 (JP) ..... 2016-240450

(51) Int. Cl.
*B41J 2/175* (2006.01)
*B41J 2/045* (2006.01)

(52) U.S. Cl.
CPC ..... *B41J 2/17566* (2013.01); *B41J 2/04508* (2013.01)

(58) Field of Classification Search
CPC ..... B41J 2/17506; B41J 2/17513; B41J 2/17523; B41J 2/17566; B41J 2/17556; B41J 2/17596; B41J 2/175696
See application file for complete search history.

(56) References Cited

U.S. PATENT DOCUMENTS

| | | | | |
|---|---|---|---|---|
| 7,758,136 | B2 | 7/2010 | Kachi | |
| 8,348,375 | B2 * | 1/2013 | Munakata | B41J 2/15 347/14 |
| 9,365,045 | B2 * | 6/2016 | Shibata | B41J 2/175 |
| 2010/0194801 | A1 * | 8/2010 | Hibi | B41J 2/155 347/9 |
| 2012/0200619 | A1 * | 8/2012 | Bibl | B41J 2/17513 347/6 |

FOREIGN PATENT DOCUMENTS

| | | |
|---|---|---|
| JP | 2005-280246 A | 10/2005 |
| JP | 2007-069419 A | 3/2007 |

* cited by examiner

*Primary Examiner* — Thinh H Nguyen
(74) *Attorney, Agent, or Firm* — Fitzpatrick, Cella, Harper & Scinto

(57) ABSTRACT

A liquid is reliably supplied to a liquid ejection head through a plurality of supply paths. The liquid is supplied to a plurality of areas of the liquid ejection head through the plurality of supply paths and a liquid ejection amount per unit time from the liquid ejection head is controlled so that a liquid flow amount of each of the areas becomes a predetermined flow amount or less.

11 Claims, 40 Drawing Sheets

LIQUID EJECTION APPARATUS AND LIQUID EJECTION METHOD

BACKGROUND OF THE INVENTION

Field of the Invention

The present invention relates to a liquid ejection apparatus and a liquid ejection method used to eject a liquid such as ink.

Description of the Related Art

In a recent inkjet liquid ejection head serving as a liquid ejection head ejecting liquid ink, there has been a demand for suppressing blurred printing caused by the insufficient supply of ink in order to meet an increase in image quality and printing speed. As a reason of blurred images, pressure loss in a passage supplying ink to an ink ejection opening is exemplified. Meanwhile, there is a tendency that the amount of a coloring material or a resin material in the ink increases to obtain high image quality. In addition, there is a tendency that a width of an ink passage decreases in accordance with the highly dense arrangement of the ejection openings. For these reasons, an increase in pressure loss accompanied by an increase in printing speed causes big problems.

Japanese Patent Laid-Open No. 2005-280246 discloses a method of predicting a printing duty from print data and controlling an ink flow amount in response to the printing duty so that an average ink flow amount for all ejection openings becomes a predetermined flow amount. Meanwhile, Japanese Patent Laid-Open No. 2007-69419 discloses a method of supplying ink to a plurality of ejection openings of a liquid ejection head through a plurality of branched supply paths in accordance with an increase in length of the liquid ejection head.

However, in the method of supplying the ink to the plurality of ejection openings of the liquid ejection head through the plurality of branched supply paths, there is concern that the ink may not be sufficiently supplied to a local part of the liquid ejection head when the ink flow amount is controlled on the basis of the average ink flow amount for all ejection openings as disclosed in Japanese Patent Laid-Open No. 2005-280246.

SUMMARY OF THE INVENTION

The present invention provides a liquid ejection apparatus and a liquid ejection method capable of stably supplying a liquid to a liquid ejection head through a plurality of supply paths.

In the first aspect of the present invention, there is provided a liquid ejection apparatus that ejects a liquid from a plurality of ejection openings of a liquid ejection head, the liquid ejection apparatus comprising: a supply path configured to communicate with the plurality of ejection openings and supplies the liquid to a plurality of areas of the liquid ejection head; and a controller configured to control a liquid ejection amount per unit time from the liquid ejection head so that a liquid flow amount of each of the areas becomes a predetermined flow amount or less.

In the second aspect of the present invention, there is provided an inkjet printing apparatus including the liquid ejection apparatus according to the first aspect of the present invention, wherein the liquid ejection head is an inkjet printing head capable of ejecting liquid ink supplied through the supply path from the plurality of ejection openings, and wherein the inkjet printing apparatus comprises a movement mechanism configured to relatively move the inkjet printing head and a printing medium to which ink ejected from the inkjet printing head is applied.

In the third aspect of the present invention, there is provided a liquid ejection method of ejecting a liquid from a plurality of ejection openings of a liquid ejection head, the liquid ejection method comprising the steps of: supplying the liquid to each of a plurality of areas communicating with the plurality of ejection openings of the liquid ejection head through a plurality of supply paths corresponding to the plurality of areas; and controlling a liquid ejection amount per unit time from the liquid ejection head so that a liquid flow amount of each of the areas becomes a predetermined flow amount or less.

According to the present invention, since the liquid flow amount of each of the plurality of areas of the liquid ejection head to which the liquid is supplied through the plurality of supply paths becomes a predetermined flow amount or less, the liquid can be stably supplied to the liquid ejection head while the locally insufficient supply of the liquid is suppressed.

Further features of the present invention will become apparent from the following description of exemplary embodiments (with reference to the attached drawings).

DESCRIPTION OF THE EMBODIMENTS

Hereinafter, embodiments of the present invention will be described with reference to the drawings.

First Embodiment

A liquid ejection apparatus of the first embodiment is an application example of an inkjet printing apparatus which prints an image by using an inkjet liquid ejection head ejecting ink as a liquid. Further, a liquid ejection head ejecting a liquid such as ink and a liquid ejection apparatus equipped with the liquid ejection head can be applied to a printer, a copying machine, a facsimile having a communication system, a word processor having a printer, and an industrial printing apparatus combined with various processing devices. For example, the liquid ejection head and the liquid ejection apparatus can be used to manufacture a biochip, print an electronic circuit, or manufacture a semiconductor substrate. Further, since the embodiments to be described below are detailed examples of the present invention, various technical limitations thereof can be made. However, the application examples and the embodiments are not limited to the application examples, the embodiments, and the other detailed methods of the specification and can be modified within the spirit of the present invention.

(Configuration of Printing Apparatus)

Figure 1A:
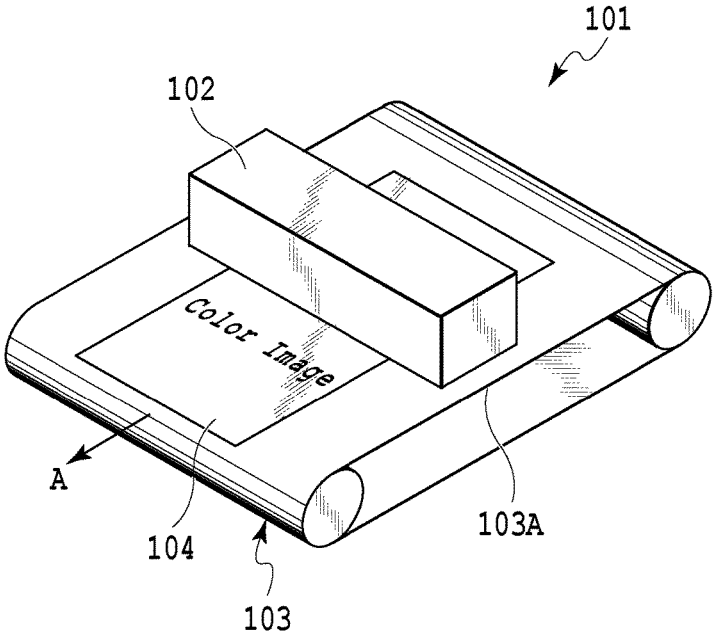
FIG. 1A is a schematic perspective view illustrating a printing apparatus which serves as a liquid ejection apparatus according to a first embodiment of the present invention.

FIG. 1A is a schematic perspective view illustrating a basic configuration of an inkjet printing apparatus 101 according to the present invention. The printing apparatus 101 of this example is a printing apparatus having a page wide type liquid ejection head and includes a conveying unit 103 which conveys a printing medium 104 in a conveying direction indicated by an arrow A and an inkjet printing head (a liquid ejection head) 102 which ejects ink. The conveying unit 103 of this example conveys the printing medium 104 by using a conveyor belt 103A. The liquid ejection head 102 is a line type (page wide type) liquid ejection head which extends in a direction (an orthogonal direction in the case of this example) intersecting the conveying direction of the printing medium 104 and a plurality of ejection openings ejecting ink are arranged in a width direction of the printing medium 104. The ink is supplied from an ink tank (not illustrated) to the liquid ejection head 102 through an ink supply portion constituting the ink passage. When the ink is ejected from the ejection opening of the liquid ejection head 102 to the printing medium 104 on the basis of print data (ejection data) while the printing medium 104 is continuously conveyed, an image is printed on the printing medium 104. The printing medium 104 is not limited to a cut sheet and may be an elongated roll sheet.

Figure 1B:
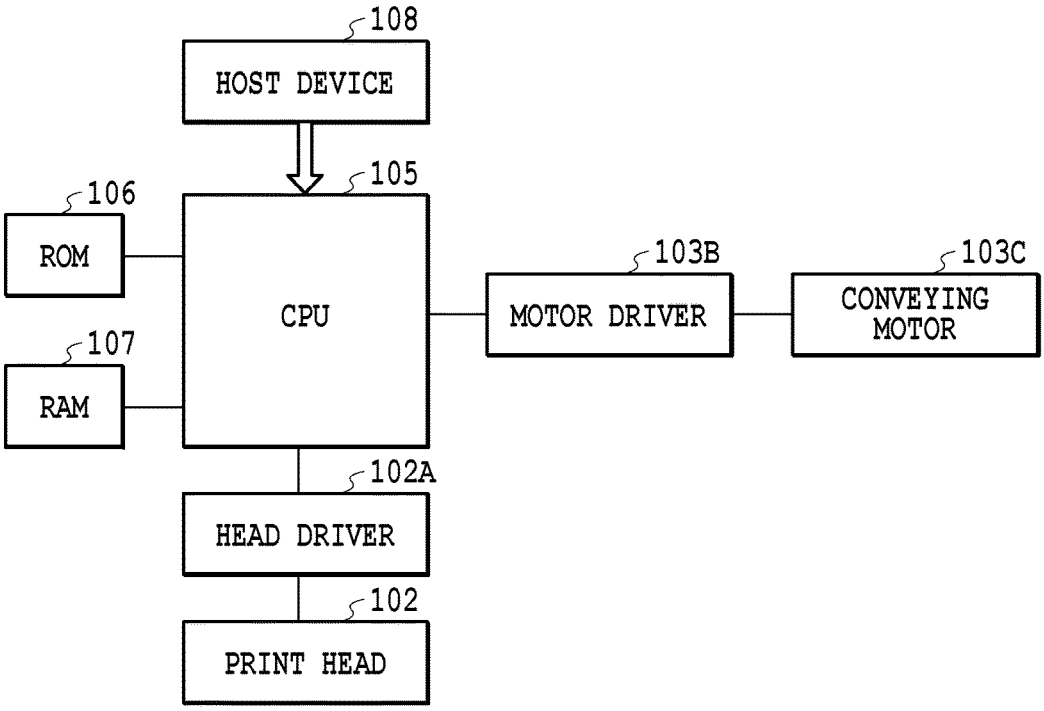
FIG. 1B is a block diagram illustrating a control system of the printing apparatus of FIG. 1A.

FIG. 1B is a block diagram illustrating a configuration example of a control system of the printing apparatus 101. A CPU 105 performs an operation control process or a data process of the printing apparatus 101. A ROM 106 stores a program of a process sequence and a RAM 107 is used as a work area for performing the processes. The liquid ejection head 102 includes a plurality of ejection openings, a plurality of ink passages respectively communicating with the ejection openings, and a plurality of ejection energy generation elements respectively disposed in the ink passages. Accordingly, a plurality of nozzles capable of ejecting the ink are formed. These nozzles serve as print elements. As an ejection energy generation element, an electro thermal conversion element or a piezo element can be used. When the electro thermal conversion element is used, the ink inside the ink passage is changed into bubbles by the heat of the electro thermal conversion element and the ink can be ejected from the ejection opening by using the foaming energy. The ejection of the ink from the liquid ejection head 102 is performed in such a manner that the CPU 105 drives the ejection energy generation element through a head driver 102A on the basis of image data input from a host device 108 or the like. The CPU 105 drives a conveying motor 103C driving the conveying unit 103 through a motor driver 103B.

(Configuration of Liquid Ejection Head)

Figure 2A:
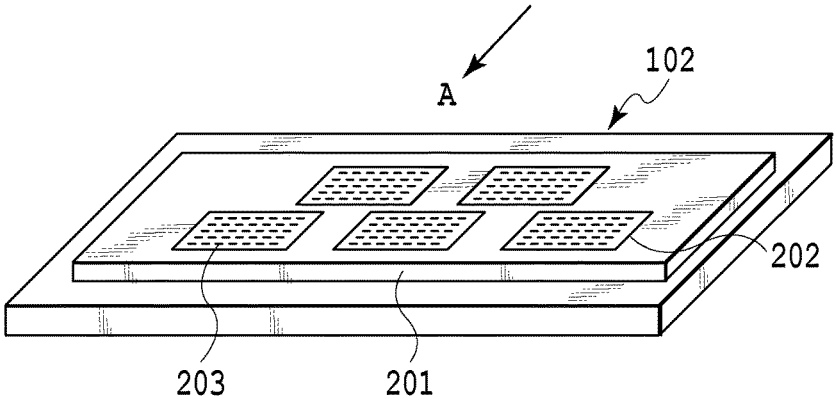
FIGS. 2A, 2B, and 2C are perspective views respectively illustrating different configuration examples of a liquid ejection head of FIG. 1A.
Figure 2B:
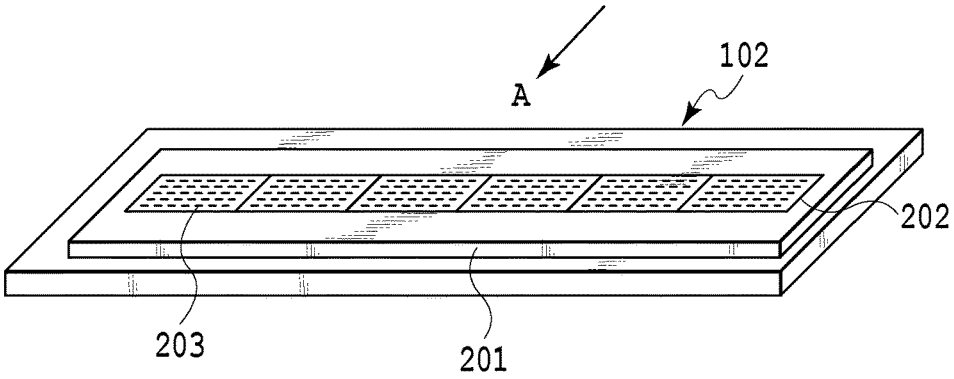
Figure 2C:
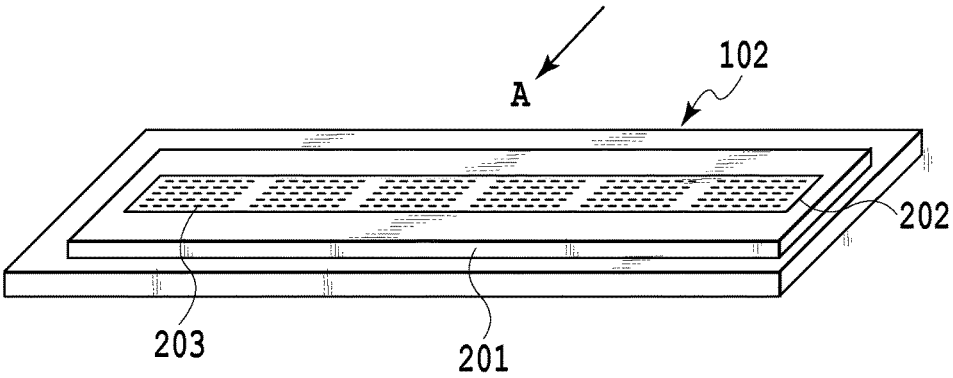

As in FIGS. 2A, 2B, and 2C, the liquid ejection head 102 includes a print element board (a liquid ejection substrate) 202 and a support member 201 supporting the print element board, and the print element board 202 is provided with an ejection opening 203, an ink passage, and an ejection energy generation element.

The plurality of print element boards 202 are disposed on the liquid ejection head 102 of FIG. 2A in a zigzag shape and the plurality of ejection openings 203 are disposed in a direction (an orthogonal direction in the case of this example) intersecting the conveying direction indicated by the arrow A. In the case of this example, the ejection openings 203 are disposed to form four ejection opening arrays and the ejection opening arrays may be configured to eject different inks or the same ink. The plurality of print element boards 202 are disposed to contact one another at the liquid ejection head 102 of FIG. 2B. A single print element board 202 is disposed at the liquid ejection head 102 of FIG. 2C. A configuration of the liquid ejection head 102 is not limited to the examples of FIGS. 2A, 2B, and 2C, and various configurations can be arbitrarily employed.

(Configuration of Ink Supply System)

Figure 3:
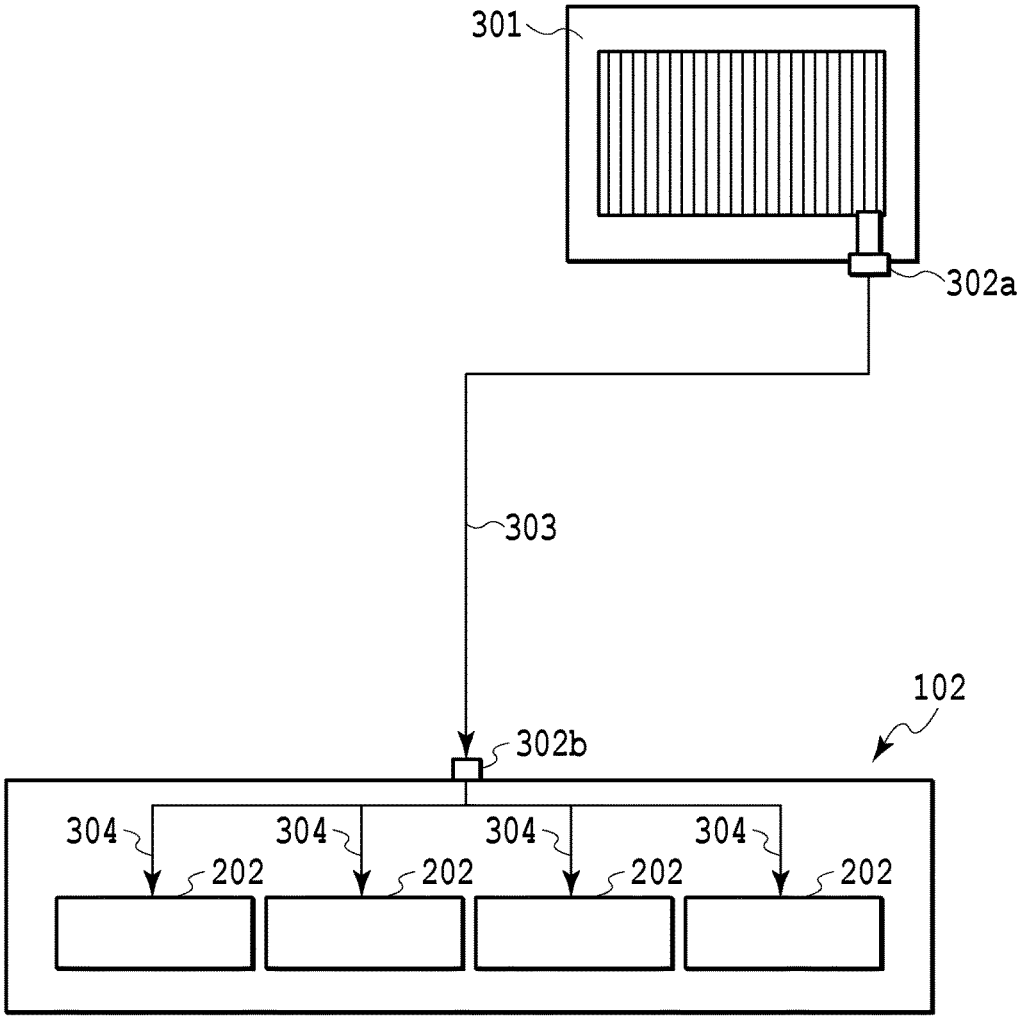
FIG. 3 is an explanatory diagram illustrating an ink supply system for the liquid ejection head of FIG. 1A.

FIG. 3 is a schematic diagram illustrating a configuration example of a supply system that supplies the ink to the liquid ejection head 102.

A liquid connection portion 302*b* of the liquid ejection head 102 is fluid-connected to a main tank 301 through a common passage 303. The common passage 303 and the liquid ejection head 102 are connected to a liquid connection portion 302*a* and the ink inside the main tank 301 is supplied to the liquid ejection head 102. The ink which is supplied to the liquid ejection head 102 is divided through a plurality of branch passages 304 branched from the common passage 303 and is supplied to the print element boards 202 corresponding to the branch passages 304.

(Description of Configuration of Print Element Board)

Figure 4A:
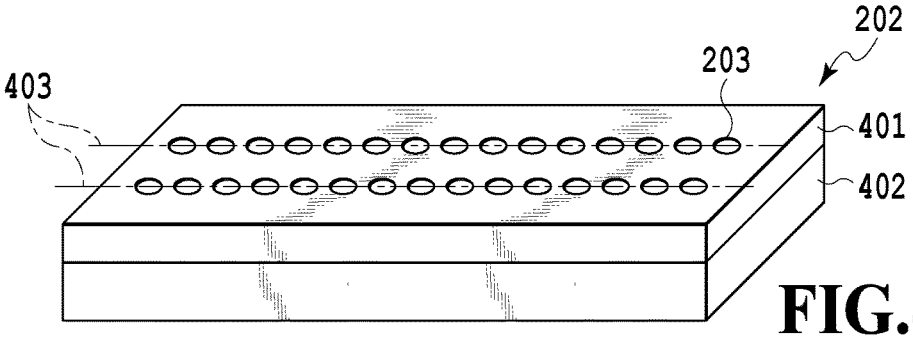
FIG. 4A is a perspective view illustrating a print element board of the liquid ejection head of FIG. 1A.
Figure 4B:
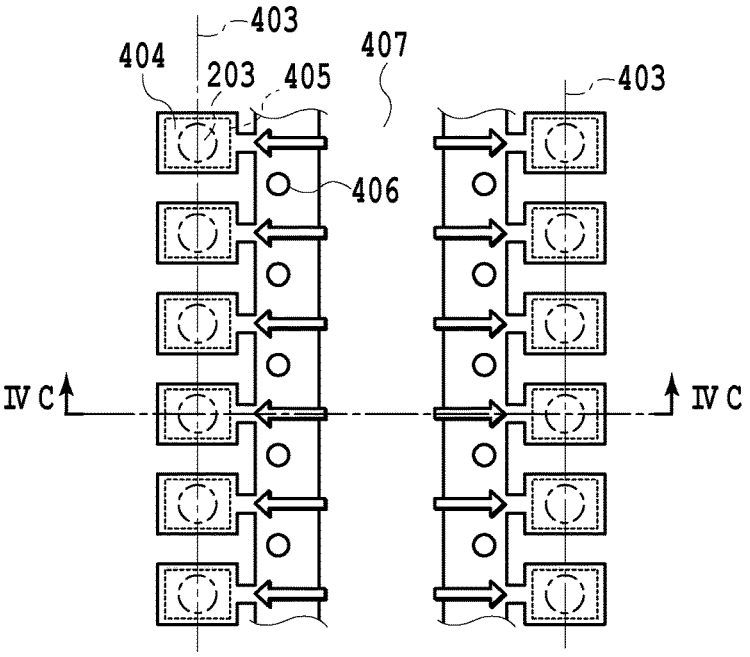
FIG. 4B is an enlarged view illustrating a main part of the liquid ejection head.
Figure 4C:
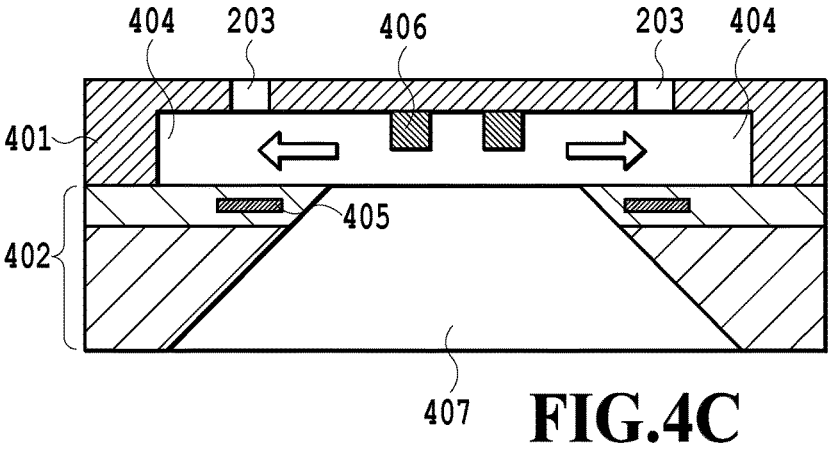
FIG. 4C is a cross-sectional view taken along a line IVC-IVC of FIG. 4B.

FIGS. 4A, 4B, and 4C are explanatory diagrams illustrating a configuration example of the print element board 202 of the liquid ejection head 102.

FIG. 4A is a perspective view illustrating the print element board 202 of this example, and an orifice plate 401 is bonded onto a substrate 402. The orifice plate 401 is provided with the plurality of ejection openings 203, and the ejection openings 203 form an ejection opening array 403. Electronic devices such as an ejection energy generation element, an electric circuit, an electric wire, and a temperature sensor can be disposed on a front face of the substrate 402 by semiconductor processing. For that reason, a material such as a semiconductor substrate capable of forming a passage therein by MEMS processing is desirable as the material of the substrate 402. An arbitrary material can be used as the material of the orifice plate 401. For example, a resin substrate capable of forming the ejection opening therein by laser processing, an inorganic plate capable of forming the ejection opening therein by dicing, a photosensitive resin material capable of forming the ejection opening and the passage therein by light curing, and a semiconductor substrate capable of forming the ejection opening and the passage therein by MEMS processing can be used.

FIG. 4B is an enlarged perspective view illustrating the print element board 202 when viewed from the orifice plate 401, and FIG. 4C is a cross-sectional view taken along a line IVC-IVC of FIG. 4B. Referring to FIGS. 4B and 4C, a configuration of the print element board will be described. A pressure chamber 404 is formed in a space between the substrate 402 and the orifice plate 401. An energy generation element 405 for ejecting the ink from the ejection opening 203 is disposed at a position of the substrate 402 facing the ejection opening 203. As the energy generation element 405, an electro thermal conversion element (a heater) or a piezo element can be used. The pressure chamber 404 is fluid-connected to a common liquid chamber 407 so that a series of ink passages (fluid passages) are formed. The ejection opening arrays 403 are formed at both sides (the left and right sides of FIGS. 4B and 4C) of the common liquid chamber 407 extending in the vertical direction of FIG. 4B in parallel to the common liquid chamber 407, and the ink inside the common liquid chamber 407 is ejected from the ejection openings 203 through the pressure chambers 404 at both sides of the common liquid chamber.

(Pressure Loss of Ink Supply System)

In general, when the ink is ejected from the liquid ejection head 102 to print an image, the pressure loss of the ink supply system increases in accordance with an increase in viscosity of the ink and an increase in ink ejection frequency. Accordingly, a printing failure easily occurs due to the insufficient supply of the ink. Hereinafter, the reason will be described.

Pressure loss $\Delta P$ generated when the ink is ejected from the ejection opening can be obtained by multiplying a viscous resistance R of a supply passage by an ink flow amount Q. The viscous resistance R changes in accordance with the viscosity of the ink, and the pressure loss increases in accordance with an increase in viscosity of the ink. In addition, the ink supply passage extending to the ejection opening is also narrowed due to an increase in density of the arrangement of the ejection openings, whereby the pressure loss increases. For that reason, since an ink droplet forming operation is disturbed when a meniscus is depressed (an increase in mist and a change in ejection amount Vd), there is concern of a printing failure. Thus, it is thought that the influence of the local pressure loss can be suppressed when the pressure loss is calculated by the unit of the monitoring area. The flow amount Q is determined by the number of the ejection openings and the ink ejection frequency (corresponding to the number of the ejected inks per unit time).

In the embodiment, as illustrated in FIGS. 6A to 10B, the pressure loss of each monitoring area of the print element boards corresponding to the branch passages arranged in parallel is calculated. However, the monitoring area is not limited to that of the embodiment. For example, in a configuration in which the ink is supplied from a main common supply passage through which a circulation flow flows from the upstream side to the downstream side to the plurality of print element boards 202, the pressure loss of the downstream print element board 202 is larger than that of the upstream print element board 202. With such a configuration, when the ink is ejected from both the upstream and downstream print element boards, the ink is not sufficiently supplied to the downstream print element board 202. In this way, when the ink flow amount (the liquid flow amount) is controlled in consideration of the influence of the pressure loss of each print element board, the locally insufficient supply of the ink in the plurality of print element boards is reduced and thus the ink can be supplied normally. Further, a duty threshold value in the monitoring area is determined on the basis of a calculated ink flow amount to be described below. Further, a print medium conveying direction (a relative movement direction with respect to the liquid ejection head) can be arbitrarily set in consideration of pressure loss obtained from a printed image.

(Control Example of Ink Flow Amount)

Figure 5:
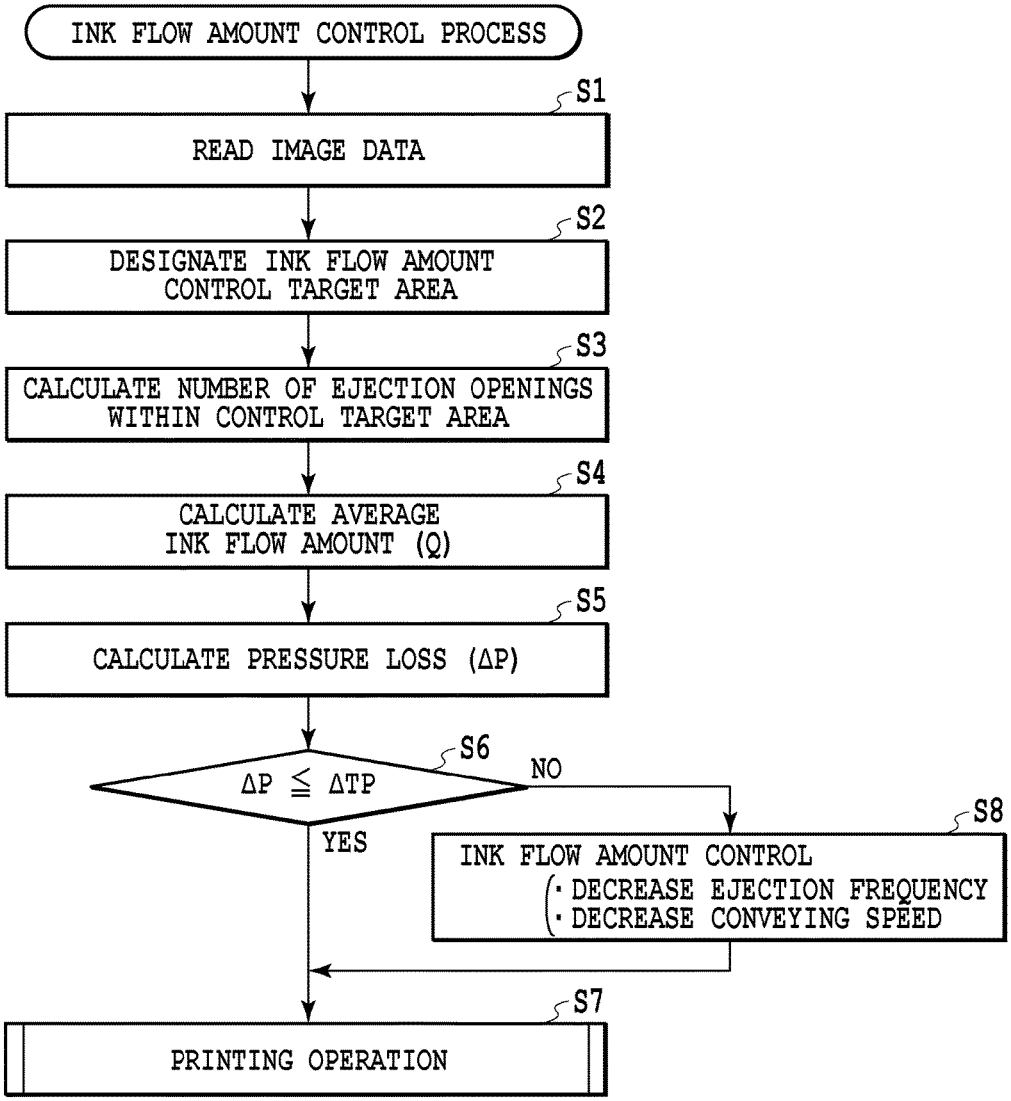
FIG. 5 is a flowchart illustrating an ink flow amount control process in the printing apparatus of FIG. 1A.

FIG. 5 is a flowchart illustrating an ink flow amount control process which is performed by the CPU 105.

The CPU 105 reads image data from the host device 108 or the like (step S1), designates an ink flow amount monitoring area (step S2), and calculates the number of the ejection openings within that area (step S3). The ink flow amount monitoring area will be described below. The processes in step S2 and step S3 can be performed on the basis of existing parameters. Accordingly, there is no need to calculate the number of the ejection openings and the monitoring areas every printing operation. Then, these values may be stored as given values in design. Based on the ejection frequency and the ejection amount of the ink ejected from the monitoring area and the number of the ejection openings within the monitoring area in every monitoring area, an average flow amount Q of the ink passing through the monitoring area is calculated (step S4). Then, the monitoring areas are recognized as pressure loss portions and the pressure loss ΔP is calculated from a viscous resistance R and an average flow amount Q of the ink in every monitoring area (step S5). Then, it is determined whether the pressure loss ΔP exceeds a predetermined value ΔTP (step S6). When the pressure loss ΔP does not exceed the predetermined value ΔTP, the printing operation is performed without the control of the ink flow amount (step S7). Meanwhile, when the pressure loss ΔP exceeds the predetermined value ΔTP, the ink flow amount is controlled (step S8). That is, when the ink ejection frequency is decreased and the conveying speed of the printing medium 104 is decreased to correspond to a decrease in ink ejection frequency, the ink flow amount of the ink passing through the monitoring area is decreased. Accordingly, the pressure loss ΔP in the monitoring area can be suppressed to a predetermined value ΔTP or less. Subsequently, a printing operation is performed (step S7).

FIGS. 6A to 6D are explanatory diagrams of the ink flow amount monitoring area.

Figure 6A:
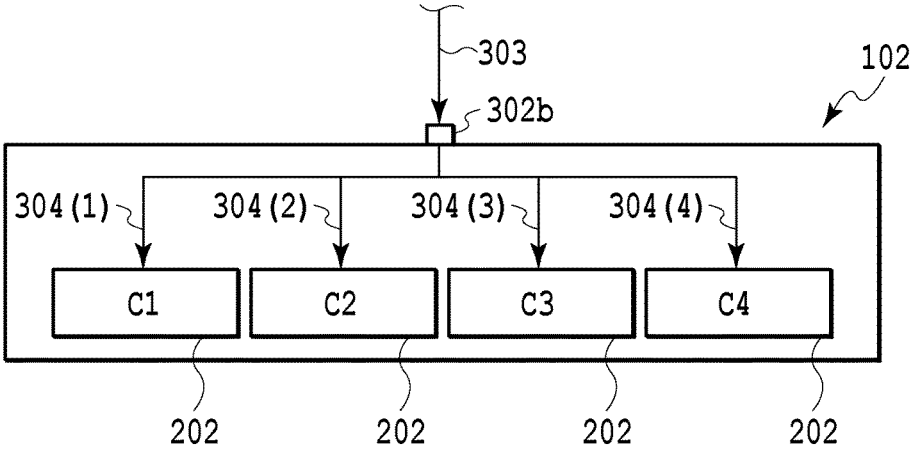
FIG. 6A is an explanatory diagram illustrating an arrangement example of the print element board of the liquid ejection head.
Figure 6B:
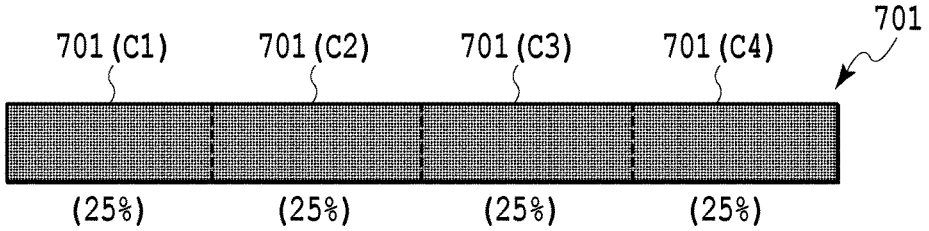
FIGS. 6B, 6C, and 6D are explanatory diagrams respectively illustrating ink passages having different printing duties.
Figure 6C:
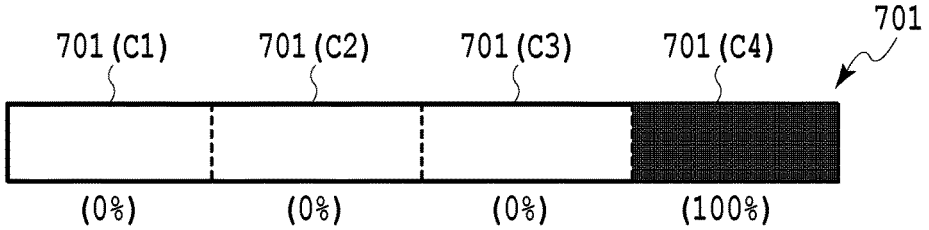
Figure 6D:
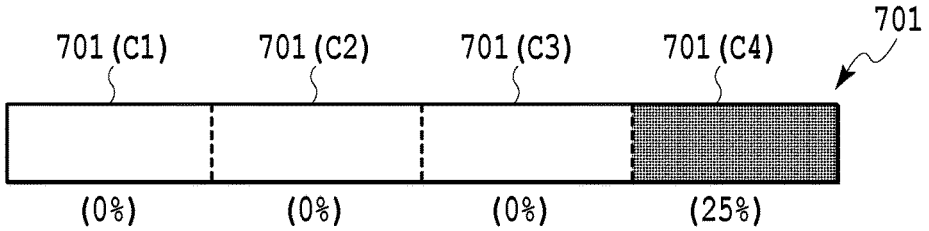

As in FIG. 6A, four print element boards 202 of the liquid ejection head 102 are set as substrates C1, C2, C3, and C4. The liquid ejection head of the embodiment is of a page wide type having a length corresponding to the width of the print medium, but in order to simplify the description, a configuration having four print element boards will be described. FIGS. 6B, 6C, and 6D illustrate print patterns 701 which are printed on the printing medium 104 and the patterns 701(C1), 701(C2), 701(C3), and 701(C4) respectively correspond to the substrates C1, C2, C3, and C4. For the convenience of description, it is assumed that the pressure loss becomes the predetermined value ΔTP when a printing duty of each of the substrates C1, C2, C3, and C4 is 25% and the pressure loss exceeds the predetermined value ΔTP when the average printing duty exceeds 25%. The printing duty corresponds to the ink application amount by the unit print area, and the printing duty becomes 100% when a solid image is printed.

FIG. 6B is an explanatory diagram illustrating a case where the printing duties of all substrates C1, C2, C3, and C4 are 25%. In this case, the average printing duty of the entire liquid ejection head 102 becomes 25% and thus an image can be printed normally. FIG. 6C is an explanatory diagram illustrating a case where the printing duties of the substrates C1, C2, and C3 are 0% and the printing duty of the substrate C4 is 100%. Even in this case, the average printing duty of the entire liquid ejection head 102 becomes 25%. However, since the printing duty of the substrate C4 is 100%, the ink excessively flows to the branch passage 304(4) of the substrate C4 and thus the pressure loss increases. In such a case, if the ink flow amount is controlled on the condition that the average printing duty of the entire liquid ejection head 102 exceeds 25%, there is concern that the ink flow amount is not controlled and the ink is not sufficiently supplied to the substrate C4. In order to avoid the insufficient supply of the ink, there is a need to control the ink flow amount when the printing duty of any one of the substrates C1, C2, C3, and C4 exceeds 25%. For that reason, as in FIG. 6D, a case is also assumed that the printing duties of the substrates C1, C2, and C3 are 0% and the printing duty of the substrate C4 is 25%. Then, the ink flow amount needs to be controlled when the printing duty of the substrate C4 exceeds 25%. In the case of FIG. 6D, the average printing duty of the entire liquid ejection head 102 becomes 6%. Thus, the average printing duty needs to be suppressed to 6% and thus the ink flow amount is excessively suppressed. Specifically, the ink ejection frequency and the printing medium conveying speed need to be ¼.

In the embodiment, the ink flow amount is controlled on the basis of the printing duty of each of the print element boards (the liquid ejection substrates) corresponding to the ink branch passage in consideration of such circumstances. In the above-described example, the ink flow amount is controlled when the printing duty of at least one of the substrates C1, C2, C3, and C4 exceeds 25%.

Figure 7A:
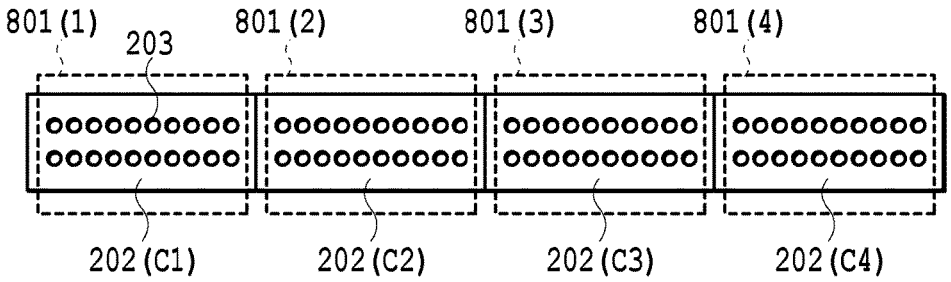
FIG. 7A is an explanatory diagram illustrating an example of a pressure loss monitoring area of the liquid ejection head.
Figure 7B:
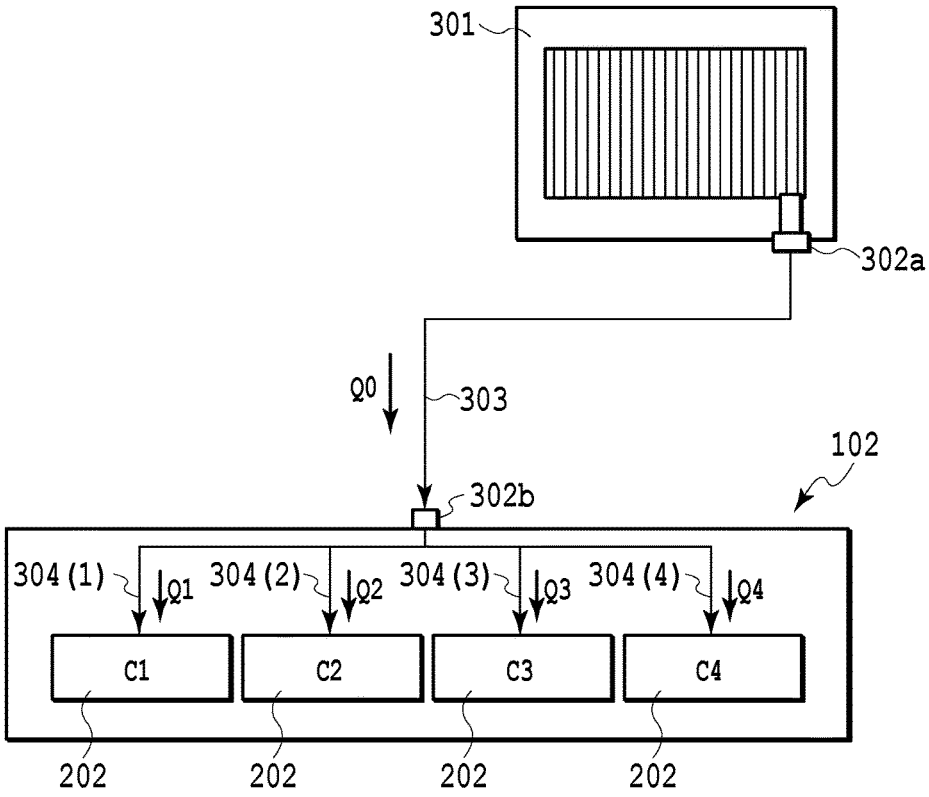
FIG. 7B is an explanatory diagram illustrating a relation between a branch passage and the monitoring area of FIG. 7A.

In the embodiment, as in FIG. 7A, monitoring areas 801 (801(1), 801(2), 801(3), and 801(4)) are set by the units of the substrates C1, C2, C3, and C4, and the pressure loss ΔP of each area is calculated. Generally, the pressure loss ΔP is expressed by Equation (1) below when the flow resistance is indicated by R [Pa·s/m$^3$] and the flow amount is indicated by Q [m$^3$/s].

$$\Delta P = R \times Q \quad (1)$$

The flow amount Q is expressed by Equation (2) below when the number of the ejection openings is indicated by n, the ejection amount is indicated by Vd [$m^3$], and the ejection frequency is indicated by fop [Hz].

$$Q=n\times Vd\times fop \quad (2)$$

In the embodiment, the pressure loss ΔP is calculated of each of the monitoring areas 801 (801(1), 801(2), 801(3), and 801(4)). That is, as in FIG. 7B, the pressure loss ΔP of each of the substrates C1, C2, C3, and C4 to which the ink is supplied from four branch passages 304 (304(1), 304(2), 304(3), and 304(4)) branched from the common passage 303 is calculated. The flow resistance from the connection portion 302*a* connecting the main tank 301 and the common passage 303 to each other and the connection portion 302*b* connecting the common passage 303 and the liquid ejection head 102 to each other is indicated by R0 and the flow amount in the section is indicated by Q0. First, when the flow resistance of the branch passage 304(1) is indicated by R1 and the flow amount thereof is indicated by Q1, the pressure loss ΔP1 of the substrate C1 is expressed by Equation (3) below.

$$\Delta P1=R0\times Q0+R1\times Q1 \quad (3)$$

Similarly, the pressure losses ΔP2, ΔP3, and ΔP4 of the substrates C2, C3, and C4 are expressed by Equations (4), (5), and (6) below.

$$\Delta P2=R0\times Q0+R2\times Q2 \quad (4)$$

$$\Delta P3=R0\times Q0+R3\times Q3 \quad (5)$$

$$\Delta P4=R0\times Q0+R4\times Q4 \quad (6)$$

It is assumed that the pressure loss becomes the predetermined value ΔTP when the printing duty of each of the substrates C1, C2, C3, and C4 becomes 25% and the pressure loss exceeds the predetermined value ΔTP when the average printing duty exceeds 25%. When the print patterns 701 of FIG. 6B are printed, since all printing duties of the substrates C1, C2, C3, and C4 do not exceed 25%, the ink ejection frequency and the printing medium conveying speed do not need to be decreased. That is, an image can be printed without a decrease in printing speed. When the print patterns 701 of FIG. 6C are printed, since the printing duty of the substrate C4 exceeds 25%, the ink ejection frequency and the printing medium conveying speed are decreased to decrease the ink flow amount. Accordingly, the pressure loss is suppressed so that the insufficient supply of the ink does not occur.

A configuration in which the substrate common passage 303 is branched to the plurality of branch passages 304 in order to supply the ink to the plurality of print element boards 202 is not limited to a configuration in which one branch passage 304 corresponds to one print element board 202.

Figure 8A:
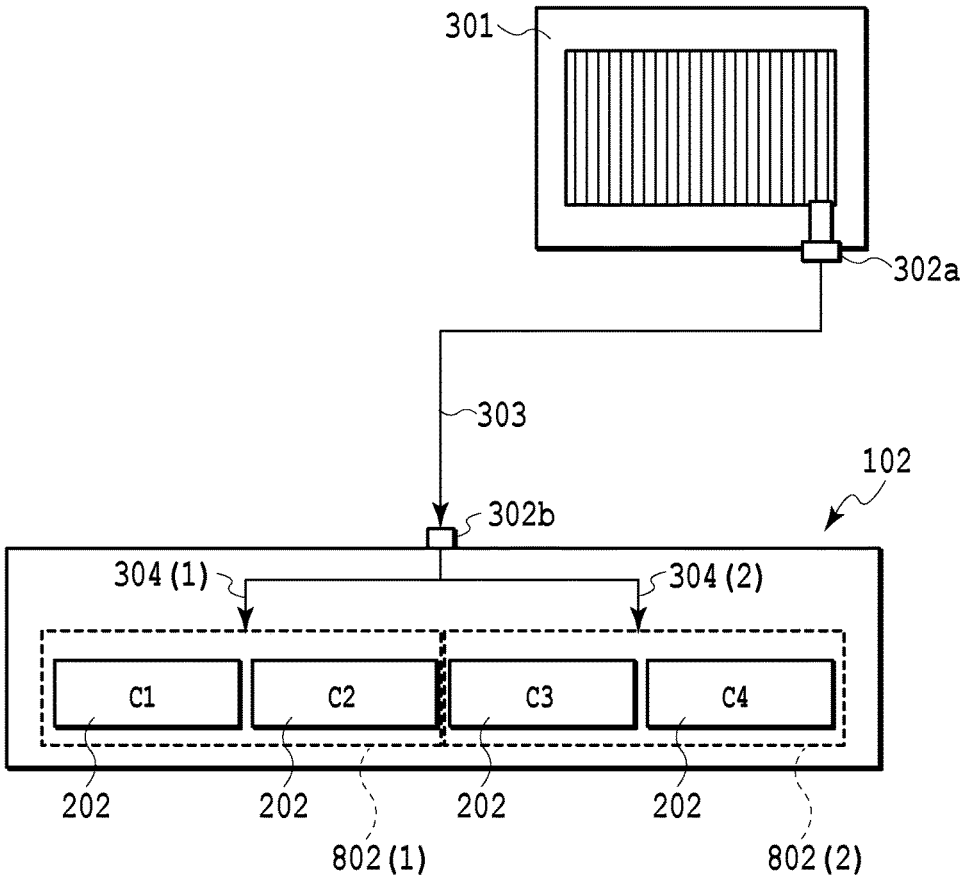
FIG. 8A is an explanatory diagram illustrating a relation between a branch passage and another example of the pressure loss monitoring area of the liquid ejection head.
Figure 8B:
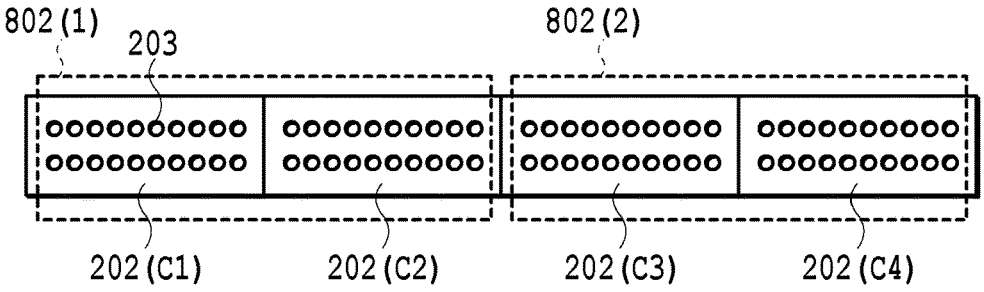
FIG. 8B is an explanatory diagram illustrating the monitoring area of FIG. 8A.
Figure 9A:
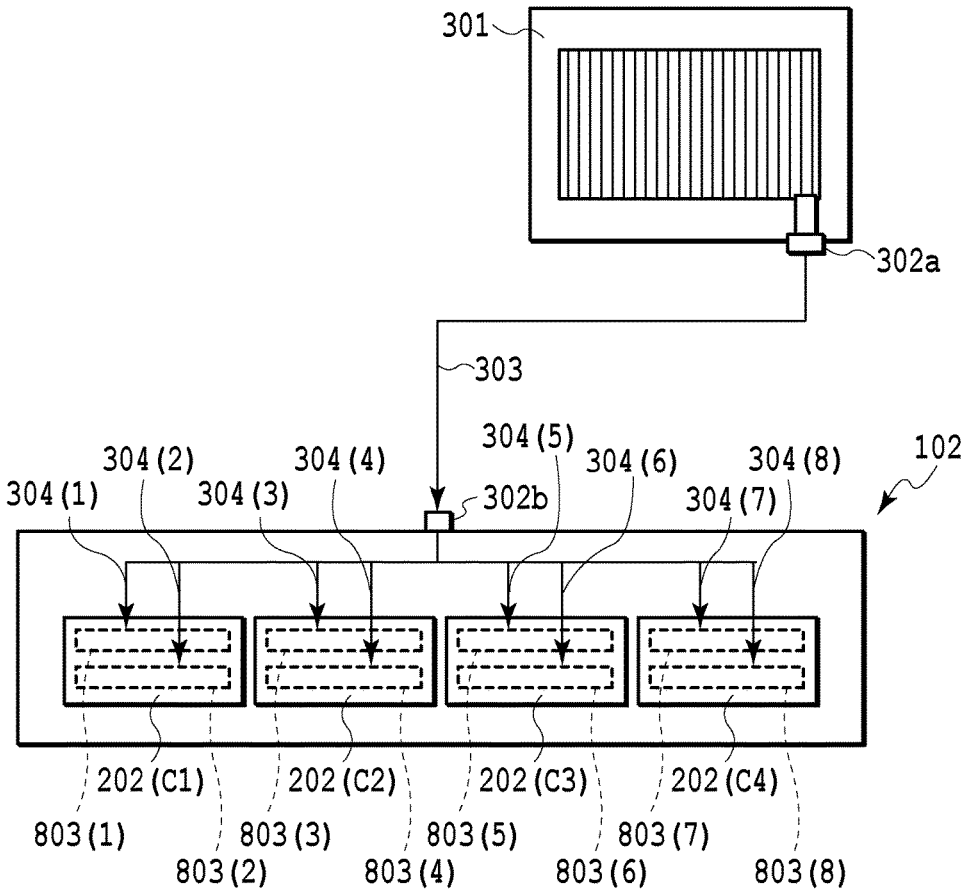
FIG. 9A is an explanatory diagram illustrating a relation between a branch passage and still another example of the pressure loss monitoring area of the liquid ejection head.
Figure 9B:
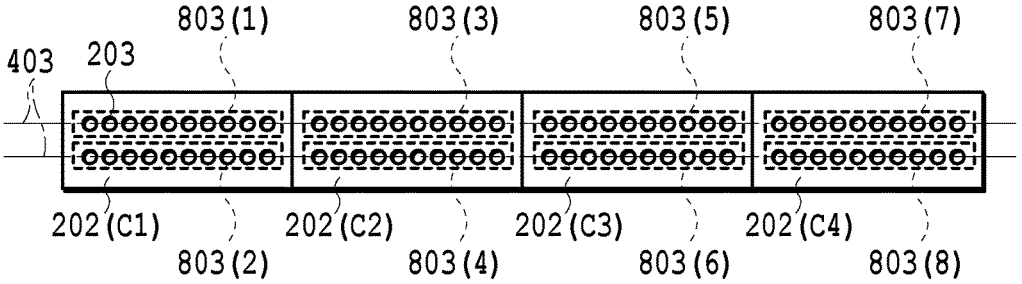
FIG. 9B is an explanatory diagram illustrating the monitoring area of FIG. 9A.
Figure 10A:
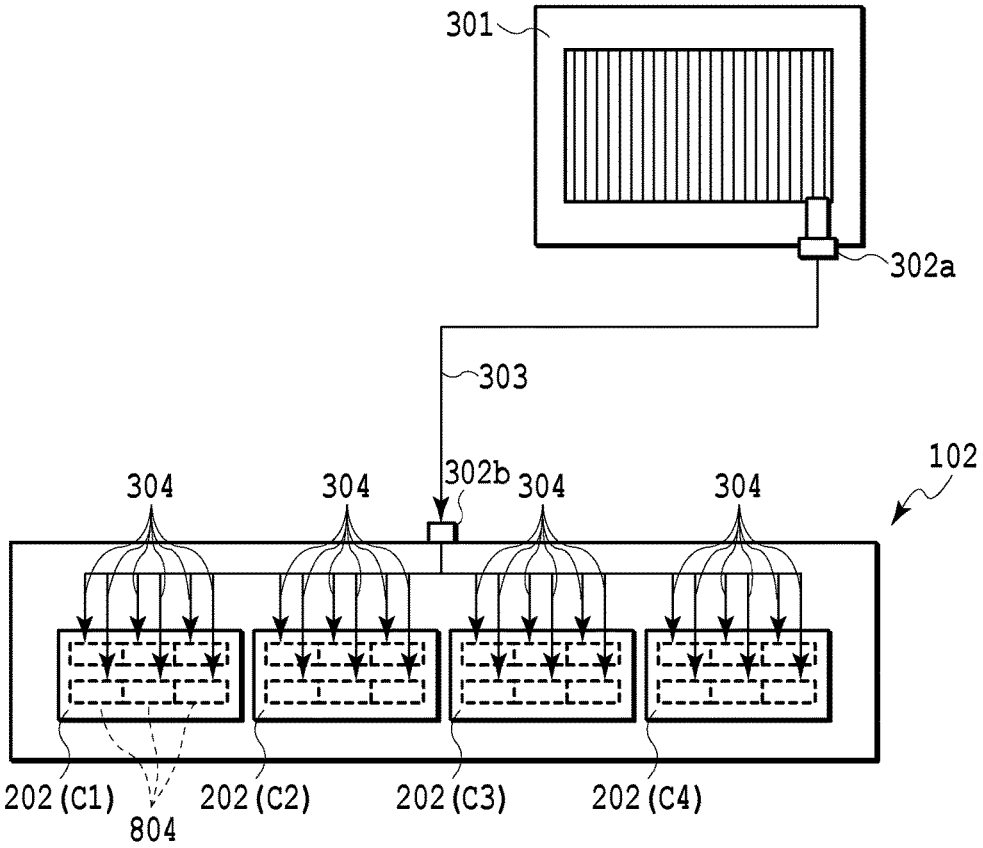
FIG. 10A is an explanatory diagram illustrating a relation between a branch passage and still another example of the pressure loss monitoring area of the liquid ejection head.
Figure 10B:
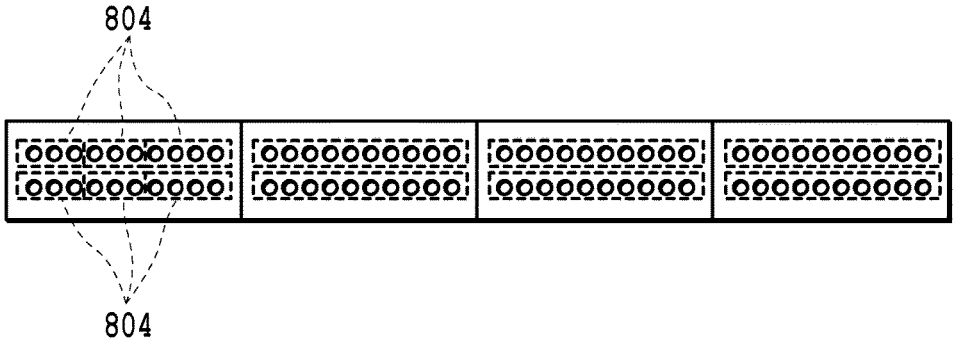
FIG. 10B is an explanatory diagram illustrating the monitoring area of FIG. 10A.

For example, as in FIGS. 8A and 8B, one branch passage may correspond to the plurality of print element boards 202. In FIGS. 8A and 8B, the ink is supplied from the branch passage 304(1) to the substrates C1 and C2, and the substrates C1 and C2 are set as the monitoring area 802(1). Further, the ink is supplied from the branch passage 304(2) to the substrates C3 and C4, and the substrates C3 and C4 are set as the monitoring area 802(2). Further, as in FIGS. 9A and 9B, one branch passage may correspond to one ejection opening array of one print element board 202. In FIGS. 9A and 9B, the ink is supplied from the branch passage 304(1) to one ejection opening array 403 of the substrate C1, and the ejection opening array 403 is set as the monitoring area 803(1). Further, the ink is supplied from the branch passage 304(2) to the other ejection opening array 403 of the substrate C1, and the ejection opening array 403 is set as the monitoring area 803(2). The same applies to a relation between the other branch passages and the monitoring areas illustrated in FIGS. 9A and 9B. Further, as in FIGS. 10A and 10B, one branch passage 304 may correspond to the plurality of ejection openings 203 of one print element board 202. In this case, the ejection opening 203 to which the ink is supplied from the same branch passage 304 is set as the monitoring area 804. Similarly to the case of FIGS. 7A and 7B, even in FIGS. 8A, 8B, 9A, 9B, 10A, and 10B, the pressure loss of each monitoring area is calculated. Then, when the pressure loss of any one of the monitoring areas exceeds a threshold value, the ink ejection frequency and the printing medium conveying speed are decreased to decrease the ink flow amount.

In this way, in the embodiment, in a configuration in which the ink is supplied to each print element board through the branch passage branched from the common passage, the pressure loss of each monitoring area of the print element board corresponding to the branch passage is calculated on the basis of image data. Then, when the pressure loss of each monitoring area exceeds a predetermined threshold value, the ink ejection frequency and the printing medium conveying speed are decreased together so that the local pressure loss of the liquid ejection head is suppressed. That is, the ink can be reliably supplied in such a manner that the ink ejection amount per unit time from the liquid ejection head is decreased. The ink ejection amount per unit time can be controlled in accordance with a change in size of the ink droplet other than the ejection frequency corresponding to the number of the ejected inks per unit time. The ink ejection amount per unit time may be controlled so that the ink flow amount of each monitoring area becomes a predetermined flow amount or less. The present invention is not limited to the above-described embodiment. For example, in a configuration including the plurality of branch passages branched from the common passage, one monitoring area may be provided for the plurality of branch passages or a plurality of monitoring areas may be provided for each branch passage, and the pressure loss of each monitoring area may be calculated.

Second Embodiment

In the first embodiment, in a configuration in which the ejection openings 203 are arranged at both sides of the common liquid chamber 407 and the ink is supplied to the print element boards through the branch passages branched from the common passage as in FIGS. 4A, 4B, and 4C, the pressure loss of each monitoring area of the print element board corresponding to the branch passage is calculated. In the second embodiment, in a configuration in which a plurality of openings for supplying the ink to the ejection opening are formed in the liquid ejection head, the pressure loss is calculated by the unit of the opening.

Figure 11A:
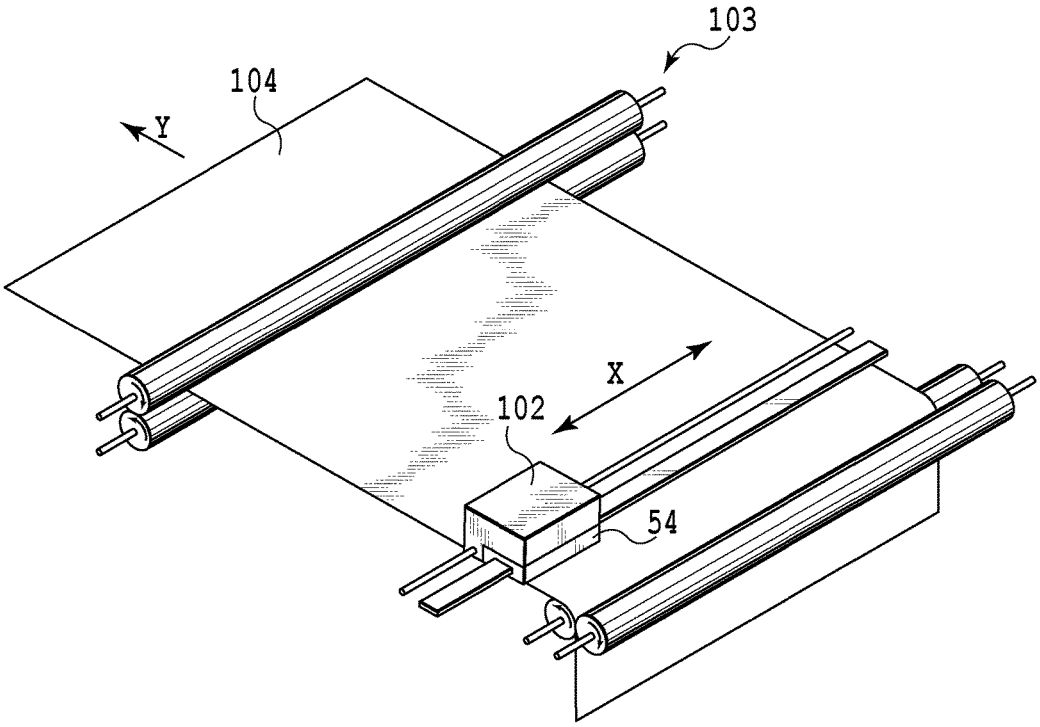
FIG. 11A is a schematic perspective view illustrating a printing apparatus which serves as a liquid ejection apparatus according to a second embodiment of the present invention.

Further, the printing apparatus of the embodiment is a serial scan type printing apparatus as in FIG. 11A. The liquid ejection head 102 is mounted on a carriage 54 and moves in a reciprocating manner in a main scanning direction indicated by an arrow X along with the carriage 54 by a movement mechanism (not illustrated). The printing medium 104 is conveyed, in a sub-scanning direction indicated by an arrow Y and intersecting (in this example, orthogonal to) the main scanning direction, by the conveying unit 103 configured as a conveying roller or a conveyor belt. The conveying unit 103 of this example is configured to convey the printing medium 104 by the conveying roller. An image is sequentially printed on the printing medium 104 in such a manner that an operation of ejecting the ink from the liquid ejection head 102 while the liquid ejection head 102 is moved in the main scanning direction along with the carriage 54 and an operation of conveying the printing medium 104 in the sub-scanning direction are alternately repeated.

(Configuration of Liquid Ejection Head)

Figure 11B:
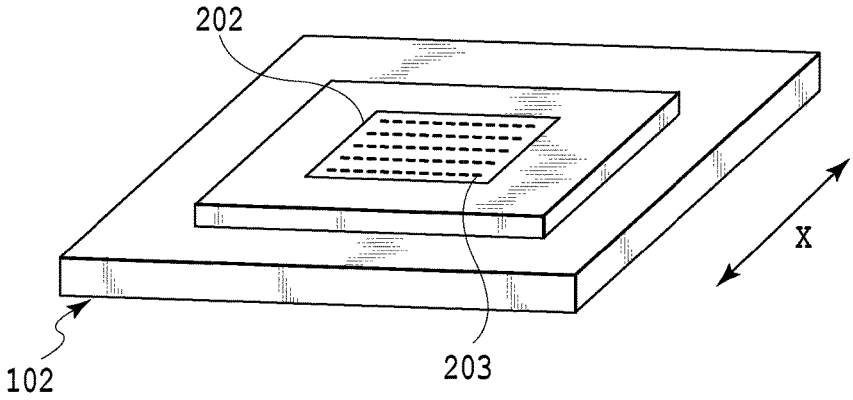
FIG. 11B is a perspective view illustrating a main part of a liquid ejection head of FIG. 11A.

FIG. 11B is a perspective view illustrating a main part of the liquid ejection head 102 of the embodiment. In the liquid ejection head 102 of this example, a single print element board 202 is supported by the support member 201. The plurality of ejection openings 203 of the print element board 202 are arranged to form an ejection opening array extending in a direction intersecting (in this example, orthogonal to) the main scanning direction. The configuration of the print element board 202 is not limited to this example. For example, the plurality of print element boards 202 may be arranged.

(Configuration of Ink Supply System)

Figure 12:
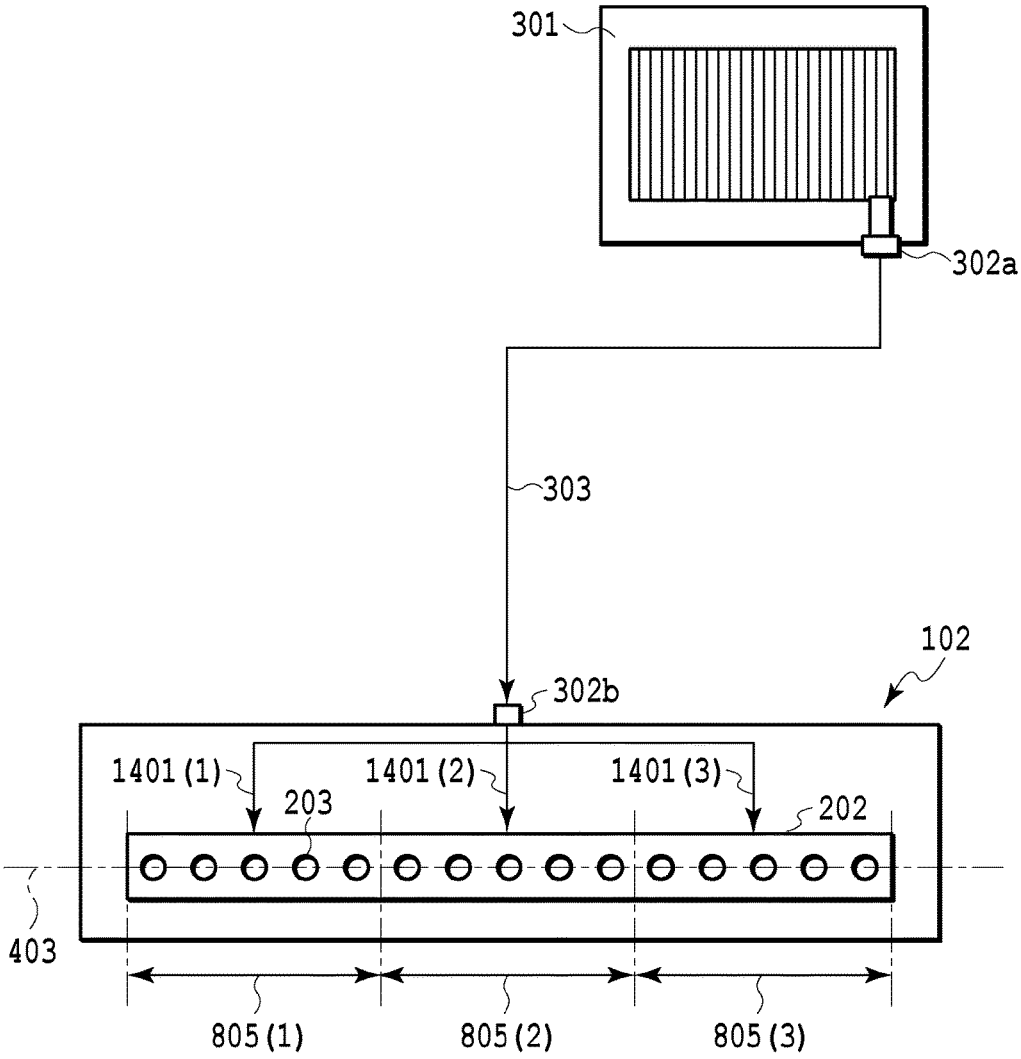
FIG. 12 is an explanatory diagram illustrating an ink supply system for the liquid ejection head of FIG. 11A.

FIG. 12 is a schematic diagram illustrating an ink supply system that supplies the ink to the liquid ejection head 102 of the embodiment. In the liquid ejection head 102, the ink is supplied from the main tank 301 through the common passage 303. The common passage 303 and the main tank 301 are connected to each other by the liquid connection portion 302*a*, and the common passage 303 and the liquid ejection head 102 are connected to each other by the liquid connection portion 302*b*. The ink supplied to the liquid ejection head 102 is supplied, through inflow side openings 1401 (1401(1), 1401(2), 1401(3)) branched from the common passage 303, to the ejection openings corresponding to the openings 1401. The inflow side opening 1401 will be described below.

(Configuration of Print Element Board)

Figure 13A:
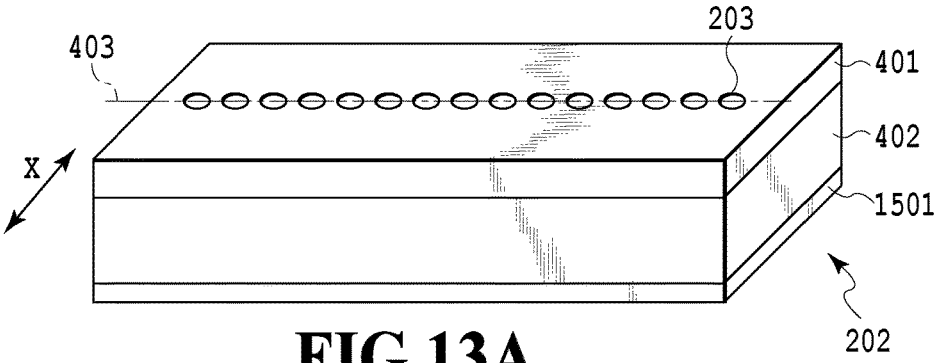
FIG. 13A is a perspective view illustrating a print element board of the liquid ejection head of FIG. 11A.
Figure 13B:
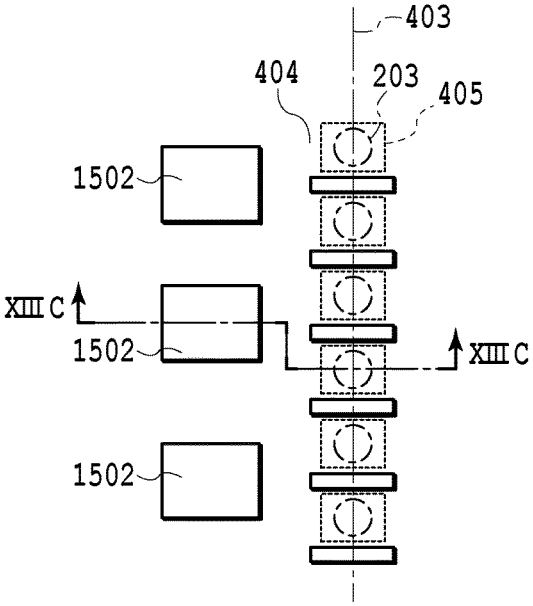
FIG. 13B is an enlarged perspective view illustrating a main part of the print element board of FIG. 13A.
Figure 13C:
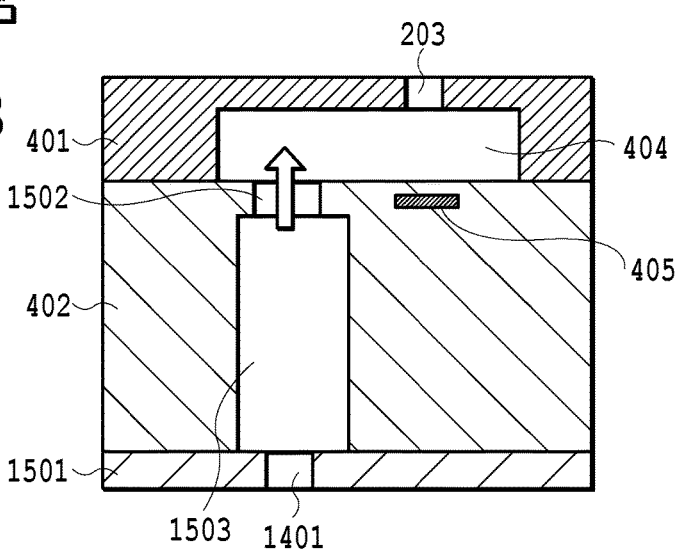
FIG. 13C is a cross-sectional view taken along a line XIIIC-XIIIC of FIG. 13B.

FIGS. 13A, 13B, and 13C are explanatory diagrams illustrating a configuration example of the print element board 202 of the liquid ejection head 102.

In the print element board 202 of this example, as in FIG. 13A, the substrate 402 and a cover plate 1501 are bonded to each other, and the substrate 402 and the orifice plate 401 are bonded to each other. The orifice plate 401 is provided with the plurality of ejection openings 203. The plurality of ejection openings 203 are arranged to form the ejection opening array 403 intersecting (in this example, orthogonal to) the main scanning direction indicated by the arrow X. Electronic devices such as an ejection energy generation element, an electric circuit, an electric wire, and a temperature sensor can be disposed on a front face of the substrate 402 by semiconductor processing. For that reason, a semiconductor substrate such as Si and the like capable of forming a passage therein by MEMS processing is desirable as the material of the substrate 402. An arbitrary material can be used as the material of the orifice plate 401. For example, a resin substrate capable of forming the ejection opening therein by laser processing, an inorganic plate capable of forming the ejection opening therein by dicing, a photosensitive resin material capable of forming the ejection opening and the passage therein by light curing, and a semiconductor substrate capable of forming the ejection opening and the passage therein by MEMS processing can be used.

FIG. 13B is an enlarged perspective view illustrating the print element board 202 when viewed from the orifice plate 401. The pressure chamber 404 is formed in a space between the substrate 402 and the orifice plate 401. The ejection energy generation element 405 for ejecting the ink from the ejection opening 203 is disposed at a position of the substrate 402 facing the ejection opening 203. As the ejection energy generation element 405, an electro thermal conversion element (a heater) or a piezo element can be used. The ink is supplied to the pressure chamber 404 through a vertical supply opening 1502. FIG. 13C is a cross-sectional view taken along a line XIIIC-XIIIC of the print element board 202 of FIG. 13B. The vertical supply opening 1502 is formed in the substrate 402 by perforating, and an inflow side rear face passage 1503 communicating with the vertical supply opening 1502 is fluid-connected to the inflow side opening 1401 of the cover plate 1501.

(Control Example of Ink Flow Amount)

As in FIG. 12, the ink flow amount monitoring areas of the embodiment are areas 805 (805(1), 805(2), 805(3)) including ejection openings 201 corresponding to the openings 1401 (1401(1), 1401(2), 1401(3)) branched from the common passage 303. The ink is mainly supplied from the openings 1401 corresponding to the monitoring areas 805 to the ejection openings 201 within the monitoring areas 805.

Figure 14:
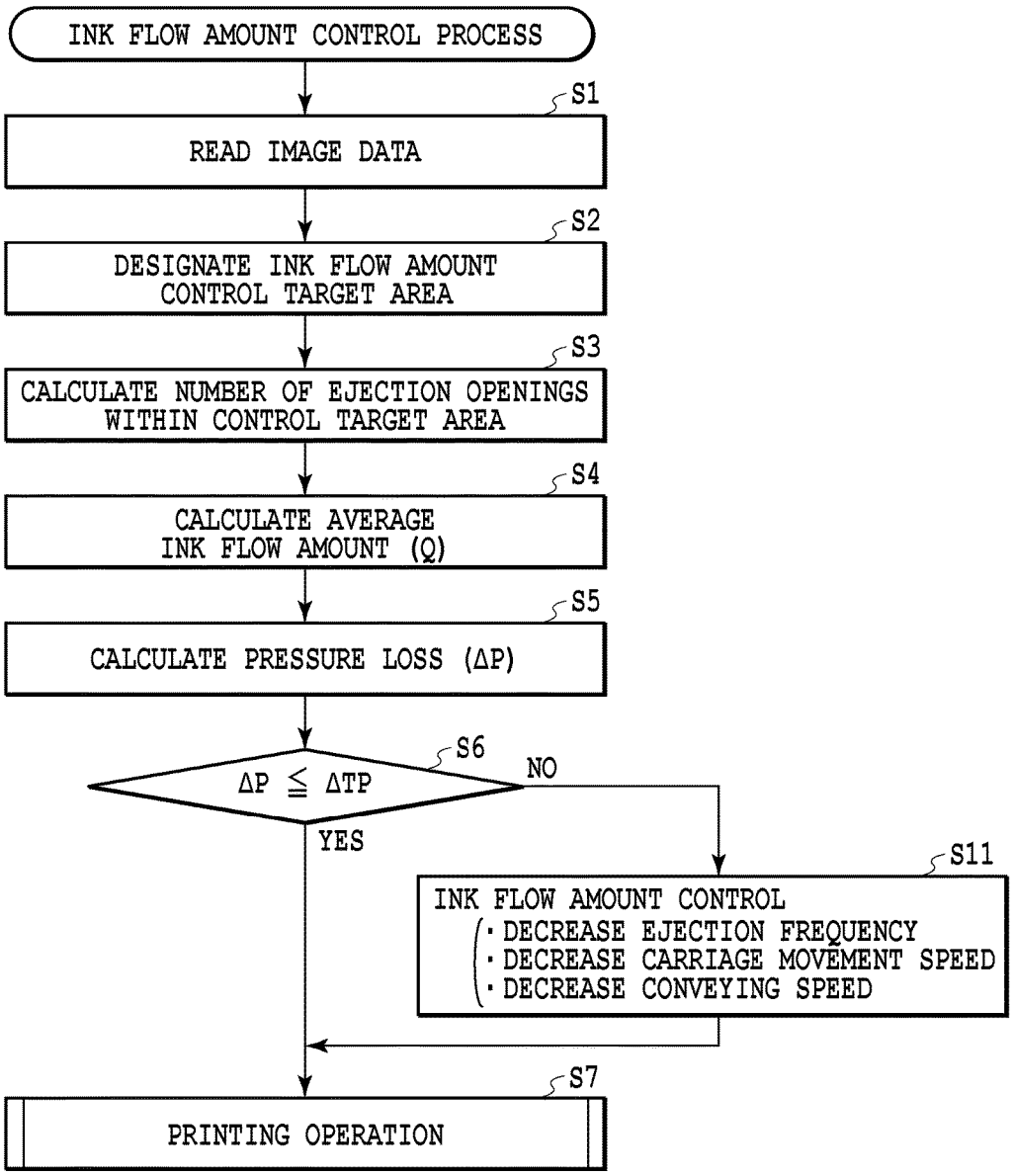
FIG. 14 is a flowchart illustrating an ink flow amount control process of the printing apparatus of FIG. 11A.

FIG. 14 is a flowchart illustrating the ink flow amount control process of the embodiment. Similarly to the first embodiment, the pressure loss ΔP of each monitoring area 805 is calculated on the basis of image data (step S1 to step S5). Then, it is determined whether the pressure loss ΔP exceeds the predetermined value ΔTP (step S6). When the pressure loss ΔP does not exceed the predetermined value ΔTP, the printing operation is performed without the control of the ink flow amount (step S7). Meanwhile, when the pressure loss ΔP exceeds the predetermined value ΔTP, the ink flow amount is controlled (step S11). In the embodiment, when the ink ejection frequency is decreased and the movement speed of the carriage 54 is decreased in accordance with a decrease in ink ejection frequency, the ink flow amount of the ink passing through the monitoring area is decreased. Further, the conveying speed of the printing medium 104 may be decreased. Accordingly, the pressure loss ΔP in the monitoring area can be suppressed to the predetermined value ΔTP or less. Subsequently, the printing operation is performed (step S7).

The liquid ejection head of the embodiment is not limited to the configuration illustrated in FIGS. 12, 13A, 13B, and 13C. For example, a liquid ejection head including a plurality of print element boards as in the first embodiment may be used, and the embodiment can be also applied to such a liquid ejection head.

In this way, the liquid ejection head of the embodiment has a configuration in which one or a plurality of print element boards are arranged, and the inflow side rear face passage 1503 communicating with the vertical supply opening 1502 communicates with the inflow side opening 1401 of the cover plate 1501. In such a liquid ejection head, the pressure loss ΔP of each of the monitoring areas 805 corresponding to the inflow side openings 1401 branched from the common passage 303 is calculated. Then, when the pressure loss ΔP of each monitoring area 805 exceeds the predetermined threshold value ΔTP, the ink ejection frequency and the carriage movement speed are decreased so that the local pressure loss of the liquid ejection head can be suppressed. In that case, the printing medium conveying speed may be also decreased.

Further, the present invention can be also applied to a configuration in which the pressure loss of each monitoring area based on the boundary of the opening position is calculated, or a configuration in which the pressure loss of each of the monitoring areas further divided based on the boundary of the opening position is calculated.

Third Embodiment

In the configuration example of the second embodiment, the pressure loss is calculated by the unit of the monitoring area corresponding to the branch passages supplying the ink to the liquid ejection head. In the third embodiment, in a so-called circulation configuration in which the ink flows from the inflow side opening to the collection side opening through the ejection opening, the pressure loss is calculated by the unit of the monitoring areas corresponding to the inflow side opening and the collection side opening.

(Configuration of Ink Supply System)

Figure 15:
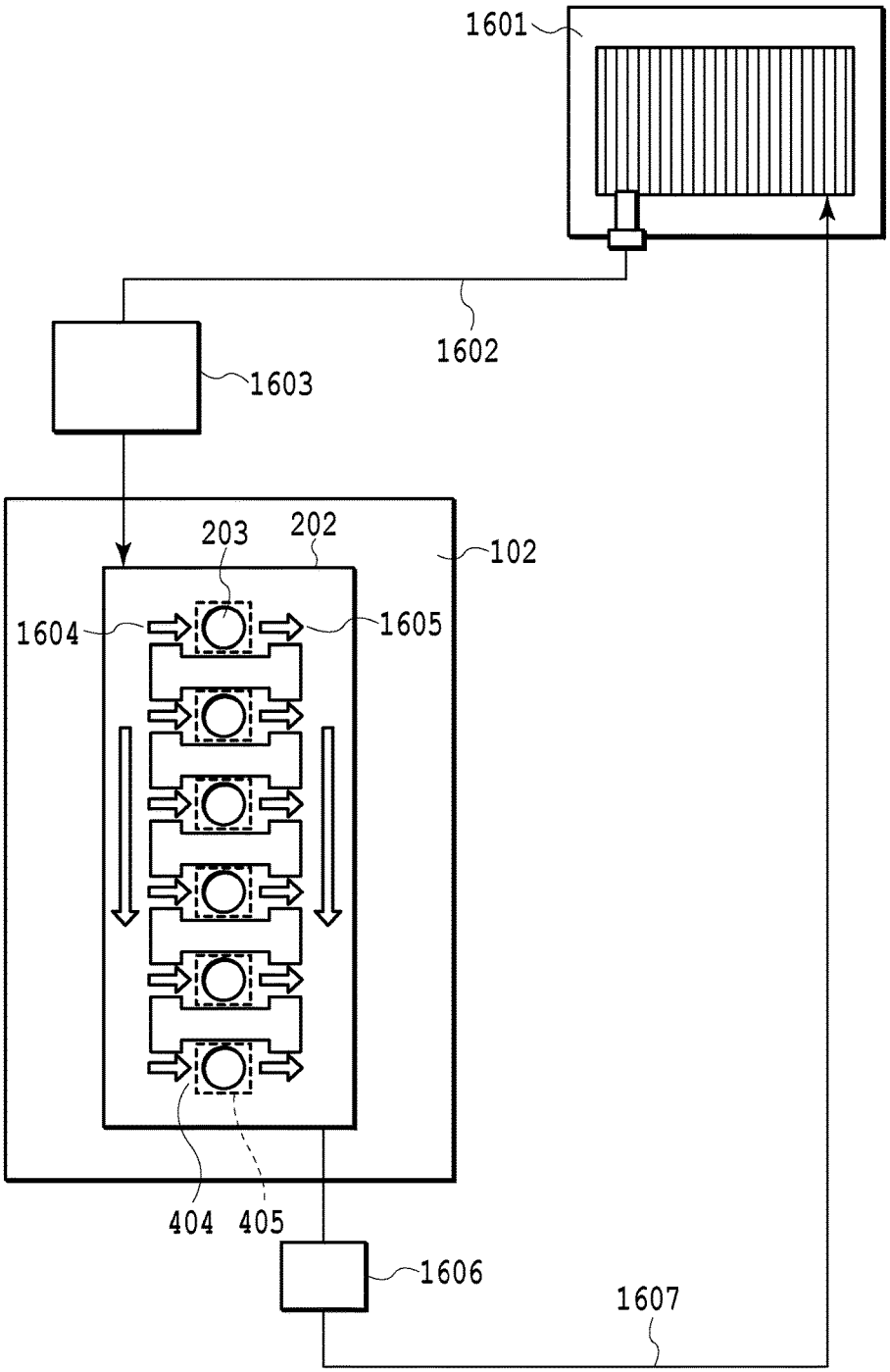
FIG. 15 is an explanatory diagram illustrating an ink supply system of a printing apparatus which serves as a liquid ejection apparatus according to a third embodiment of the present invention.

FIG. 15 is a schematic diagram illustrating an ink supply system that supplies the ink to the liquid ejection head 102 of the embodiment. The ink inside an ink tank 1601 is supplied to the liquid ejection head 102 through an ink supply passage 1602. A part of the ink supplied to the liquid ejection head 102 is ejected from the ejection opening 203 and the other ink is collected to the ink tank 1601 through an ink collection passage 1607. The ink pressure of the ejection opening 203 is adjusted while the ink circulation flow is generated between the ink tank 1601 and the liquid ejection head 102 by a negative pressure adjustment device 1603 provided in the ink supply passage 1602 and a constant flow amount pump 1606 provided in the ink collection passage 1607. The constant flow amount pump 1606 and the negative pressure adjustment device 1603 which generate the ink circulation flow can be integrally provided with the liquid ejection head 102 or can be attached to the outside of the liquid ejection head 102 so as to be connected to the liquid ejection head 102 through a supply tube or the like. Further, an MEMS element such as a micro pump can be assembled into the print element board.

(Configuration of Print Element Board)

Figure 16A:
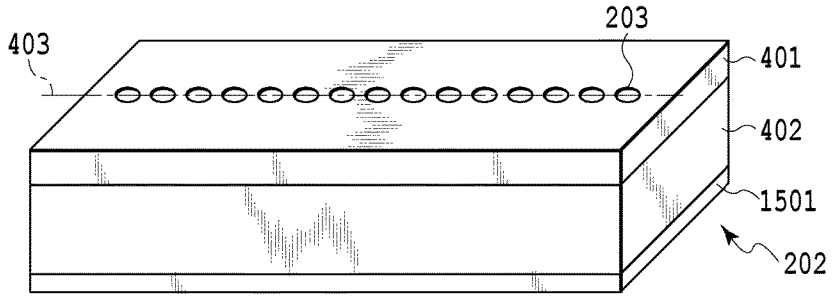
FIG. 16A is a perspective view illustrating a print element board of a liquid ejection head of FIG. 15.
Figure 16B:
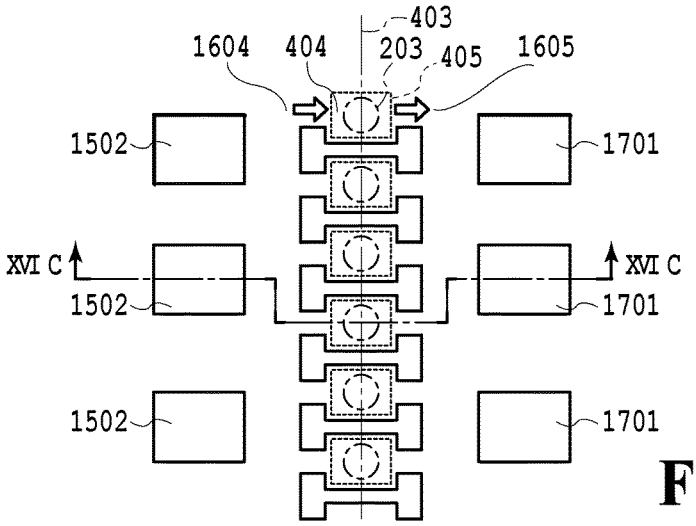
FIG. 16B is an enlarged perspective view illustrating a main part of the print element board of FIG. 16A.
Figure 16C:
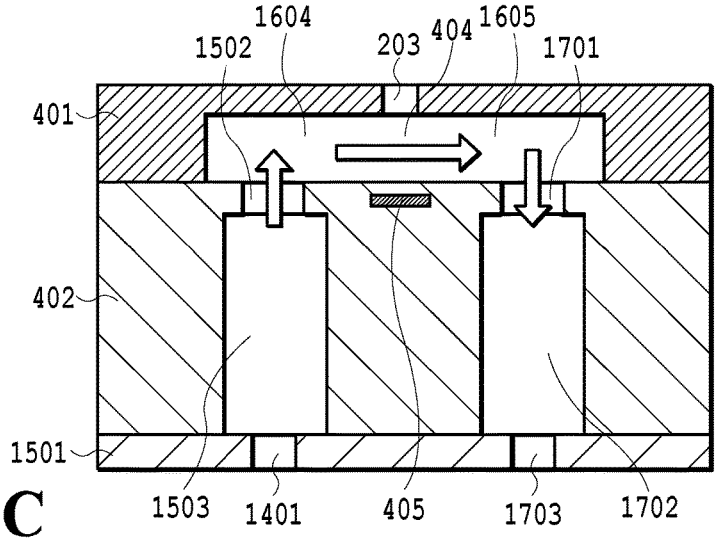
FIG. 16C is a cross-sectional view taken along a line XVIC-XVIC of FIG. 16B.

FIGS. 16A to 16C are explanatory diagrams illustrating a configuration example of the print element board 202 of the liquid ejection head 102, and the print element board 202 has the same configuration as that of the second embodiment.

FIG. 16B is an enlarged perspective view illustrating the print element board 202 when viewed from the orifice plate 401. The pressure chamber 404 is formed in a space between the substrate 402 and the orifice plate 401. The ejection energy generation element 405 for ejecting the ink from the ejection opening 203 is disposed at a position of the substrate 402 facing the ejection opening 203. As the ejection energy generation element 405, an electro thermal conversion element (a heater) or a piezo element can be used. The ink is supplied to the pressure chamber 404 through the vertical supply opening 1502. FIG. 16C is a cross-sectional view taken along a line XVIC-XVIC of the print element board 202 of FIG. 16B. An inflow passage 1604 and a collection passage 1605 are fluid-connected to the pressure chamber 404 to form a series of passages. Thus, the ink flows from the inflow passage 1604 to the collection passage 1605 through the pressure chamber 404. The vertical supply opening 1502 and a vertical collection opening 1701 penetrate the substrate 402 and respectively communicate with the inflow passage 1604 and the collection passage 1605. Further, the inflow side rear face passage 1503 communicating with the vertical supply opening 1502 and a collection side rear face passage 1702 communicating with the vertical collection opening 1701 respectively communicate with the inflow side opening 1401 and a collection side opening 1703 of the cover plate 1501.

In the embodiment, the ink is ejected from the ejection opening 203 when the ejection energy generation element 405 is driven while the ink circulation path is formed and a flow of the ink is generated from the inflow passage 1604 to the collection passage 1605. Even when the ink ejecting operation is performed while a flow of the ink is generated from the inflow passage 1604 to the collection passage 1605, an influence on the ink droplet landing accuracy is small.

(Control Example of Ink Flow Amount)

Figure 28A:
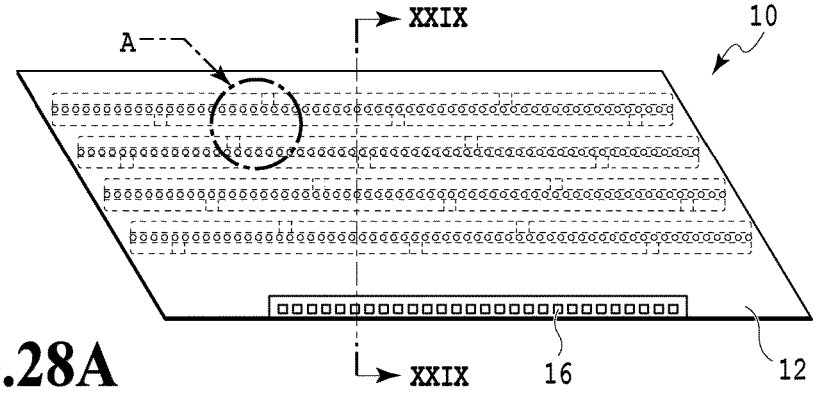
FIGS. 28A, 28B, and 28C are explanatory diagrams respectively illustrating a print element board.
Figure 28B:
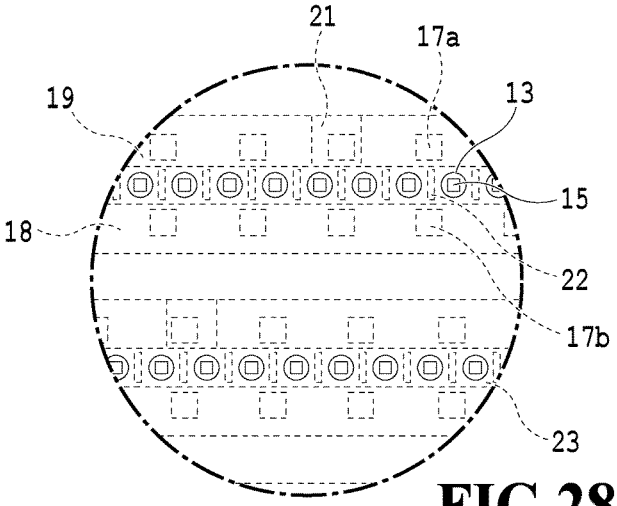
Figure 28C:
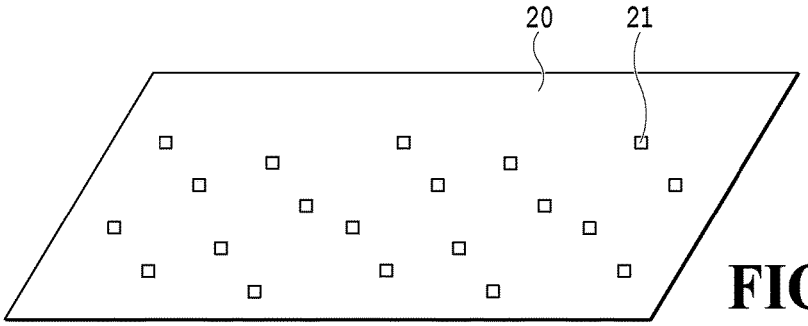
Figure 29:
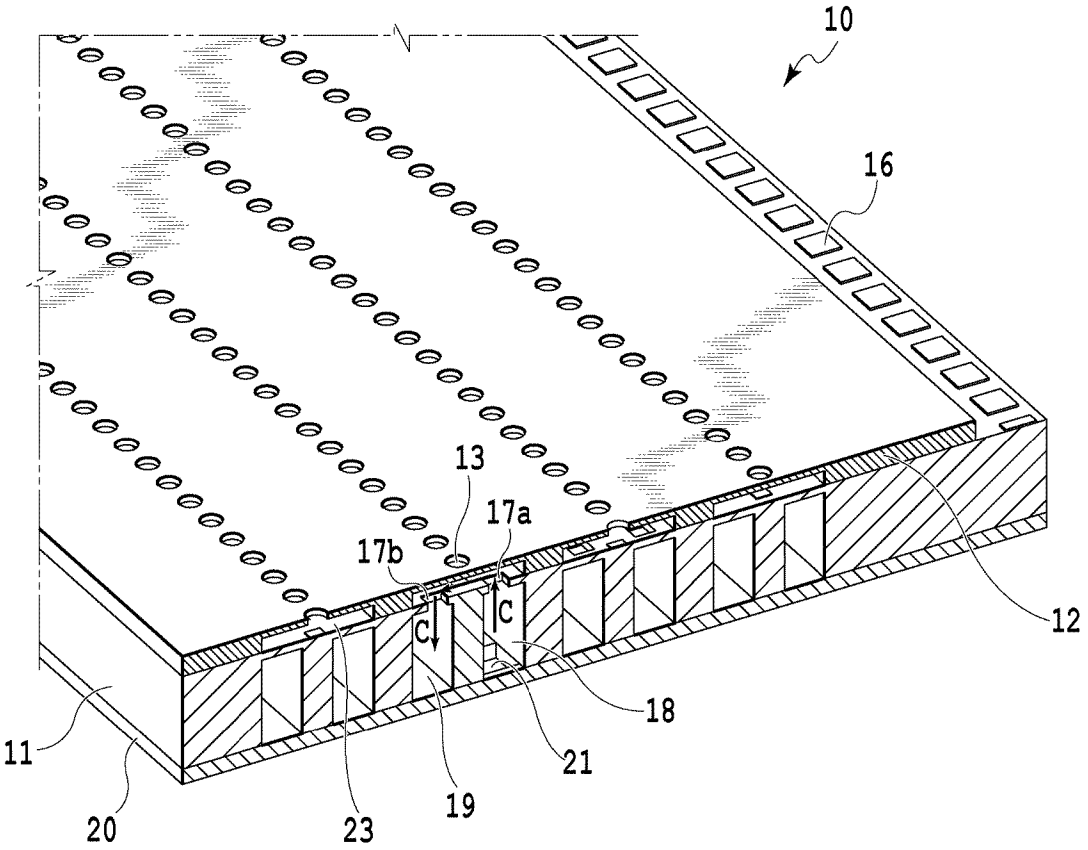
FIG. 29 is a perspective view illustrating cross-sections of the print element board taken along a line XXIX-XXIX of FIG. 28A.

The reason why the insufficient supply of the ink in the ejection opening located at the end of the print element board is worried in a configuration of the embodiment in which the ink flows from the inflow side opening to the collection side opening through the ejection opening will be described. FIG. 28A is a top view of the print element board 202 illustrated in FIG. 16A, FIG. 28B is an enlarged view of a part A of FIG. 28A, and FIG. 28C is a rear view of the print element board 202 of FIG. 28A. FIG. 29 is a cross-sectional view illustrating a print element board 10 and a cover plate 20 taken along a line XXIX-XXIX of FIG. 28A. As illustrated in FIG. 29, the ink is circulated from an opening 21 of a cover plate 20 through a liquid supply path 18, a pressure chamber 23, and a liquid collection path 19. Since a passage length of the liquid supply path 18 or the liquid collection path 19 from the opening 21 located at the end of the arrangement direction of ejection openings 13 to the ejection opening located at that end increases, the pressure loss increases. In addition, the pressure loss also increases due to an increase in ink flow amount inside the liquid supply path 18 or the liquid collection path 19 when the ink is ejected from the plurality of ejection openings 13.

Similarly to the second embodiment, when the ink flow amount is controlled on the basis of the pressure loss of each monitoring area as in FIG. 14, the insufficient supply of the ink caused by the pressure loss can be suppressed.

Figure 17:
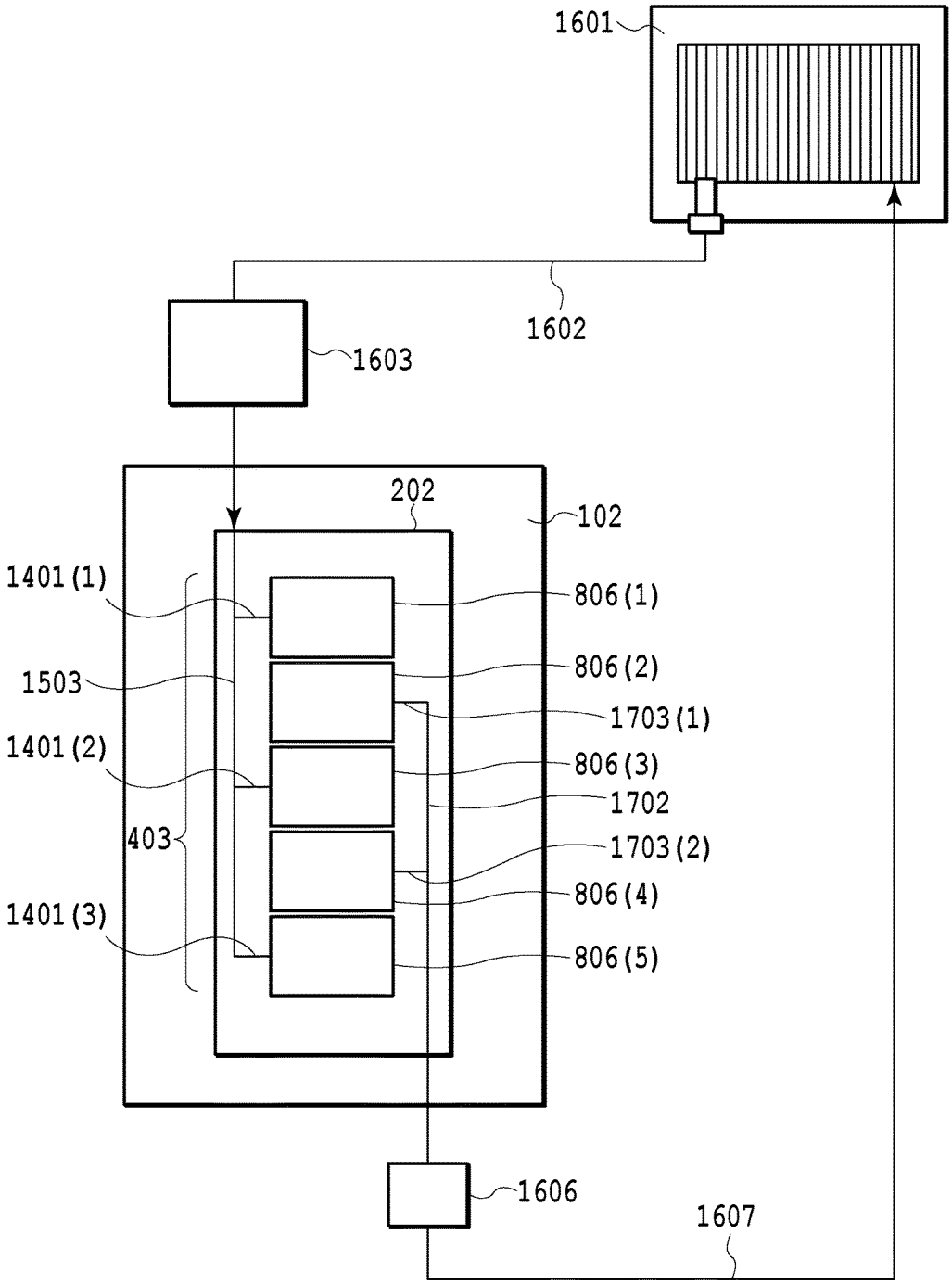
FIG. 17 is an explanatory diagram illustrating an example of a pressure loss monitoring area of the liquid ejection head of FIG. 15.

In the embodiment, as in FIG. 17, the inflow side openings 1401 (1401(1), 1401(2), 1401(3)) are branched from the inflow side rear face passage 1503 serving as the common passage. Further, the collection side openings 1703 (1703 (1), 1703(2)) are divided from the collection side rear face passage 1702 serving as the common passage. As illustrated in FIG. 16C, the ink which is supplied from the plurality of inflow side openings 1401 formed at the cover plate 1501 provided on the rear face of the print element board 202 is supplied to the plurality of pressure chambers 404 through the inflow side rear face passage 1503 serving as a common passage. Subsequently, the ink passes through the collection side rear face passage 1702 serving as a common passage and is supplied to the collection side opening 1703. The monitoring area of the embodiment includes areas 806 (806(1) to 806(5)) of the nozzle arrays 403 respectively corresponding to the inflow side opening 1401 and the collection side opening 1703.

The pressure loss of each monitoring area 806 is calculated. At that time, the flow amount Q is expressed by Equation (7) below in consideration of an ink circulation flow amount Q' for each ejection opening 203. Here, the number of all nozzles in the monitoring area is indicated by n'.

$$Q=(n\times Vd\times fop)+(n'\times Q') \tag{7}$$

Here, as described above, the ink circulation flow amount Q' has a small influence on the ink droplet landing accuracy during the ink ejection operation.

A method of calculating the pressure loss of each of the monitoring areas 806 respectively corresponding to the inflow side opening 1401 and the collection side opening 1703 is similar to that of the first embodiment. The liquid ejection head is not limited to the configuration illustrated in FIGS. 16A, 16B, 16C, and 17 as long as the ink can be circulated. In this way, the liquid ejection head of the embodiment has a configuration in which one or a plurality of print element boards are disposed, the inflow side rear face passage 1503 communicates with the vertical supply opening 1502, and the collection side rear face passage 1702 communicates with the vertical collection opening 1701. When the inflow side rear face passage 1503 and the collection side rear face passage 1702 respectively communicate with the inflow side opening 1401 and the collection side opening 1703 of the cover plate 1501, the ink circulation passage is formed. In such a liquid ejection head, the pressure loss of each of the monitoring areas 806 corresponding to the inflow side opening 1401 and the collection side opening 1703 is calculated and the ink flow amount is controlled on the basis of the pressure loss. Accordingly, since the local pressure loss of the liquid ejection head is suppressed, the ink can be ejected normally.

Further, the present invention is not limited to the above-described example. For example, a configuration in which the pressure loss of each monitoring area based on the boundary of the opening position, or a configuration in which the pressure loss of each of the monitoring areas further divided based on the boundary of the opening position can be exemplified. Particularly, when the monitoring area is further divided based on the boundary of the opening position, the pressure loss can be suppressed in more detail.

Fourth Embodiment

FIGS. 18 to 30 are explanatory diagrams illustrating a fourth embodiment of the present invention. Here, the same ink circulation path as that of the third embodiment is provided. Similarly to the third embodiment, when the monitoring area is set and the ink flow amount is controlled on the basis of the pressure loss of each monitoring area, the local pressure loss of the liquid ejection head can be suppressed.

(Description of Inkjet Printing Apparatus)

Figure 18:
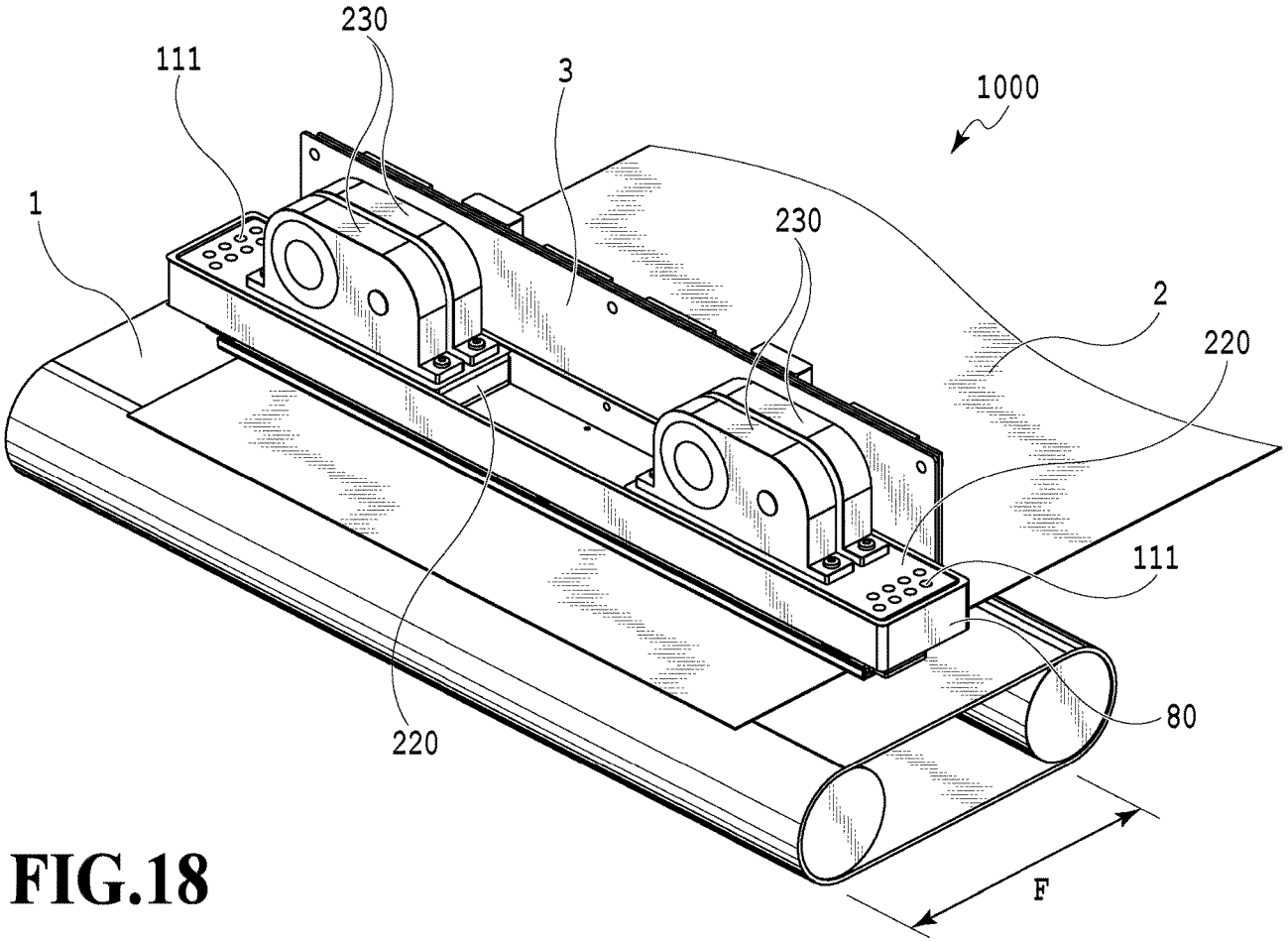
FIG. 18 is an explanatory diagram illustrating a printing apparatus according to a fourth embodiment of the present invention.

FIG. 18 is a diagram illustrating a schematic configuration of a liquid ejection apparatus in the present invention that ejects a liquid and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230, a liquid connection portion 111 which serves as an ink supply opening and an ink collection opening of the liquid supply unit 220, and a casing 380. The print medium 2 is not limited to a cut sheet and may be also a continuous roll medium. The liquid ejection head 3 can print a full color image by inks of cyan C, magenta M, yellow Y, and black K and is fluid-connected to a liquid supply member, a main tank, and a buffer tank (see FIG. 19 to be described later) which serve as a supply path supplying a liquid to the liquid ejection head 3. Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 19:
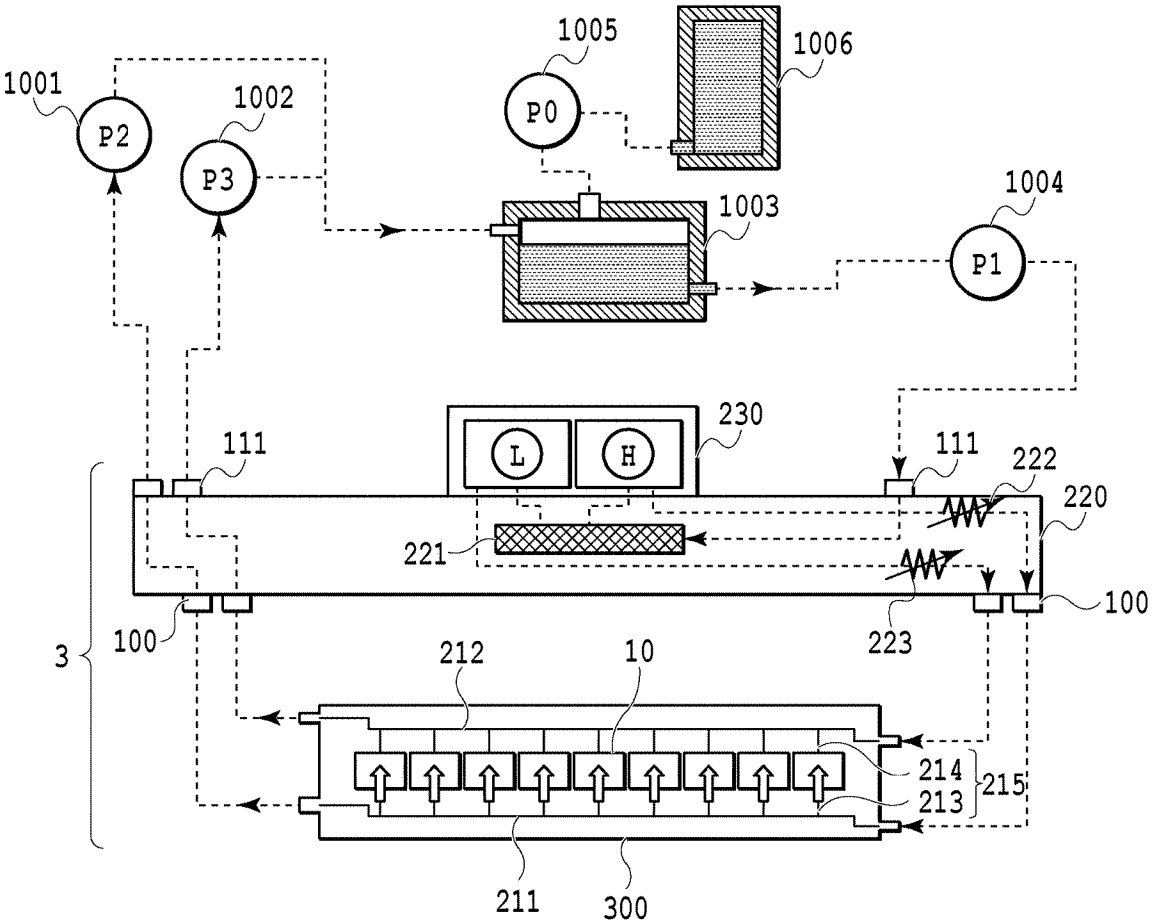
FIG. 19 is an explanatory diagram illustrating a first circulation configuration in a circulation path applied to the printing apparatus of FIG. 18.

FIG. 19 is a schematic diagram illustrating the first circulation configuration in the circulation path applied to the printing apparatus 1000 of the embodiment. The liquid ejection head 3 is fluid-connected to a first circulation pump (the high pressure side) 1001, a first circulation pump (the low pressure side) 1002, and a buffer tank 1003. Further, in FIG. 19, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the first circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the action of the first circulation pump (the high pressure side) 1001 and the first circulation pump (the low pressure side) 1002 at the downstream side of the liquid ejection head 3, is collected from the liquid ejection head 3 through the liquid connection portion 111, and is returned to the buffer tank 1003.

The buffer tank 1003 as a sub-tank is connected to the main tank 1006, and includes an atmosphere communication opening (not illustrated) communicating the inside of the tank 1003 with the outside and thus can collect bubbles in the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (discharge) of the ink from the ejection opening of the liquid ejection head 3 in a printing operation and a suction recovery operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during the printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality. Above all, when a too high flow rate is set, a difference in negative pressure among the print element boards 10 increases due to the influence of pressure loss of the passage inside a liquid ejection unit 300 and thus unevenness in density is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow rate of the ink changes in the circulation system due to a difference in ink ejection amount per unit area. As two negative pressure control mechanisms constituting the negative pressure control unit 230, any mechanism may be used as long as a pressure at the downstream side of the negative pressure control unit 230 can be controlled within a predetermined range or less from a desired set pressure. As an example, a mechanism such as a so-called "pressure reduction regulator" can be employed. In the circulation passage of the embodiment, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004. As illustrated in FIG. 19, the negative pressure control unit 230 includes two negative pressure adjustment mechanisms respectively having different control pressures. Among two negative pressure adjustment mechanisms, a relatively high pressure side (indicated by "H" in FIG. 19) and a relatively low pressure side (indicated by "L" in FIG. 19) are respectively connected to the common supply passage 211 and the common collection passage 212 inside the liquid ejection unit 300 through the liquid supply unit 220. The liquid ejection unit 300 is provided with the common supply passage 211, the common collection passage 212, and individual passages 215 (individual supply passages 213 and individual collection passages 214) communicating with the print element board. The negative pressure control mechanism H is connected to the common supply passage 211, the negative pressure control mechanism L is connected to the common collection passage 212, and a differential pressure is formed between two common passages 211 and 212. Then, since the individual passage 215 communicates with the common supply passage 211 and the common collection passage 212, a flow (a flow indicated by an arrow direction of FIG. 19) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be collected to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be collected toward the common collection passage 212. For this reason, the liquid ejection head 3 of the embodiment can print a high-quality image at a high speed.

(Description of Second Circulation Configuration)

Figure 20:
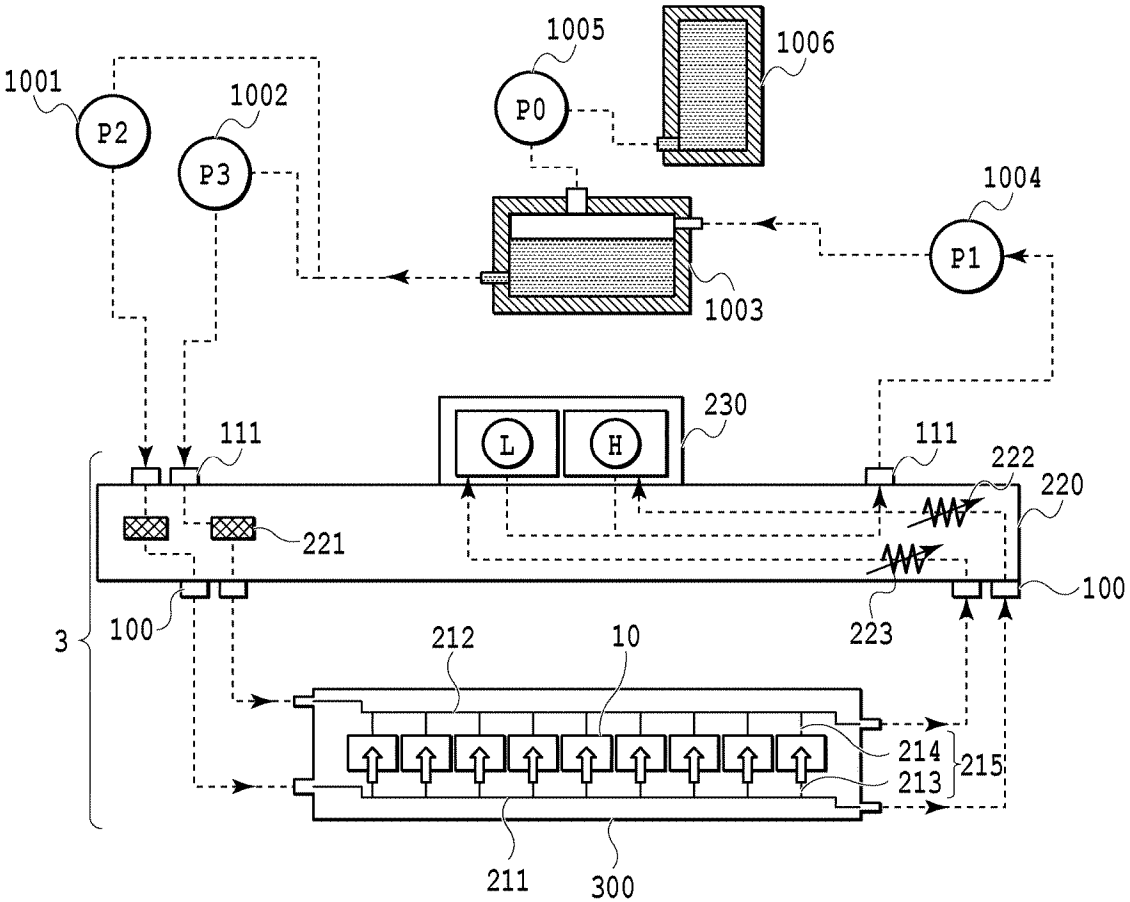
FIG. 20 is an explanatory diagram illustrating a second circulation configuration in the circulation path applied to the printing apparatus of FIG. 18.

FIG. 20 is a schematic diagram illustrating the second circulation configuration which is a circulation configuration different from the first circulation configuration in the circulation path applied to the printing apparatus of the embodiment. A main difference from the first circulation configuration is that two negative pressure control mechanisms constituting the negative pressure control unit 230 both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is collected from the liquid ejection head 3 through the negative pressure control unit 230 and the liquid connection portion 111. The collected ink is returned to the buffer tank 1003 by the second circulation pump 1004.

In the second circulation configuration, the negative pressure control unit 230 stabilizes a change in pressure at the upstream side (that is, the liquid ejection unit 300 side) of the negative pressure control unit 230 within a predetermined range from a predetermined pressure even when a change in flow rate is caused by a change in ink ejection amount per unit area. In the circulation passage of the embodiment, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used. Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 20) and a low pressure side (indicated by "L" in FIG. 20) are respectively connected to the common supply passage 211 and the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the liquid is formed from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or a trash produced from the negative pressure control unit 230 flows into the liquid ejection head 3. As a second advantage, in the second circulation configuration, a maximal value of the flow rate necessary for the liquid supplied from the buffer tank 1003 to the liquid ejection head 3 is smaller than that of the first circulation configuration. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 21:
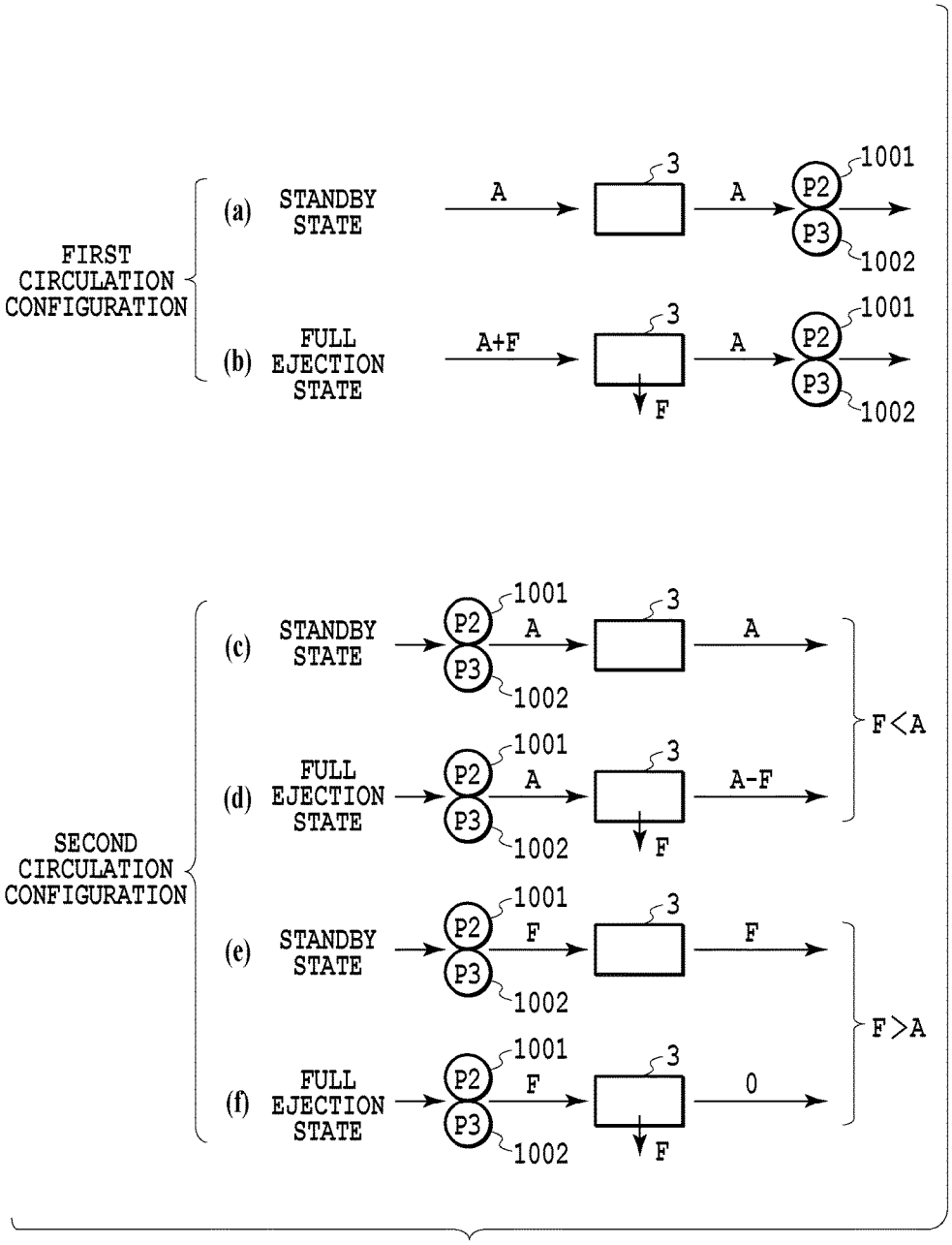
FIG. 21 is an explanatory diagram illustrating an ink circulation amount in the first circulation configuration and the second circulation configuration.

FIG. 21 is a schematic diagram illustrating a difference in ink inflow amount to the liquid ejection head 3 between the first circulation configuration and the second circulation configuration. A part (a) of FIG. 21 illustrates the standby state in the first circulation configuration and a part of FIG. 21 illustrates the full ejection state in the first circulation configuration. Parts (c) to (f) of FIG. 21 illustrate the second circulation configuration. Here, the parts (c) and (d) of FIG. 21 illustrate a case where the flow rate F is lower than the flow rate A and the parts (e) and (f) of FIG. 21 illustrate a case where the flow rate F is higher than the flow rate A. In this way, the flow rates in the standby state and the full ejection state are illustrated.

In the case of the first circulation configuration (the parts (a) and (b) of FIG. 21) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of {(the flow rate A)+(the flow rate F)} since the flow rate F is added to the flow rate A (part (b) of FIG. 21).

Meanwhile, in the case of the second circulation configuration (parts (c) and (d) of FIG. 21) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, when the flow rate A is higher than the flow rate F (parts (c) and (d) of FIG. 21) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the collection flow rate of the liquid ejection head 3 satisfies a relation of {(the flow rate A)−(the flow rate F)} (part (d) of FIG. 21). However, when the flow rate F is higher than the flow rate A (parts (e) and (f) of FIG. 21), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid collected from the liquid ejection head 3 becomes almost zero (part (f) of FIG. 21). In addition, if the liquid is ejected but not ejected in the full ejection state when the flow rate F is higher than the flow rate A, the liquid which is attracted by the amount consumed by the ejection of the flow rate F is collected from the liquid ejection head 3. the liquid which is reduced by the amount consumed by the ejection from the flow rate F is discharged from the liquid ejection head 3. Further, when the flow rate A and the flow rate F are equal to each other, the flow rate A (or the flow rate F) is supplied to the liquid ejection head 3 and the flow rate F is consumed by the liquid ejection head 3. For this reason, the flow rate collected from the liquid ejection head 3 becomes almost zero.

In this way, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value {(the flow rate A)+(the flow rate F)} of the supply flow rate necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a long longitudinal length among the line heads is beneficial.

Meanwhile, the first circulation configuration has more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with a main droplet of the ink.

Meanwhile, in the case of the first circulation configuration, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation configurations can be desirably selected in consideration of the specifications (the ejection flow rate F, the minimal circulation flow rate A, and the passage resistance inside the head) of the liquid ejection head and the printing apparatus body.

(Description of Configuration of Liquid Ejection Head)

Figure 22A:
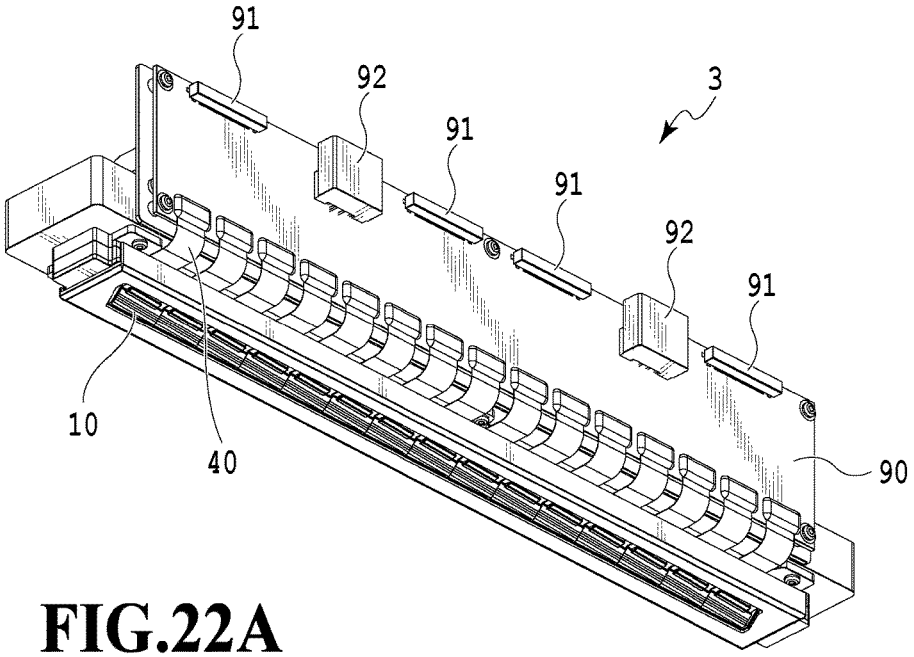
FIG. 22A and FIG. 22B are perspective views respectively illustrating the liquid ejection head of FIG. 18.
Figure 22B:
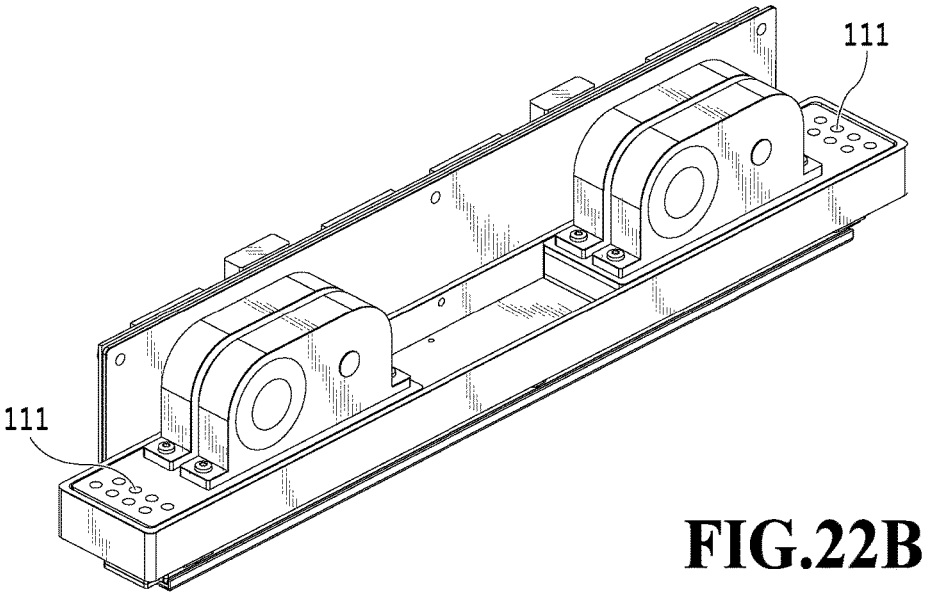

A configuration of the liquid ejection head 3 according to the embodiment will be described. FIGS. 22A and 22B are perspective views illustrating the liquid ejection head 3 according to the embodiment. The liquid ejection head 3 is a line type liquid ejection head in which fifteen print element boards 310 capable of ejecting inks of four colors of cyan C, magenta M, yellow Y, and black K are arranged in series (an in-line arrangement). As illustrated in FIG. 22A, the liquid ejection head 3 includes the print element boards 310 and a signal input terminal 91 and a power supply terminal 92. These terminals 91 and 92 are electrically connected to the print element board 310 through a flexible circuit board 40 and an electric wiring board 90. The signal input terminal 91 and the power supply terminal 92 are electrically connected to the control unit of the printing apparatus 1000 so that an ejection drive signal and power necessary for the ejection are supplied to the print element board 310. When the wirings are integrated by the electric circuit inside the electric wiring board 90, the number of the signal input terminals 91 and the power supply terminals 92 can be decreased compared with the number of the print element boards 310. Accordingly, the number of electrical connection components to be separated when the liquid ejection head 3 is assembled to the printing apparatus 1000 or the liquid ejection head is replaced decreases. As illustrated in FIG. 22B, the liquid connection portions 111 which are provided at both ends of the liquid ejection head 3 are connected to the liquid supply system of the printing apparatus 1000. Accordingly, the inks of four colors including cyan C, magenta M, yellow Y, and black K are supplied from the supply system of the printing apparatus 1000 to the liquid ejection head 3, and the inks passing through the liquid ejection head 3 are collected by the supply system of the printing apparatus 1000. In this way, the inks of different colors can be circulated through the path of the printing apparatus 1000 and the path of the liquid ejection head 3.

Figure 23:
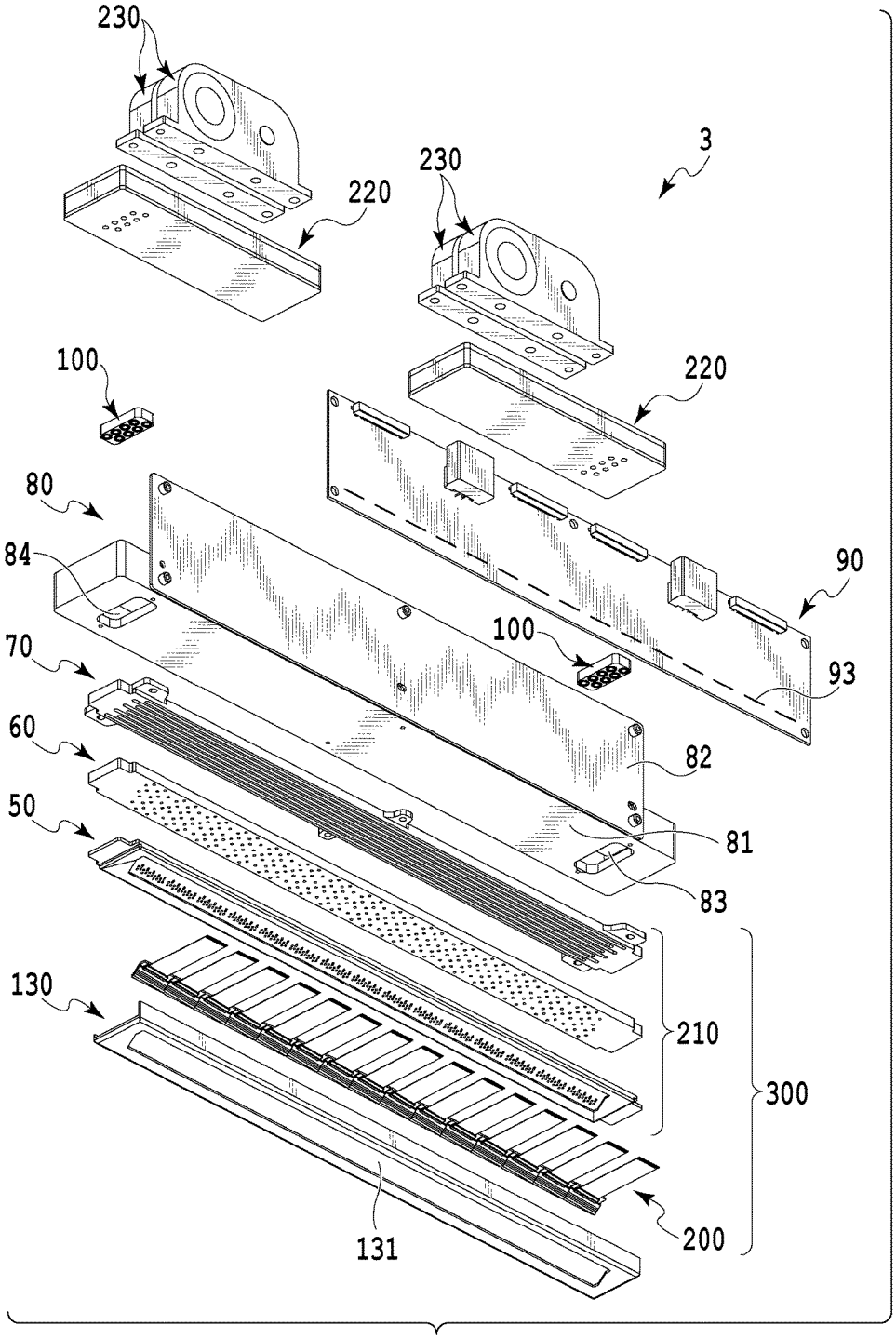
FIG. 23 is an exploded perspective view illustrating the liquid ejection head.

FIG. 23 is an exploded perspective view illustrating components or units constituting the liquid ejection head 3. The liquid ejection unit 300, the liquid supply unit 220, and the electric wiring board 90 are attached to the casing 380. The liquid connection portions 111 (see FIG. 20) are provided in the liquid supply unit 220. Also, in order to remove a foreign material in the supplied ink, filters 221 (see FIGS. 19 and 20) for different colors are provided inside the liquid supply unit 220 while communicating with the openings of the liquid connection portions 111. Two liquid supply units 220 respectively provided with the filters 221 corresponding to two colors. In the first circulation configuration as illustrated in FIG. 19, the liquid passing through the filter 221 is supplied to the negative pressure control unit 230 disposed on the liquid supply unit 220 disposed to correspond to each color. The negative pressure control unit 230 is a unit which includes negative pressure control valves corresponding to different colors. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change negative pressure at the downstream side (liquid ejection unit 300 side) of the negative pressure control unit within a predetermined range. As described in FIG. 19, two negative pressure control valves corresponding to each color are built inside the negative pressure control unit 230. Two negative pressure control valves are respectively set to different control pressures. Here, the high pressure side of the two negative pressure control valves communicates with the common supply passage 211 (see FIG. 19) inside the liquid ejection unit 300 through the liquid supply unit 220, and the low pressure side of the two negative pressure control valves communicates with the common collection passage 212 (see FIG. 19) through the liquid supply unit 220.

The casing 380 includes a liquid ejection unit support portion 381 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 381 by screws. The liquid ejection unit support portion 381 is used to correct the warpage or deformation of the liquid ejection unit 300 to ensure the relative position accuracy among the print element boards 310. Accordingly, stripe and unevenness of an image printed on the medium is suppressed. For that reason, it is desirable that the liquid ejection unit support portion 381 have sufficient rigidity. As a material, metal such as SUS or aluminum or ceramic such as alumina is desirable. The liquid ejection unit support portion 381 is provided with openings 83 and 84 into which a joint rubber 100 is inserted. The liquid supplied from the liquid supply unit 220 is led to a third passage member 370 constituting the liquid ejection unit 300 through the joint rubber 100.

The liquid ejection unit 300 includes a plurality of ejection modules 200 and a passage member 210, and a cover member 130 is attached to a face near the print medium in the liquid ejection unit 300. Here, the cover member 130 is a member having a picture frame shaped surface and provided with an elongated opening 131 as illustrated in FIG. 23, and the print element board 310 and a sealing member 110 (see FIG. 27A to be described later) included in the ejection module 200 are exposed from the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 23, the passage member 210 is obtained by laminating a first passage member 50, a second passage member 60, and a third passage member 370, and distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 381 by screws and thus the warpage or deformation of the passage member 210 is suppressed.

Figure 24:
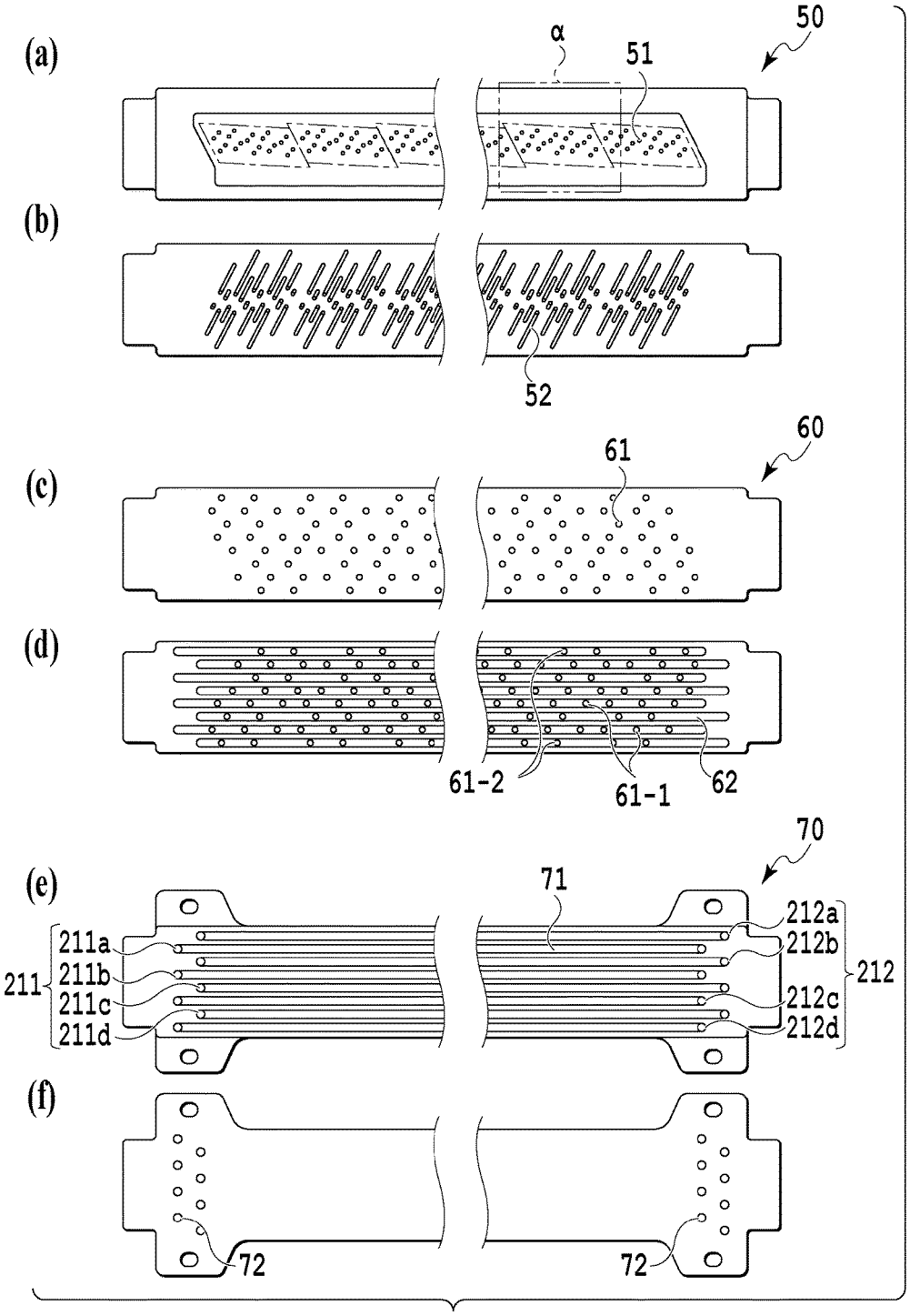
FIG. 24 is a diagram illustrating front and rear faces of first, second, and third passage members in the liquid ejection head.

Parts (a) to (f) of FIG. 24 are diagrams illustrating front and rear faces of the first to third passage members. The part (a) of FIG. 24 illustrates a face of the first passage member 50 onto which the ejection module 200 is mounted, and the part (f) of FIG. 24 illustrates a face of the third passage member 370 with which the liquid ejection unit support portion 381 comes into contact. The first passage member 50 and the second passage member 60 are bonded to teach other so that the parts illustrated in the parts (b) and (c) of FIG. 24 corresponding to the contact faces of the passage members 50 and 60 face each other. The second passage member 60 and the third passage member 370 are bonded to each other so that the parts illustrated in the parts (d) and (e) of FIG. 24 corresponding to the contact faces of the passage members 60 and 370 face each other. When the second passage member 60 and the third passage member 370 are bonded to each other, eight common passages (211*a*, 211*b*, 211*c*, 211*d*, 212*a*, 212*b*, 212*c*, 212*d*) extending in the longitudinal direction of the passage member are formed by common passage grooves 362 and 371 of the passage members. Accordingly, a set of the common supply passage 211 and the common collection passage 212 is formed inside the passage member 210 to correspond to each color. The ink is supplied from the common supply passage 211 to the liquid ejection head 3, and the ink supplied to the liquid ejection head 3 is collected by the common collection passage 212. A communication opening 72 (see the part (f) of FIG. 24) of the third passage member 370 communicates with the corresponding hole of the joint rubber 100, and is fluid-connected to the liquid supply unit 220 (see FIG. 23). A bottom face of the common passage groove 362 of the second passage member 60 is provided with a plurality of communication openings 361 (a communication opening 361-1 communicating with the common supply passage 211 and a communication opening 361-2 communicating with the common collection passage 212). Such a communication openings 361 communicates with one end of a corresponding individual passage groove 352 of the first passage member 50. The other end of the individual passage groove 352 of the first passage member 50 is provided with a communication opening 351, and is fluid-connected to the ejection modules 200 through the communication opening 351. By the individual passage groove 352, the passages can be densely provided at the center side of the passage member.

It is desirable that the first to third passage members be formed of a material having corrosion resistance with respect to a liquid and having a low linear expansion coefficient. As a material, for example, a composite material (resin) obtained by adding inorganic filler such as fiber or fine silica particles to a base material such as alumina, LCP (liquid crystal polymer), PPS (polyphenyl sulfide), PSF (polysulfone), or modified PPE (polyphenylene ether) can be appropriately used. As a method of forming the passage member 210, three passage members may be laminated and adhered to one another. When a resin composite material is selected as a material, a bonding method using welding may be used.

Figure 25:
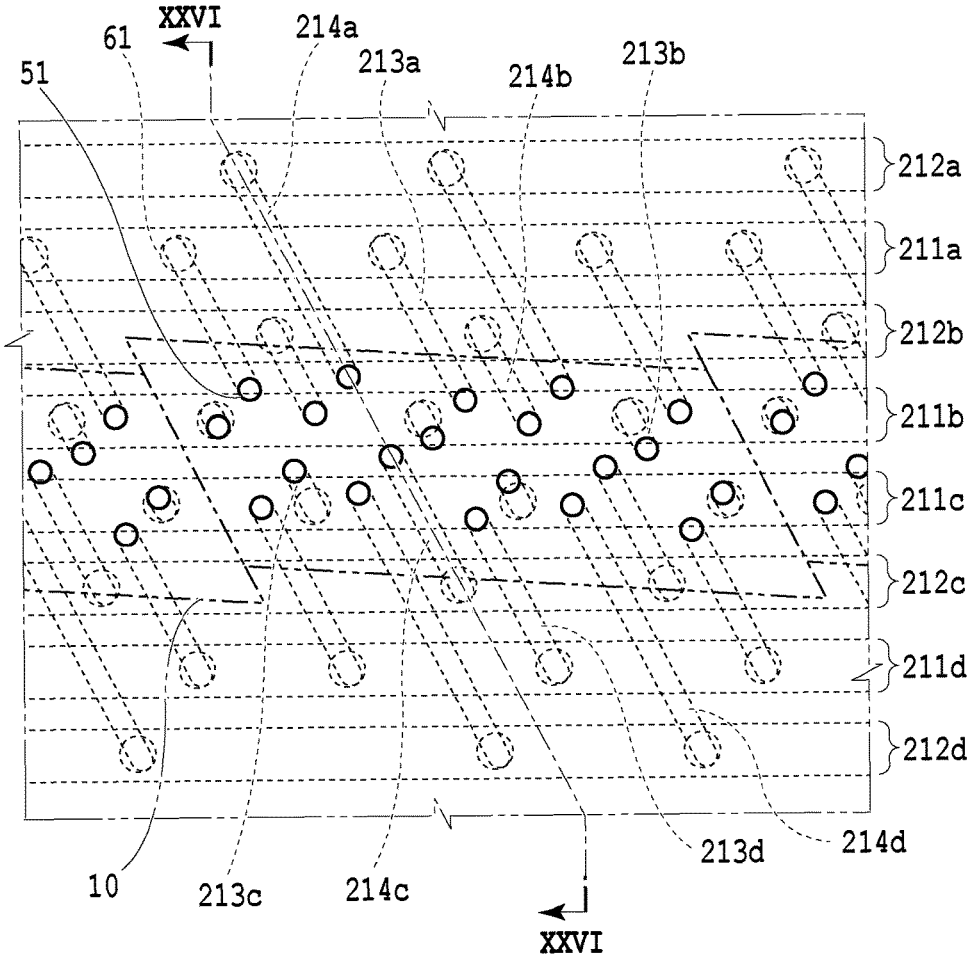
FIG. 25 is an enlarged perspective view illustrating passages formed by bonding the first, second, and third passage members.

FIG. 25 is a partially enlarged perspective view illustrating a part α of the part (a) of FIG. 24 and illustrating the passages inside the passage member 210 formed by bonding the first to third passage members to one another when viewed from a face onto which the ejection module 200 is mounted on the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

In the passage member 210, the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 are provided for each color. The individual supply passages 213 (213*a*, 213*b*, 213*c*, 213*d*) which are formed by the individual passage grooves 352 are connected to the common supply passages 211 of different colors through the communication openings 361. Further, the individual collection passages 214 (214*a*, 214*b*, 214*c*, 214*d*) formed by the individual passage grooves 352 are connected to the common collection passages 212 of different colors through the communication openings 361. With such a passage configuration, the ink can be intensively supplied to the print element board 310 located at the center portion of the passage member from the common supply passages 211 through the individual supply passages 213. Further, the ink can be collected from the print element board 310 to the common collection passages 212 through the individual collection passages 214.

Figure 26:
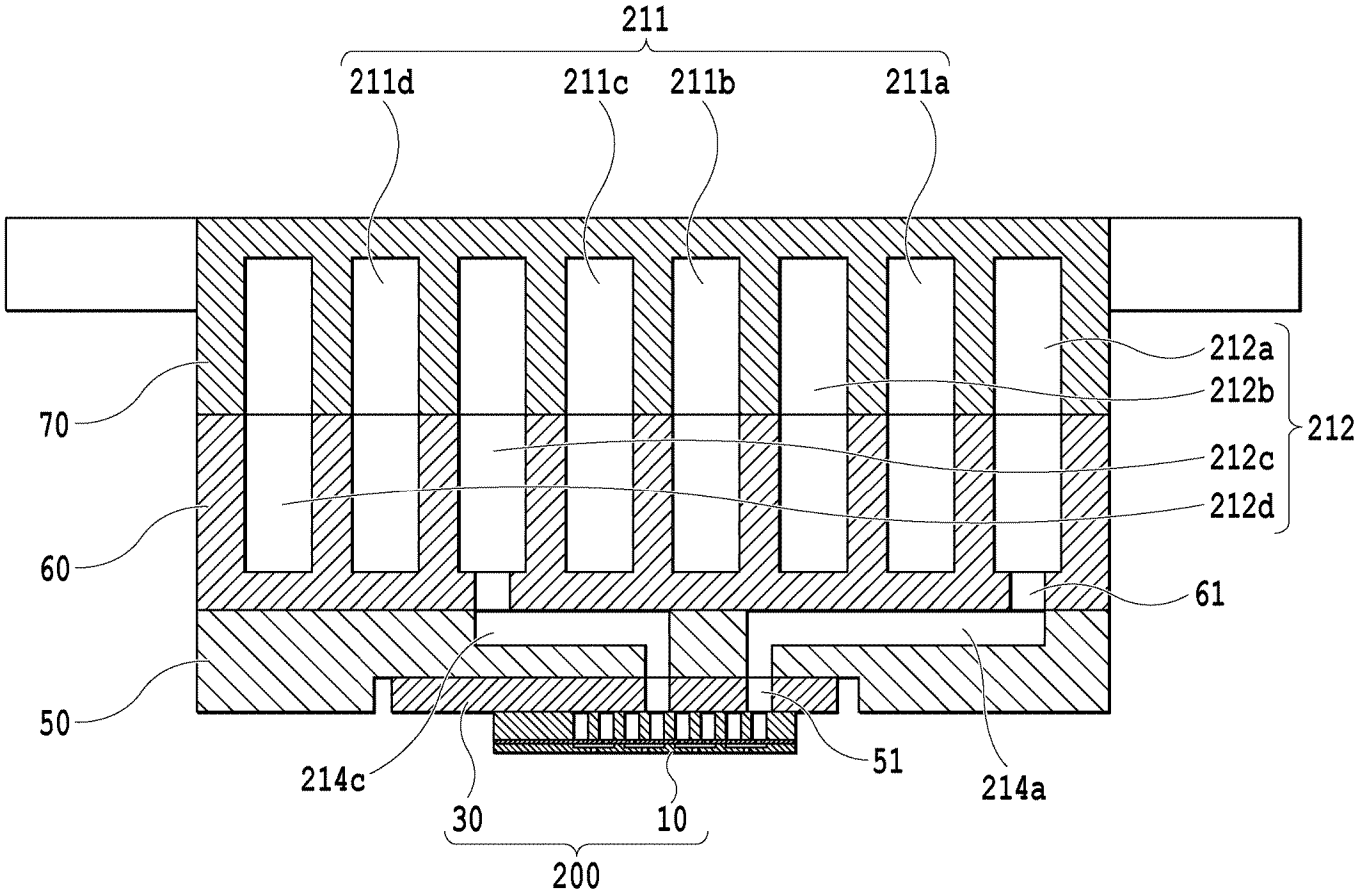
FIG. 26 is a cross-sectional view taken along a line XXVI-XXVI of FIG. 25.

FIG. 26 is a cross-sectional view taken along a line XXVI-XXVI of FIG. 25. The individual collection passages (214*a*, 214*c*) communicate with the ejection module 200 through the communication openings 351. In FIG. 26, only the individual collection passages (214*a*, 214*c*) are illustrated, but in a different cross-section, the individual supply passages 213 and the ejection module 200 communicates with each other as illustrated in FIG. 25. A support member 330 and the print element board 310 which are included in each ejection module 200 are provided with passages which supply the ink from the first passage member 50 to a print element 315 provided in the print element board 310. Further, the support member 330 and the print element board 310 are provided with passages which collect (re-circulate) a part or the entirety of the liquid supplied to the print element 315 to the first passage member 50.

Here, the common supply passage 211 of each color is connected to the negative pressure control unit 230 (the high pressure side) of corresponding color through the liquid supply unit 220, and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 25 and 26, a liquid flow of each color is generated in order of the common supply passage 211, the individual supply passage 213, the print element board 310, the individual collection passage 214, and the common collection passage 212 inside the liquid ejection head of the embodiment having the passages connected to one another.

(Description of Ejection Module)

Figure 27A:
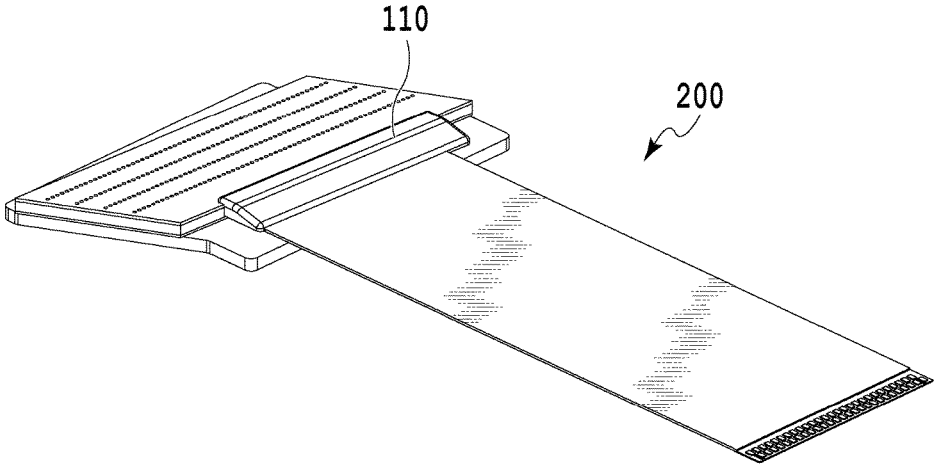
FIGS. 27A and 27B are perspective views respectively illustrating an ejection module.
Figure 27B:
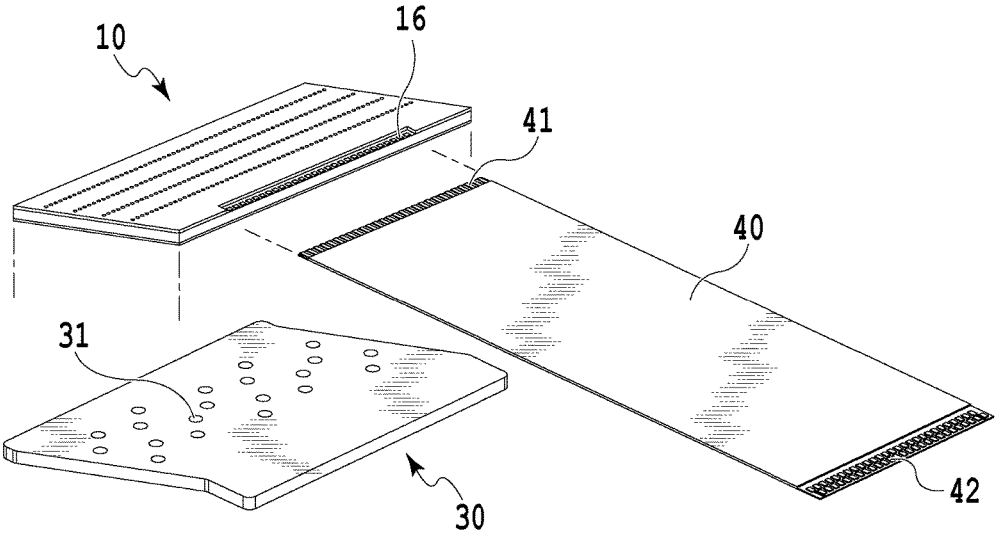

FIG. 27A is a perspective view illustrating one ejection module 200 and FIG. 27B is an exploded view thereof. As a method of manufacturing the ejection module 200, first, the print element board 310 and the flexible circuit board 40 are adhered onto the support member 330 provided with a liquid communication opening 31. Subsequently, a terminal 316 on the print element board 310 and a terminal 341 on the flexible circuit board 40 are electrically connected to each other by wire bonding, and the wire bonded portion (the electrical connection portion) is sealed by the sealing member 110. A terminal 342 which is opposite to the print element board 310 of the flexible circuit board 40 is electrically connected to a connection terminal 93 (see FIG. 23) of the electric wiring board 90. Since the support member 330 serves as a support body that supports the print element board 310 and a passage member that fluid-communicates the print element board 310 and the passage member 210 to each other, it is desirable that the support member 330 have high flatness and sufficiently high reliability while being bonded to the print element board. As a material, for example, alumina or resin is desirable.

(Description of Structure of Print Element Board)

FIG. 28A is a top view illustrating a face provided with an ejection opening 313 of the print element board 310, FIG. 28B is an enlarged view of a part A of FIG. 28A, and FIG. 28C is a top view illustrating a rear face of FIG. 28A. Here, a configuration of the print element board 310 of the embodiment will be described. As illustrated in FIG. 28A, an ejection opening forming member 312 of the print element board 310 is provided with four ejection opening arrays corresponding to different colors of inks. Further, the extension direction of the ejection opening arrays of the ejection openings 313 will be referred to as an "ejection opening array direction". As illustrated in FIG. 28B, the print element 315 serving as an ejection energy generation element for ejecting the liquid by heat energy is disposed at a position corresponding to each ejection opening 313. A pressure chamber 323 providing the print element 315 is defined by a partition wall 22. The print element 315 is electrically connected to the terminal 316 by an electric wire (not illustrated) provided in the print element board 310. Then, the print element 315 boils the liquid while being heated on the basis of a pulse signal input from a control circuit of the printing apparatus 1000 via the electric wiring board 90 (see FIG. 23) and the flexible circuit board 40 (see FIG. 27B). The liquid is ejected from the ejection opening 313 by a foaming force caused by the boiling. As illustrated in FIG. 28B, a liquid supply path 318 extends at one side along each ejection opening array and a liquid collection path 319 extends at the other side along the ejection opening array. The liquid supply path 318 and the liquid collection path 319 are passages that extend in the ejection opening array direction provided in the print element board 310 and communicate with the ejection opening 313 through a supply opening 317*a* and a collection opening 317*b*.

As illustrated in FIG. 28C, a sheet-shaped cover plate (lid member) 20 is laminated on a rear face of a face provided with the ejection opening 313 of the print element board 310, and the cover plate 20 is provided with a plurality of openings 20A communicating with the liquid supply path 318 and the liquid collection path 319. In the embodiment, the cover plate 20 is provided with three openings 20A for each liquid supply path 318 and two openings 20A for each liquid collection path 319. As illustrated in FIG. 28B, openings 20A of the cover plate 20 communicate with the communication openings 351 illustrated the part (a) of FIG. 24. It is desirable that the cover plate 20 have sufficient corrosion resistance for the liquid. From the viewpoint of preventing mixed color, the opening shape and the opening position of the opening 20A need to have high accuracy. For this reason, it is desirable to form the opening 20A by using a photosensitive resin material or a silicon plate as a material of the cover plate 20 through photolithography. In this way, the cover plate 20 changes the pitch of the passages by the opening 20A. Here, it is desirable to form the cover plate 20 by a film-shaped member with a thin thickness in consideration of pressure loss.

FIG. 29 is a perspective view illustrating cross-sections of the print element board 310 and the cover plate 20 when taken along a line XXIX-XXIX of FIG. 28A. Here, a flow of the liquid inside the print element board 310 will be described. The cover plate 20 serves as a lid that forms a part of walls of the liquid supply path 318 and the liquid collection path 319 formed in a substrate 311 of the print element board 310. The print element board 310 is formed by laminating the substrate 311 formed of Si and an ejection opening forming member 312 formed of photosensitive resin, and the cover plate 20 is bonded to a rear face of the substrate 311. One face of the substrate 311 is provided with the print element 315 (see FIG. 28B) and a rear face thereof is provided with grooves forming the liquid supply path 318 and the liquid collection path 319 extending along the ejection opening array. The liquid supply path 318 and the liquid collection path 319 which are formed by the substrate 311 and the cover plate 20 are respectively connected to the common supply passage 211 and the common collection passage 212 inside each passage member 210, and a differential pressure is generated between the liquid supply path 318 and the liquid collection path 319. When the liquid is ejected from the ejection opening 313 to print an image, at the ejection opening not ejecting the liquid, the liquid inside the liquid supply path 318 provided inside the substrate 311 flows toward the liquid collection path 319 through the supply opening 317*a*, the pressure chamber 323, and the collection opening 317*b* by the differential pressure (see an arrow C of FIG. 29). By the flow, foreign materials, bubbles, and thickened ink produced by the evaporation from the ejection opening 313, at the ejection opening 313 or the pressure chamber 323 not involved with a printing operation, can be collected by the liquid collection path 319. Further, the thickening of the ink in the ejection opening 313 or the pressure chamber 323 can be suppressed. The liquid which is collected to the liquid collection path 319 is collected in order of the communication opening 351 inside the passage member 210, the individual collection passage 214, and the common collection passage 212 through the opening 20A of the cover plate 20 and the liquid communication opening 31 (see FIG. 27B) of the support member 330. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the joint rubber 100, the communication opening 72 and the common passage groove 371 provided in the third passage member, the common passage groove 362 and the communication opening 361 provided in the second passage member, and the individual passage groove 353 and the communication opening 351 provided in the first passage member. Subsequently, the liquid is supplied to the pressure chamber 23 while sequentially passing through the liquid communication opening 31 provided in the support member 330, the opening 20A provided in the cover plate 20, and the liquid supply path 318 and the supply opening 317*a* provided in the substrate 311. In the liquid supplied to the pressure chamber 23, the liquid which is not ejected from the ejection opening 313 sequentially flows through the collection opening 317*b* and the liquid collection path 319 provided in the substrate 311, the opening 20A provided in the cover plate 20, and the liquid communication opening 31 provided in the support member 330. Subsequently, the liquid sequentially flows through the communication opening 351 and the individual passage groove 352 provided in the first passage member, the communication opening 361 and the common passage groove 362 provided in the second passage member, the common passage groove 371 and the communication opening 72 provided in the third passage member 370, and the hole of joint rubber 100. Then, the liquid flows from the liquid connection portion 111 provided in the liquid supply unit 220 to the outside of the liquid ejection head 3.

In the first circulation configuration illustrated in FIG. 19, the liquid which flows from the liquid connection portion 111 is supplied to the hole of the joint rubber 100 through the negative pressure control unit 230. Further, in the second circulation configuration illustrated in FIG. 20, the liquid which is collected from the pressure chamber 323 passes through the hole of joint rubber 100 and flows from the liquid connection portion 111 to the outside of the liquid ejection head through the negative pressure control unit 230. The entire liquid which flows from one end of the common supply passage 211 of the liquid ejection unit 300 is not supplied to the pressure chamber 323 through the individual supply passage 213*a*. That is, the liquid which flows from one end of the common supply passage 211 may flow from the other end of the common supply passage 211 to the liquid supply unit 220 while not flowing into the individual supply passage 213*a*. In this way, since the path is provided so that the liquid flows therethrough without passing through the print element board 310, the reverse flow of the circulation flow of the liquid can be suppressed even in the print element board 310 including the small passage with a large flow resistance as in the embodiment. In this way, since the thickening of the liquid in the vicinity of the ejection opening and the pressure chamber 23 can be suppressed in the liquid ejection head 3 of the embodiment, a slippage or a non-ejection of the liquid can be suppressed. As a result, a high-quality image can be printed.

(Description of Positional Relation Among Print Element Boards)

Figure 30:
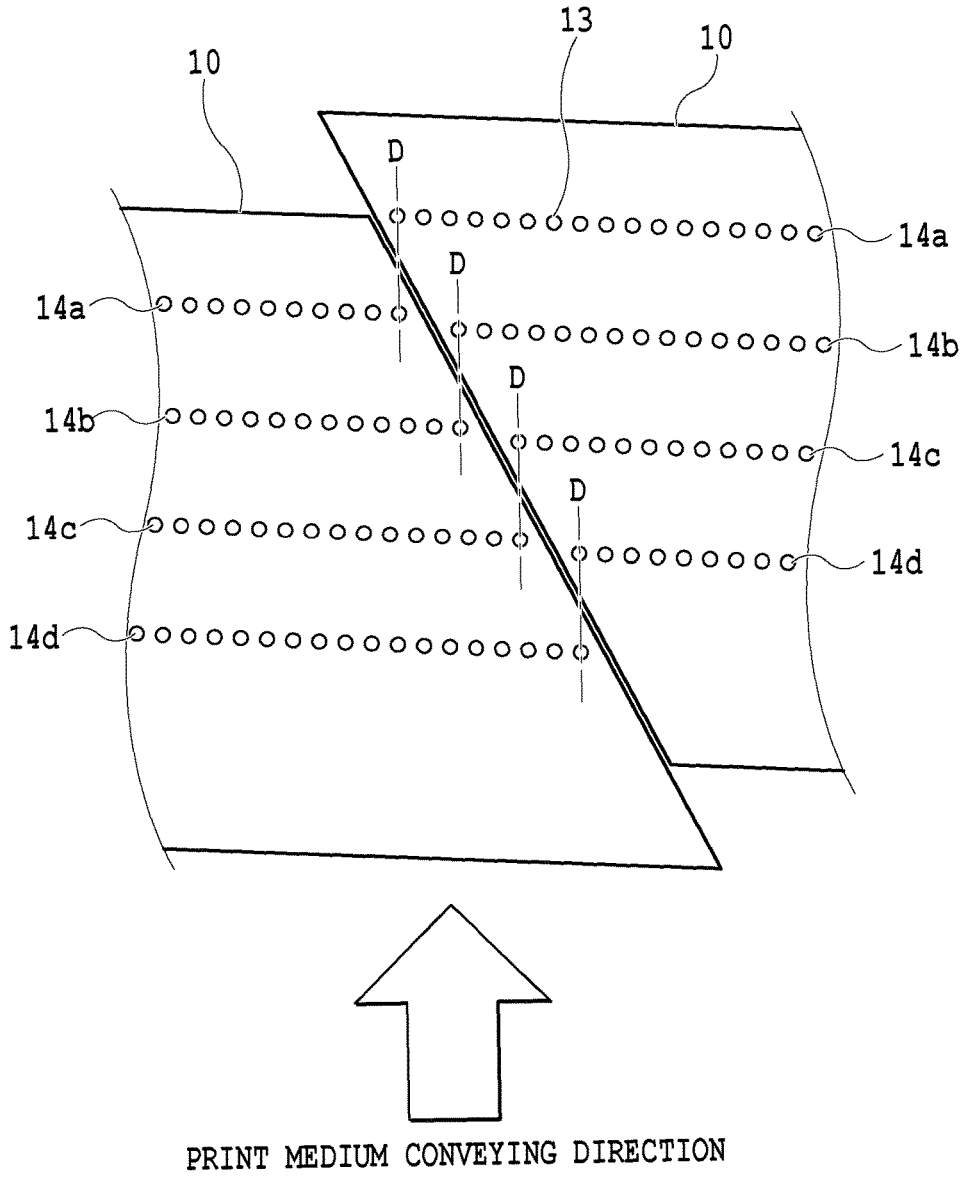
FIG. 30 is an enlarged top view of an adjacent portion of two print element boards.

FIG. 30 is a partially enlarged top view illustrating an adjacent portion of the print element board in two adjacent ejection modules. In the embodiment, a substantially parallelogram print element board is used. Ejection opening arrays (14*a* to 14*d*) having the ejection openings 313 arranged in each print element board 310 are disposed to be inclined while having a predetermined angle with respect to the longitudinal direction of the liquid ejection head 3. Then, the ejection opening array at the adjacent portion between the print element boards 310 is formed such that at least one ejection opening overlaps in the print medium conveying direction. In FIG. 30, two ejection openings on a line D overlap each other. With such an arrangement, even when a position of the print element board 310 is slightly deviated from a predetermined position, black streaks or missing of a print image can be rendered less noticeable by a driving control of the overlapping ejection openings. Even when the print element boards 310 are disposed in a straight linear shape (an in-line shape) instead of a zigzag shape, black streaks or missing at the connection portion between the print element boards 10 can be handled while an increase in the length of the liquid ejection head 3 in the print medium conveying direction is suppressed by the configuration illustrated in FIG. 30. Further, in the embodiment, a principal plane of the print element board has a parallelogram shape, but the present invention is not limited thereto. For example, even when the print element boards having a rectangular shape, a trapezoid shape, and the other shapes are used, the configuration of the present invention can be desirably used.

Fifth Embodiment

Hereinafter, configurations of an inkjet printing apparatus 2000 and a liquid ejection head 2003 according to a fifth embodiment of the present invention will be described with reference to the drawings. In the description below, only a difference from the fourth embodiment will be described and a description of the same components as those of the fourth embodiment will be omitted. Here, the same ink circulation path as that of the third embodiment is provided. Similarly to the third embodiment, when the monitoring area is set and the ink flow amount is controlled on the basis of the pressure loss of each monitoring area, the local pressure loss of the liquid ejection head can be suppressed.

(Description of Inkjet Printing Apparatus)

Figure 38:
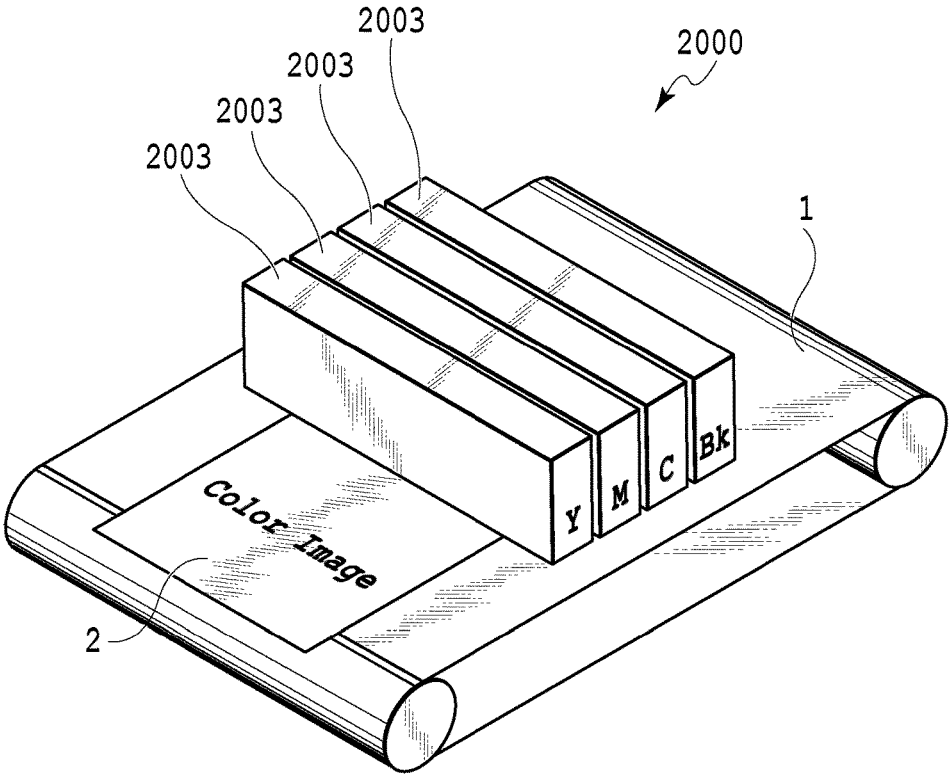
FIG. 38 is a diagram illustrating a fifth embodiment of the printing apparatus to which the present invention is applied.

FIG. 38 is a diagram illustrating the inkjet printing apparatus 2000 according to the embodiment used to eject the liquid. The printing apparatus 2000 of the embodiment is different from the first embodiment in that a full color image is printed on the print medium by a configuration in which four monochromic liquid ejection heads 2003 respectively corresponding to the inks of cyan C, magenta M, yellow Y, and black K are disposed in parallel. In the fourth embodiment, the number of the ejection opening arrays which can be used for one color is one. However, in the fifth embodiment, the number of the ejection opening arrays which can be used for one color is twenty. For this reason, when print data is appropriately distributed to a plurality of ejection opening arrays to print an image, an image can be printed at a higher speed. Further, even when there are the ejection openings that do not eject the liquid, the liquid is ejected complementarily from the ejection openings of the other arrays located at positions corresponding to the non-ejection openings in the print medium conveying direction. The reliability is improved and thus a commercial image can be appropriately printed. Similarly to the fourth embodiment, the supply system, the buffer tank 1003 (see FIGS. 19 and 20), and the main tank 1006 (see FIGS. 19 and 20) of the printing apparatus 2000 are fluid-connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the fourth embodiment, the first and second circulation configurations illustrated in FIG. 19 or 20 can be used as the liquid circulation configuration between the printing apparatus 2000 and the liquid ejection head 2003.

(Description of Structure of Liquid Ejection Head)

Figure 31A:
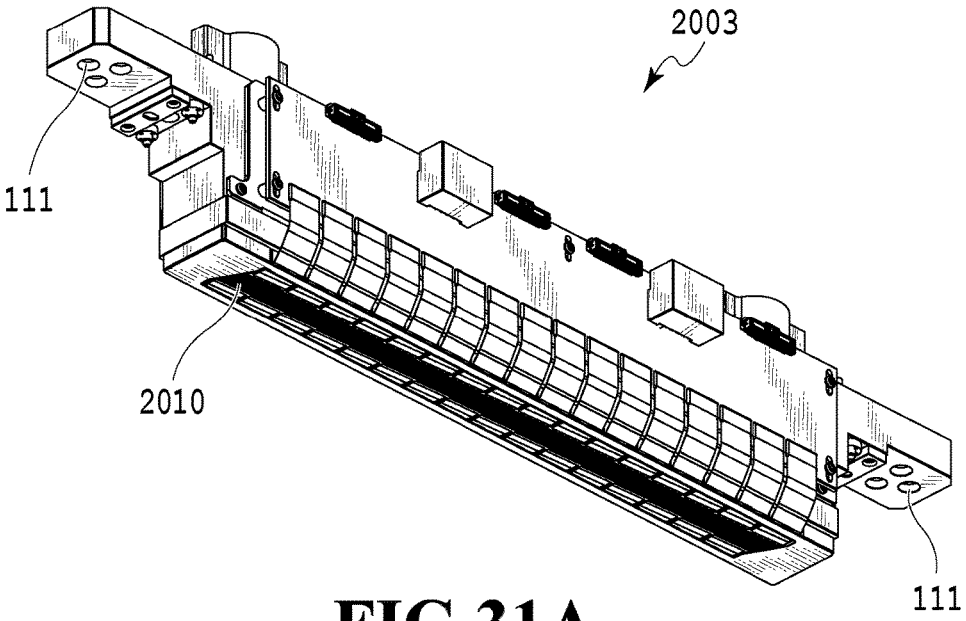
FIGS. 31A and 31B are perspective views respectively illustrating a liquid ejection head according to a fifth embodiment of the present invention.
Figure 31B:
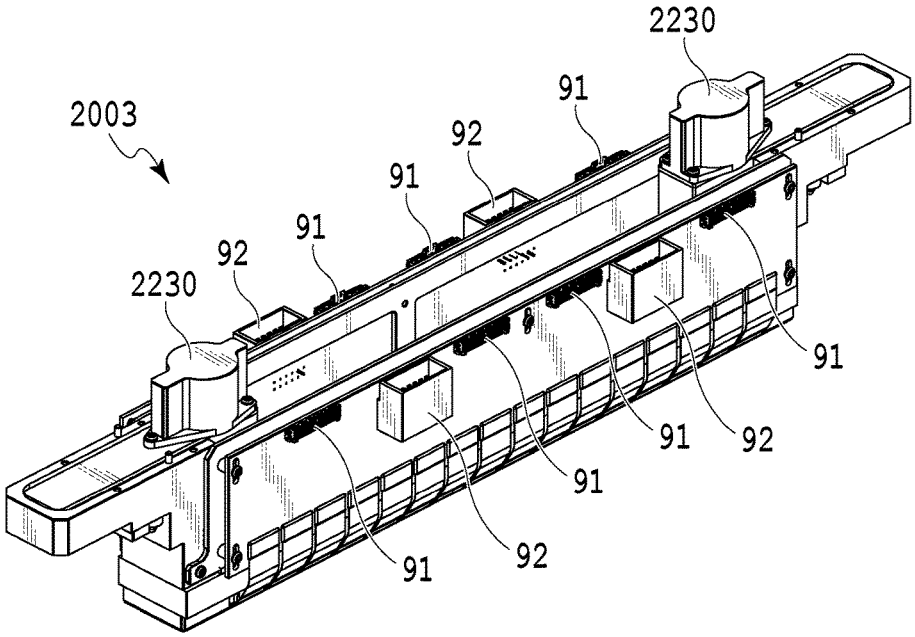

FIGS. 31A and 31B are perspective views illustrating the liquid ejection head 2003 according to the embodiment. Here, a structure of the liquid ejection head 2003 according to the embodiment will be described. The liquid ejection head 2003 is an inkjet line type liquid ejection head which includes sixteen print element boards 2010 arranged linearly in the longitudinal direction of the liquid ejection head 2003 and can print an image by one kind of liquid. Similarly to the first embodiment, the liquid ejection head 2003 includes the liquid connection portion 111, the signal input terminal 91, and the power supply terminal 92. However, since the liquid ejection head 2003 of the fifth embodiment includes many ejection opening arrays compared with the fourth embodiment, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 32:
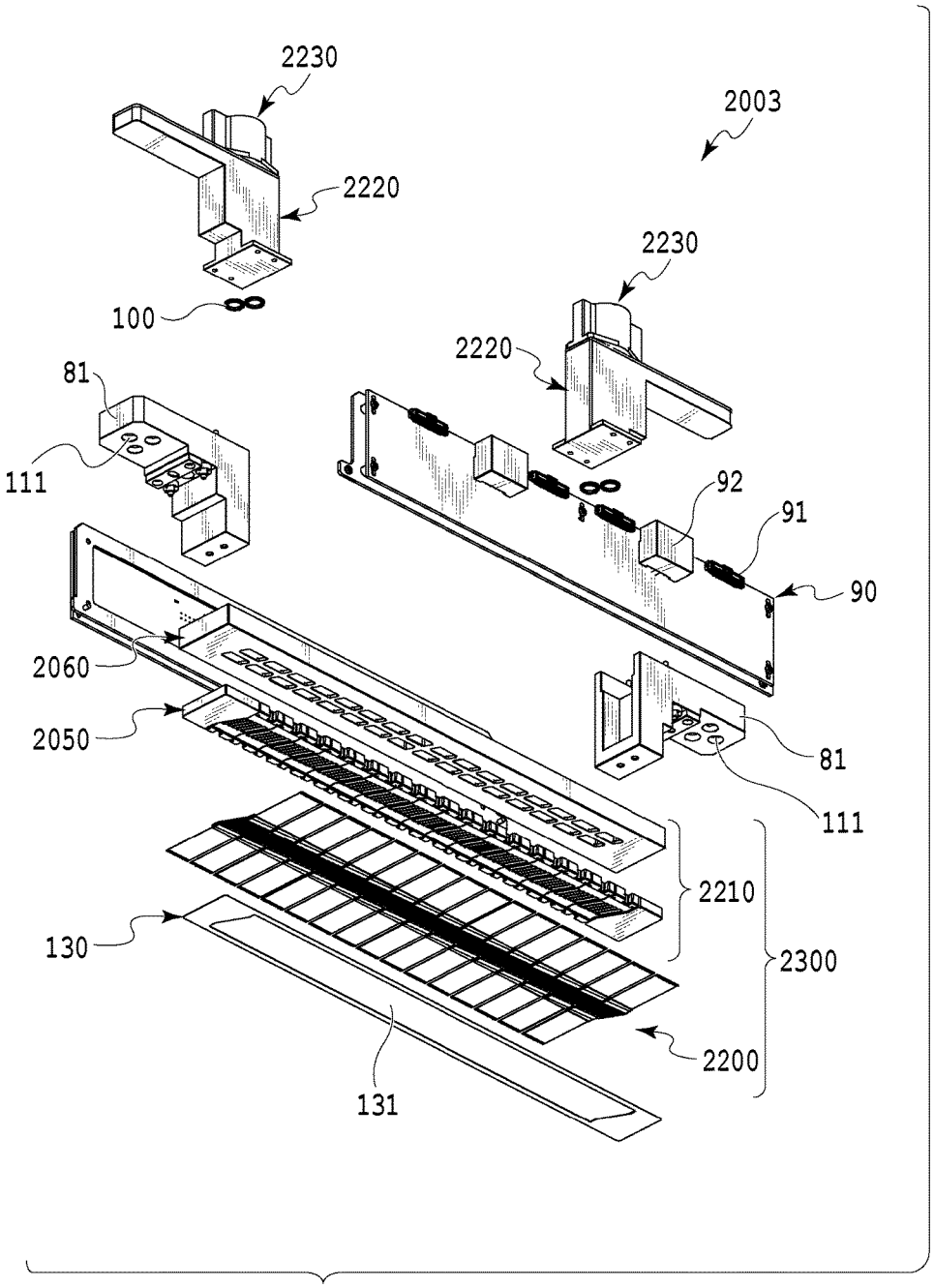
FIG. 32 is an exploded perspective view illustrating the liquid ejection head.

FIG. 32 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the fourth embodiment, but the function of guaranteeing the rigidity of the liquid ejection head is different. In the fourth embodiment, the rigidity of the liquid ejection head is mainly guaranteed by the liquid ejection unit support portion 381, but in the liquid ejection head 2003 of the fifth embodiment, the rigidity of the liquid ejection head 2003 is guaranteed by a second passage member 2060 included in a liquid ejection unit 2300. The liquid ejection unit support portion 381 of the fifth embodiment is connected to both ends of the second passage member 2060, and the liquid ejection unit 2300 is mechanically connected to a carriage of the printing apparatus 2000 to position the liquid ejection head 2003. The electric wiring board 90 and a liquid supply unit 2220 including a negative pressure control unit 2230 are connected to the liquid ejection unit support portion 381. Each of two liquid supply units 2220 includes a filter (not illustrated) built therein.

Two negative pressure control units 2230 are set to control a pressure at different (relatively high and low negative pressures). Further, as in FIGS. 31A, 31B, and 32, when the negative pressure control units 2230 at the high pressure side and the low pressure side are provided at both ends of the liquid ejection head 2003, the flows of the liquid in the common supply passage and the common collection passage extending in the longitudinal direction of the liquid ejection head 2003 face each other. In such a configuration, a heat exchange between the common supply passage and the common collection passage is promoted and thus a difference in temperature inside two common passages is reduced. Accordingly, a difference in temperature of the print element boards 2010 provided along the common passage is reduced. As a result, there is an advantage that unevenness in printing is not easily caused by a difference in temperature.

Next, a detailed configuration of a passage member 2210 of the liquid ejection unit 2300 will be described. As illustrated in FIG. 32, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, SUS, Ti, or alumina can be used.

Figure 33:
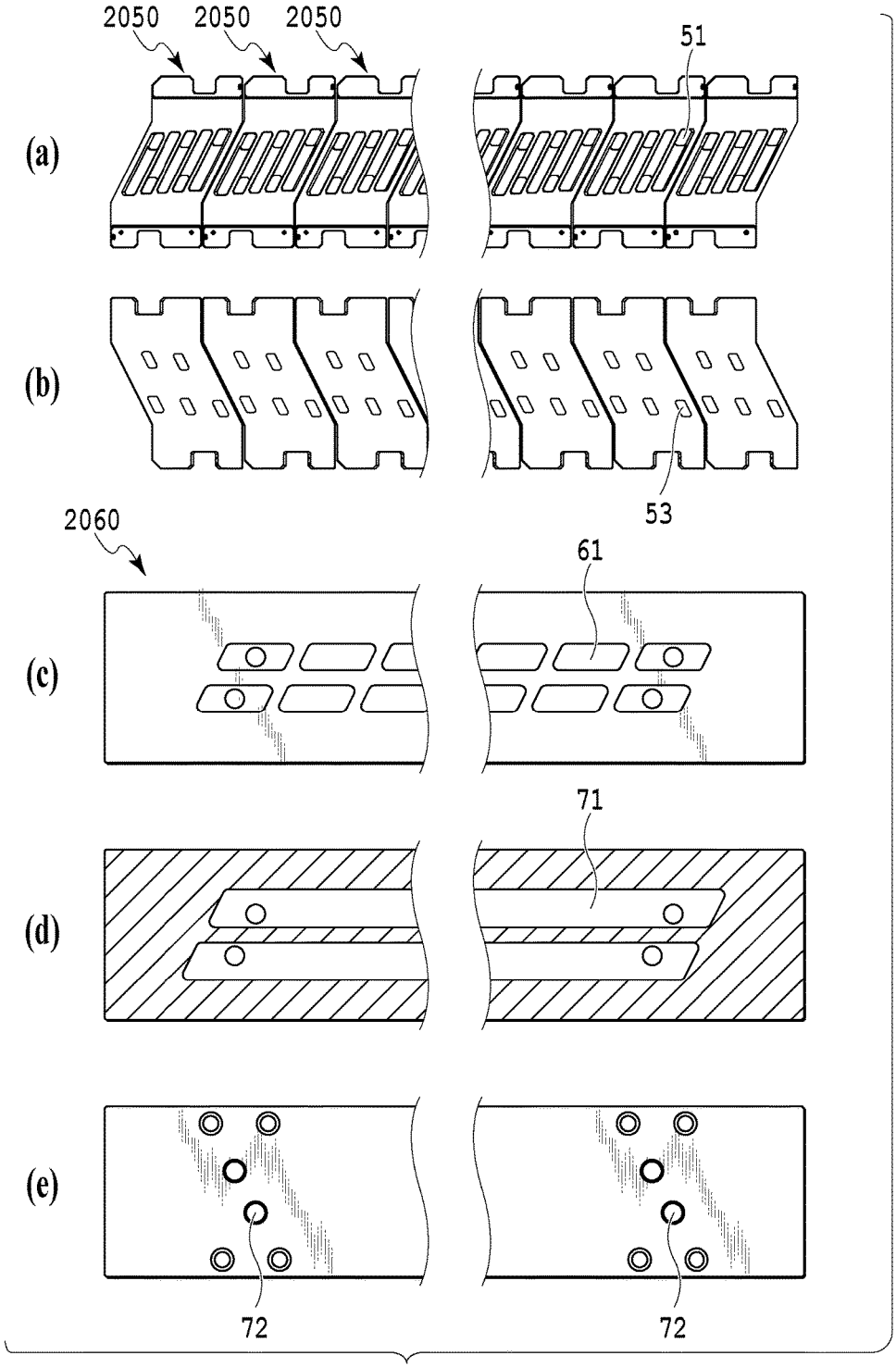
FIG. 33 is an explanatory diagram illustrating a passage member constituting the liquid ejection head.

A part (a) of FIG. 33 is a diagram illustrating a face of the first passage member 2050 onto which the ejection module 2200 is mounted, and a part (b) of FIG. 33 is a diagram illustrating a rear face thereof and a face contacting the second passage member 2060. Differently from the fourth embodiment, the first passage member 2050 of the fifth embodiment has a configuration in which a plurality of members corresponding to the ejection modules 2200 are disposed adjacently. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more. As illustrated in the part (a) of FIG. 33, the communication opening 351 of the first passage member 2050 fluid-communicates with the ejection module 2200. As illustrated in the part (b) of FIG. 33, the individual communication opening 353 of the first passage member 2050 fluid-communicates with the communication opening 361 of the second passage member 2060. A part (c) of FIG. 33 illustrates a contact face of the second passage member 60 with respect to the first passage member 2050, a part (d) of FIG. 33 illustrates a cross-section of a center portion of the second passage member 60 in the thickness direction, and a part (e) of FIG. 33 is a diagram illustrating a contact face of the second passage member 2060 with respect to the liquid supply unit 2220. The function of the communication opening and the passage of the second passage member 2060 is similar to each color of the fourth embodiment. The common passage groove 371 of the second passage member 2060 is formed such that one side thereof is a common supply passage 2211 illustrated in FIG. 34 and the other side thereof is a common collection passage 2212. These passages 2211 and 2212 are respectively provided along the longitudinal direction of the liquid ejection head 2003 so that the liquid is supplied from one end thereof to the other end thereof. The fifth embodiment is different from the fourth embodiment in that the liquid flow directions in the common supply passage 2211 and the common collection passage 2212 are opposite to each other.

Figure 34:
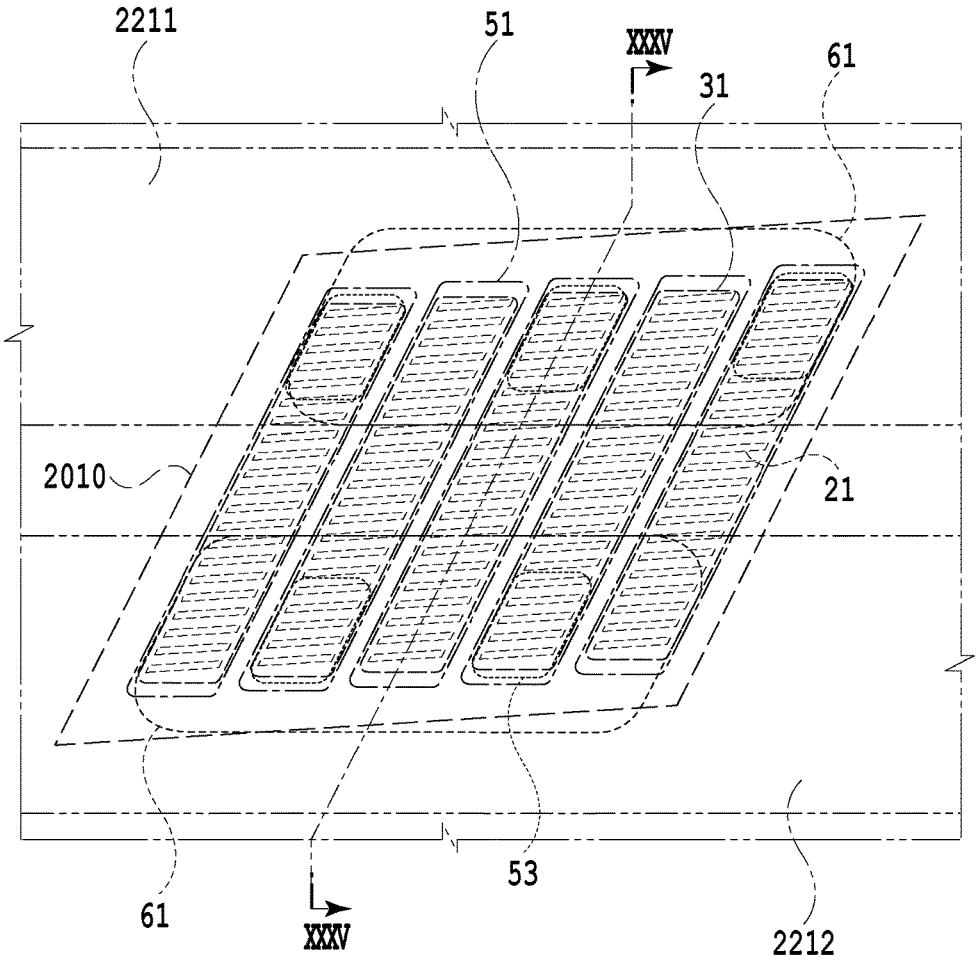
FIG. 34 is a perspective view illustrating a liquid connection relation between the print element board and the passage member in the liquid ejection head.

FIG. 34 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 361 of the second passage member 2060 is connected to the individual communication opening 353 of the first passage member 2050 so that both positions match each other. And thus a liquid supply passage communicating with the communication opening 351 of the first passage member 2050 through the communication opening 361 from the common supply passage 2211 of the second passage member 2060 is formed. Similarly, a liquid the supply path communicating with the communication opening 351 of the first passage member 2050 through the common collection passage 2212 from the communication opening 72 of the second passage member 2060 is also formed.

Figure 35:
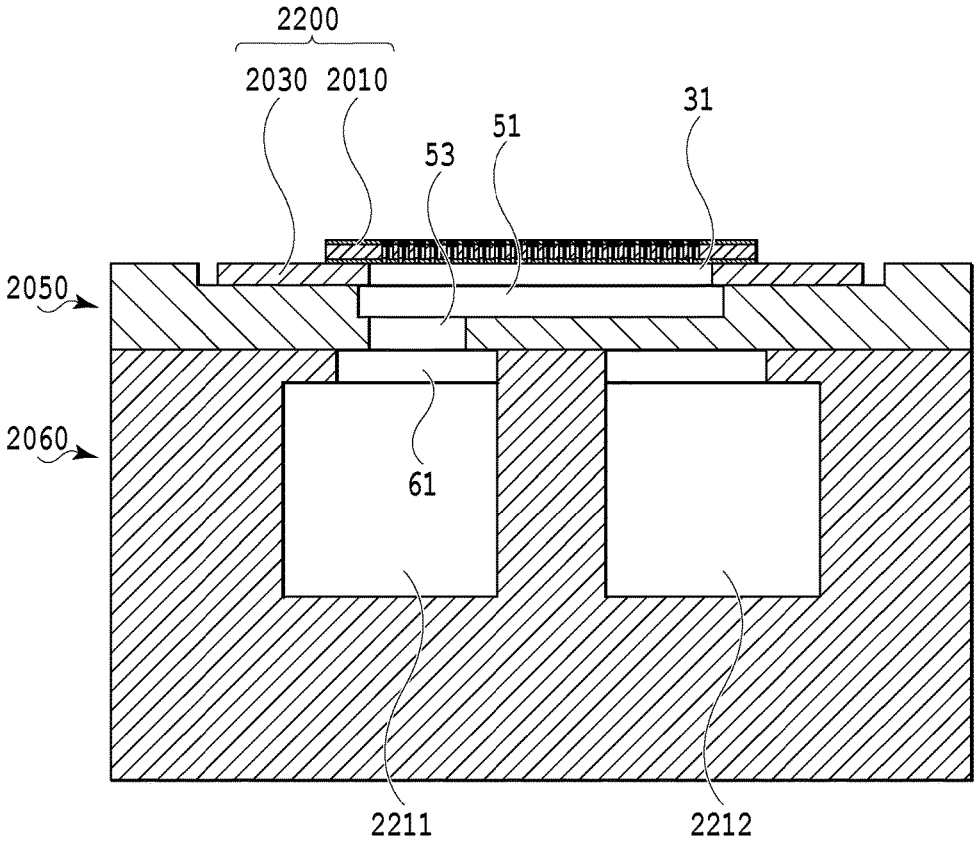
FIG. 35 is a cross-sectional view taken along a line XXXV-XXXV of FIG. 34.

FIG. 35 is a cross-sectional view taken along a line XXXV-XXXV of FIG. 34. The common supply passage 2211 is connected to the ejection module 2200 through the communication opening 361, the individual communication opening 353, and the communication opening 351. Although not illustrated in FIG. 35, it is obvious that the common collection passage 2212 is connected to the ejection module 2200 by the same path in a different cross-section in FIG. 34. Similarly to the fourth embodiment, each of the ejection module 2200 and the print element board 2010 is provided with a passage communicating with each ejection opening and thus a part or the entirety of the supplied liquid can be circulated while passing through the ejection opening that does not perform the ejection operation. Further, similarly to the fourth embodiment, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 36A:
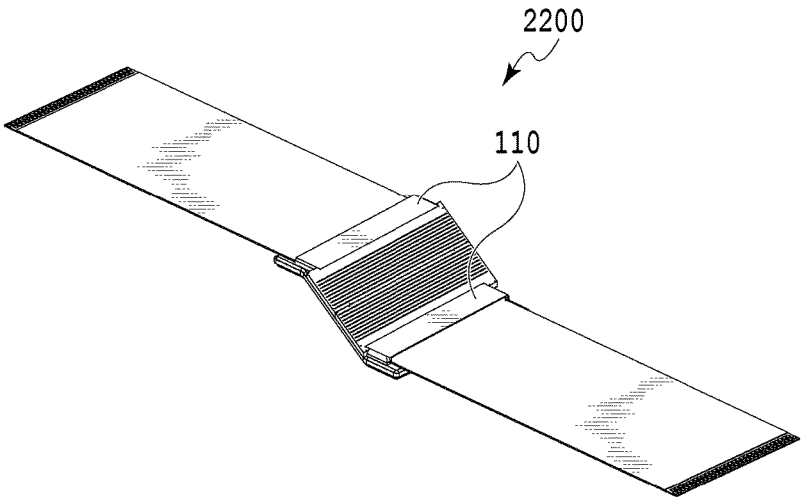
FIGS. 36A and 36B are perspective views illustrating an ejection module of the liquid ejection head.
Figure 36B:
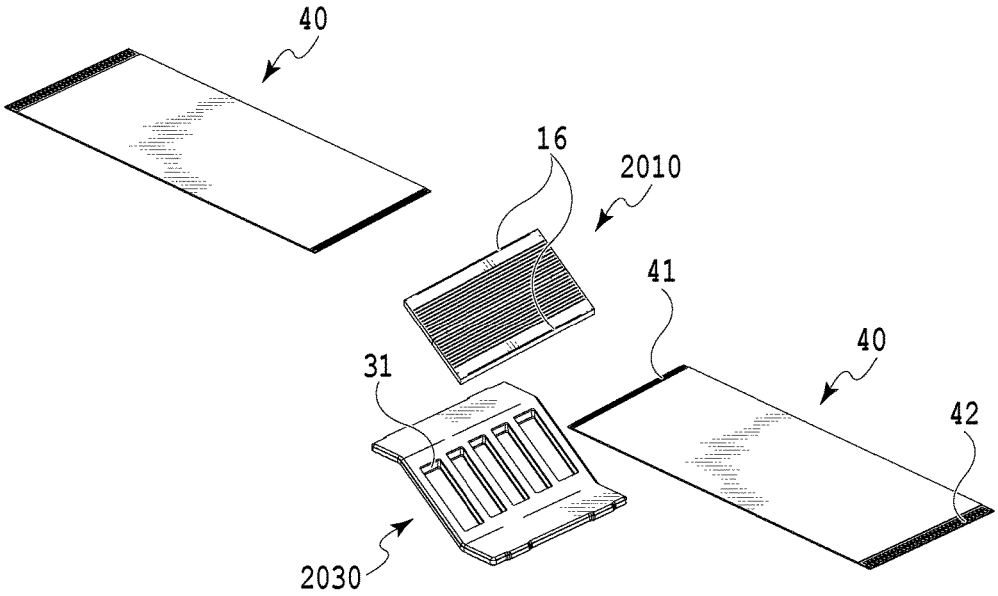

FIG. 36A is a perspective view illustrating one ejection module 2200 and FIG. 36B is an exploded view thereof. A difference from the fourth embodiment is that the terminals 316 are respectively disposed at both sides (the long side portions of the print element board 2010) in the ejection opening array directions on the print element board 2010. Accordingly, two flexible circuit boards 40 electrically connected to the print element board 2010 are disposed for each print element board 2010. Since the number of the ejection opening arrays provided in the print element board 2010 is twenty, the ejection opening arrays are more than eight ejection opening arrays of the fourth embodiment. Here, since a maximal distance from the terminal 316 to the print element is shortened, a decrease in voltage or a delay of a signal generated in the wiring portion inside the print element board 2010 is reduced. Further, the liquid communication opening 31 of the support member 2030 is opened along the entire ejection opening array provided in the print element board 2010. The other configurations are similar to those of the fourth embodiment.

(Description of Structure of Print Element Board)

Figure 37A:
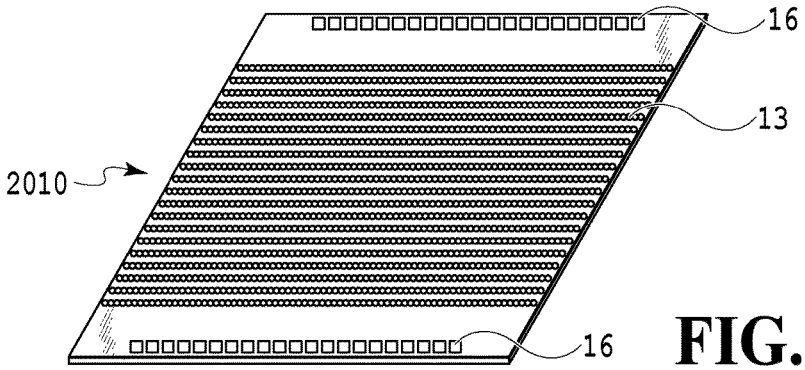
FIGS. 37A and 37B are explanatory diagrams illustrating the print element board.
Figure 37B:
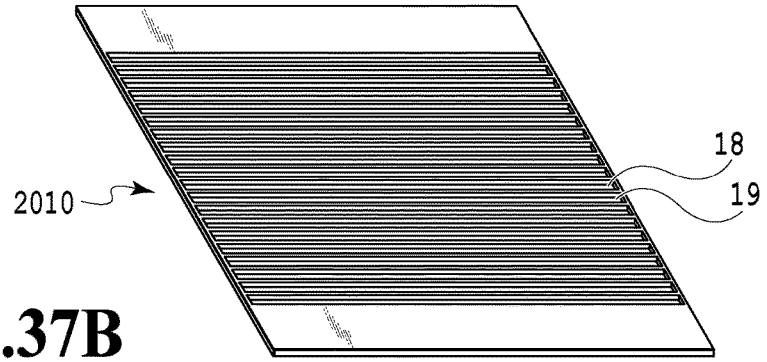
Figure 37C:
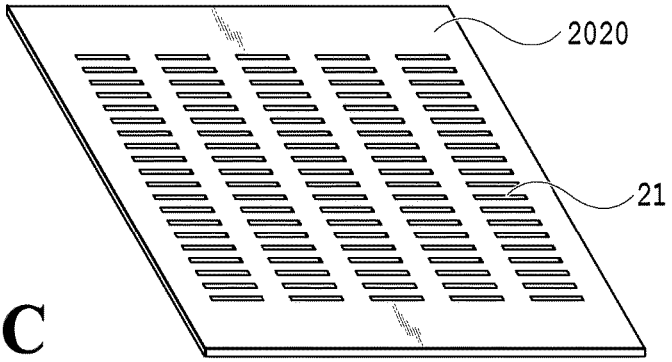
FIG. 37C is explanatory diagram illustrating the cover plate.

FIG. 37A is a schematic diagram illustrating a face of the print element board 2010 on which the ejection opening 313 is disposed, and FIG. 37C is a schematic diagram illustrating a rear face of the face of FIG. 37A. FIG. 37B is a schematic diagram illustrating a face of the print element board 2010 when a cover plate 2020 provided on the rear face of the print element board 2010 in FIG. 37C is removed. As illustrated in FIG. 37B, the liquid supply path 318 and the liquid collection path 319 are alternately provided along the ejection opening array direction at the rear face of the print element board 2010. The number of the ejection opening arrays is larger than that of the fourth embodiment. However, a basic difference from the fourth embodiment is that the terminal 316 is disposed at both sides of the print element board in the ejection opening array direction as described above. A basic configuration is similar to the fourth embodiment in that a pair of the liquid supply path 318 and the liquid collection path 319 is provided in each ejection opening array and the cover plate 2020 is provided with the opening 20A communicating with the liquid communication opening 31 of the support member 2030.

In addition, the description of the above-described embodiment does not limit the scope of the present invention. As an example, in the embodiment, a thermal type has been described in which bubbles are generated by a heating element to eject the liquid. However, the present invention can be also applied to the liquid ejection head which employs a piezo type and the other various liquid ejection types.

In the embodiment, the inkjet printing apparatus (the printing apparatus) has been described in which the liquid such as ink is circulated between the tank and the liquid ejection head, but the other embodiments may be also used. In the other embodiments, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the embodiment, an example of using a so-called line type head having a length corresponding to the width of the print medium has been described, but the present invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the present invention is not limited thereto. That is, a liquid ejection head which is shorter than the width of the print medium and includes a plurality of print element boards disposed so that the ejection openings overlap each other in the ejection opening array direction may be provided and the liquid ejection head may be scanned with respect to the print medium.

Sixth Embodiment

In the configuration examples of the first to fifth embodiments, the pressure loss is calculated the monitoring area corresponding to each of the inflow side opening 1401 and the collection side opening 1703 in a configuration in which the ink flows from the inflow side opening 1401 to the collection side opening 1703 through the pressure chamber 404. In the sixth embodiment, the pressure loss is calculated every unit of the monitoring area corresponding to each of divided areas within the print element board based on the ejection opening at the end side inside the print element board.

A description of the same components as those of the third to fifth embodiments will be omitted. Even in the embodiment, the ink circulation path is formed similarly to the third to fifth embodiments.

(Control Example of Ink Flow Amount)

Figure 39:
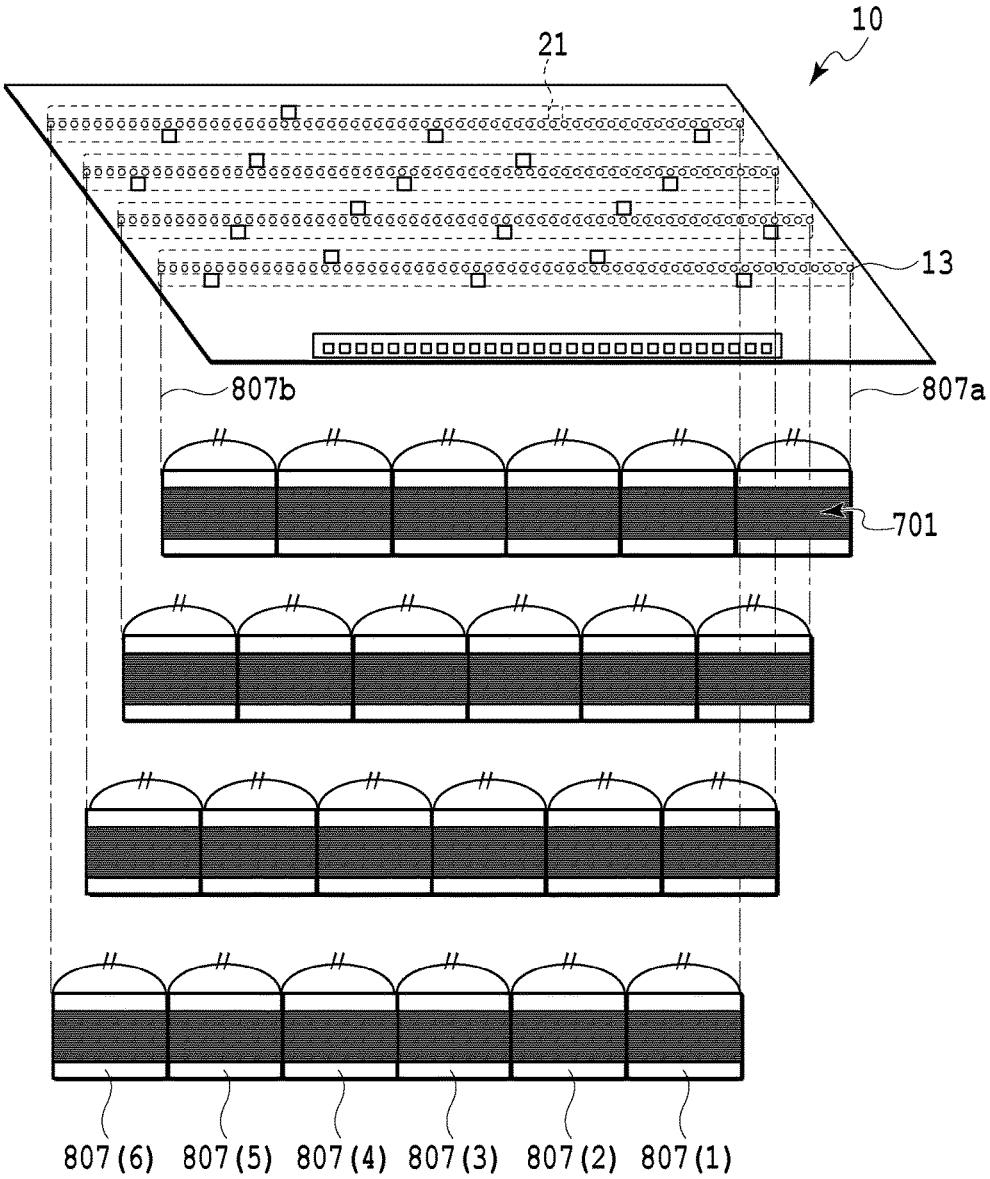
FIG. 39 is a diagram illustrating a configuration of a liquid ejection head according to a sixth embodiment of the present invention.

FIG. 39 is a top view illustrating a face provided with the ejection opening 13 in the print element board 10 similarly to FIG. 28A of the fourth embodiment. In the embodiment, an example of a printing apparatus which continuously prints an image by one pass and includes a page wide type liquid ejection head with a plurality of print element boards will be described. FIG. 39 illustrates one print element board which is located at the end side of the liquid ejection head. In FIG. 39, areas 807(1) to 807(6) which are uniformly divided from a position 807*a* of an ejection opening at one end to a position 807*b* of an ejection opening at the other end in one ejection opening array are set to as monitoring areas. In this case, when the ink flow amount is controlled on the basis of the pressure loss for each of the monitoring areas similar to the methods of the third to fifth embodiments, the local pressure loss in the liquid ejection head can be controlled.

Here, in the embodiment, the threshold value of the ink flow amount controlled for each monitoring area is set to a value in an area which has the largest gap between itself and the opening 21 of the cover plate 2020 (FIG. 37C) and has the largest pressure loss. For example, in FIG. 39, when both ends of the print element board 10 in the ejection opening arrangement direction are considered, the monitoring area 807(1) has a longest distance from the opening 21 of the cover plate to an end of the area. Since the pressure loss of the monitoring area 807(1) becomes the largest, the flow amount inside the monitoring area 807(1) is employed as the threshold value. Since the threshold value is set on the basis of an area in which the pressure loss hardly occurs, the printing operation can be performed when the printing duty is equal to or smaller than the threshold value even within the other monitoring areas inside the print element board.

In this case, the threshold value of the printing duty of each monitoring area can be provided as the same threshold value in all areas or a different threshold value in each of the areas. Further, the present invention is not limited thereto. For example, the threshold value can be changed every array and the threshold value can be provided every print element board.

Figure 40:
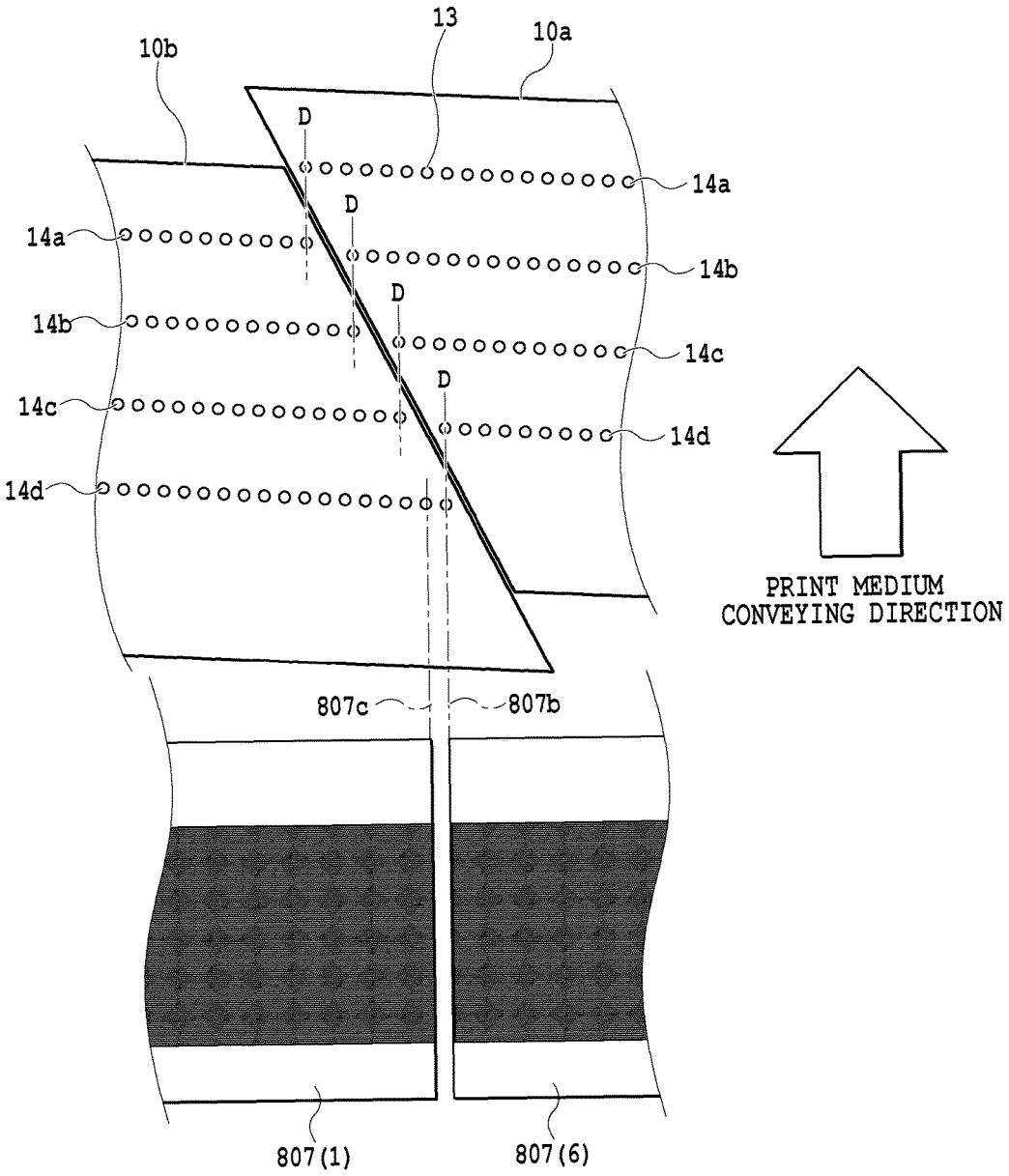
FIG. 40 is a diagram illustrating a configuration of the liquid ejection head according to the sixth embodiment of the present invention.

FIG. 40 illustrates a connection portion between the print element board 10*a* at the outermost end and the print element board 10*b* adjacent thereto in the page wide type liquid ejection head having the plurality of print element boards 10 and having the same configuration as that of FIG. 30 of the fourth embodiment. As illustrated in FIG. 39, the print element board 10*a* including the ejection opening position 807*a* at the end is set as a reference for dividing the monitoring area. In that case, the inside of the print element board 10*a* is equally divided (six divided parts 807(1) to 807(6)) as illustrated in FIG. 39. As described above, the print element board 10 has a substantially parallelogram shape and the ejection opening arrays 14*a* to 14*d* having the ejection openings 13 arranged in the print element board 10*a* are disposed to be inclined with respect to the print medium conveying direction by a predetermined angle. Then, the ejection opening arrays at the adjacent portions of the print element board 10*a* and 10*b* are formed so that at least one ejection opening overlaps in the print medium conveying direction. For that reason, for example, a start position of the monitoring area in the ejection opening array 14*d* of the print element board 10*b* is the ejection opening position 807*c* of the second nozzle in relation to the connection portion of the print element board 10*a*. Accordingly, the monitoring areas are deviated every adjacent print element boards. Thus, in the embodiment, there is also a place not including the opening 21 of the cover plate within the monitoring area in the page wide type liquid ejection head having the plurality of print element boards, but the pressure loss is controlled by the same threshold value as the other monitoring areas.

The liquid ejection head of the embodiment is not limited to the configurations illustrated in FIGS. 39 and 40. For example, the liquid ejection head may only have one print element board similarly to the second embodiment. Then, the embodiment can be also applied to such a liquid ejection head. Further, the number of the openings or divided monitoring areas is not limited to the embodiment. Further, in the embodiment, a principal plane of the print element board is formed in a parallelogram shape, but the present invention is not limited thereto. For example, even when the print element board formed in a rectangular shape, a trapezoid shape, or the other shapes is used, the configuration of the present invention can be desirably applied thereto. The monitoring areas may not overlap each other in the print medium conveying direction at the connection portion of the adjacent print element boards and the present invention is not limited thereto.

Other Embodiments

The present invention can be applied to various print type inkjet printing apparatuses and the print type includes a serial scan type and a full line type printing an image by the relative movement between the liquid ejection head and the printing medium.

Further, the present invention can be widely applied to a liquid ejection apparatus that uses a liquid ejection head capable of ejecting various liquids other in addition to the inkjet printing apparatus that prints an image by using the inkjet printing head capable of ejecting the ink. For example, the present invention can be applied to a printer, a copying machine, a facsimile having a communication system, a word processor having a printer, and an industrial printing apparatus combined with various processing devices. Further, the present invention can be used to manufacture a biochip or print an electronic circuit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002777 filed Jan. 8, 2016, and No. 2016-240450 filed Dec. 12, 2016, which are hereby incorporated by reference herein in their entirety.

What is claimed is:

1. A liquid ejection apparatus that ejects a liquid from a plurality of ejection openings of a liquid ejection head, the liquid ejection apparatus comprising:

a supply path configured to communicate with the plurality of ejection openings and to supply the liquid to a plurality of areas of the liquid ejection head;

a calculator configured to calculate a liquid flow amount on the basis of ejection data for ejecting the liquid from the plurality of ejection openings; and a controller configured to control, in a case where the liquid flow amount of at least one of the plurality of areas exceeds a predetermined flow amount, a liquid ejection amount per unit time from the liquid ejection head so that the liquid flow amount of each of the areas becomes the predetermined flow amount or less.

2. The liquid ejection apparatus according to claim 1, further comprising:

a movement mechanism configured to relatively move the liquid ejection head and a medium to which the liquid is ejected from the liquid ejection head, wherein the controller controls a liquid ejection frequency of the liquid ejection head and a movement speed of the movement mechanism.

3. The liquid ejection apparatus according to claim 1, wherein the supply path is provided for each of the plurality of areas.

4. The liquid ejection apparatus according to claim 1, wherein each area includes a sub-area connected to the supply path and a sub-area not connected to the supply path.

5. The liquid ejection apparatus according to claim 1, wherein the supply path is branched by units of each area corresponding to the ejection openings.

6. The liquid ejection apparatus according to claim 1, wherein the plurality of ejection openings are arranged to form a plurality of ejection openings arrays, and wherein the supply path is branched by units of the areas corresponding to each of the ejection opening arrays.

7. The liquid ejection apparatus according to claim 1, wherein the liquid ejection head includes a plurality of liquid ejection substrates provided with the ejection openings, and wherein the supply path is branched by units of the areas corresponding to each of the liquid ejection substrates.

8. The liquid ejection apparatus according to claim 1, wherein the liquid ejection head includes a plurality of passages communicating with the plurality of ejection openings and a plurality of openings communicating with the plurality of passages, and wherein the supply path is branched by units of the areas corresponding to each of the openings.

9. The liquid ejection apparatus according to claim 1, wherein the liquid ejection head includes an ejection energy generation element for ejecting the liquid, a pressure chamber provided with the ejection energy generation element, and a collection passage for collecting the liquid from the pressure chamber, and wherein the liquid ejection apparatus comprises a circulator configured to circulate the liquid through the supply path, the pressure chamber, and the collection passage.

10. An inkjet printing apparatus including the liquid ejection apparatus according to claim 1, wherein the liquid ejection head is an inkjet printing head capable of ejecting liquid ink, supplied through the supply path, through the plurality of ejection openings, and wherein the inkjet printing apparatus comprises a movement mechanism configured to relatively move the inkjet printing head and a printing medium to which ink ejected from the inkjet printing head is applied.

11. A liquid ejection method of ejecting a liquid from a plurality of ejection openings of a liquid ejection head, the liquid ejection method comprising the steps of:

supplying the liquid to each of a plurality of areas communicating with the plurality of ejection openings of the liquid ejection head through a plurality of supply paths corresponding to the plurality of areas;

calculating a liquid flow amount on the basis of ejection data for ejecting the liquid from the plurality of ejection openings; and controlling, in a case where the liquid flow amount of at least one of the plurality of areas exceeds a predetermined flow amount, a liquid ejection amount per unit time from the liquid ejection head so that the liquid flow amount of each of the areas becomes the predetermined flow amount or less.

* * * * *